US005719539A

United States Patent [19]

Ishizaki et al.

[11] Patent Number: 5,719,539

[45] Date of Patent: Feb. 17, 1998

[54] DIELECTRIC FILTER WITH MULTIPLE RESONATORS

[75] Inventors: Toshio Ishizaki, Kobe; Atsushi Sasaki, Toyonaka; Yuki Satoh, Katano; Hiroshi Kushitani, Izumisano; Hideaki Nakakubo, Souraku-gun; Toshiaki Nakamura, Nara; Kimio Aizawa, Ikoma; Takashi Fujino, Izumi, all of Japan

[73] Assignee: Matsushita Electric Industrial Co., Ltd., Osaka, Japan

[21] Appl. No.: 294,711

[22] Filed: Aug. 23, 1994

[30] Foreign Application Priority Data

| | | | |
|---|---|---|---|
| Aug. 24, 1993 | [JP] | Japan | 5-209292 |
| Oct. 19, 1993 | [JP] | Japan | 5-290800 |
| Nov. 17, 1993 | [JP] | Japan | 5-287948 |
| Mar. 25, 1994 | [JP] | Japan | 6-055534 |

[51] Int. Cl.[6] ..... H01P 1/203

[52] U.S. Cl. ..... 333/204; 333/219

[58] Field of Search ..... 333/202, 203, 333/204, 205, 219, 185

[56] References Cited

U.S. PATENT DOCUMENTS

| | | | |
|---|---|---|---|
| 4,431,977 | 2/1984 | Sokola et al. | 333/206 |
| 4,506,241 | 3/1985 | Makimoto et al. | 333/222 |
| 4,701,727 | 10/1987 | Wong | 333/204 |
| 4,742,562 | 5/1988 | Kommrusch | 455/78 |
| 5,124,676 | 6/1992 | Ueno | 333/206 |
| 5,144,268 | 9/1992 | Weidman | 333/204 |
| 5,248,949 | 9/1993 | Eguchi | 333/204 |
| 5,349,314 | 9/1994 | Shimizu et al. | 333/204 |
| 5,373,271 | 12/1994 | Hirai et al. | 333/205 |
| 5,416,454 | 5/1995 | McVeety | 333/204 |
| 5,448,209 | 9/1995 | Hirai et al. | 333/204 |

FOREIGN PATENT DOCUMENTS

| | | |
|---|---|---|
| 0499643 | 8/1992 | European Pat. Off. . |
| 0506476 | 9/1992 | European Pat. Off. . |
| 0510971 | 10/1992 | European Pat. Off. . |
| 4135435 | 4/1993 | Germany . |
| 63-128801 | 1/1988 | Japan . |
| 2-106701 | 8/1990 | Japan . |
| 3-72706 | 3/1991 | Japan . |
| 5-95202 | 4/1993 | Japan . |
| 2163606 | 2/1986 | United Kingdom . |

OTHER PUBLICATIONS

G. Mattaei; "Comb-Line Band-Pass Filters of Narrow or Moderate Bandwidth", pp. 82–91 (Aug., 1963).

J.D. Rhodes; "The Stepped Digital Elliptic Filter", IEEE Transactions on Microwave Theory and Techniques, vol. MTT-17, No. 4, pp. 178–184 (Apr. 1969).

R. Pregla; "Microwave Filters of Coupled Lines and Lumped Capacitances", IEEE Transactions on Microwave Theory and Techniques, pp. 278–280, (May 1970).

M. Makimoto et al; "Compact Bandpass Filters Using Stepped Impedance Resonators", Proceedings of the IEEe, vol. 67, No. 1, pp. 16–19, (Jan. 1979).

(List continued on next page.)

*Primary Examiner*—Robert Pascal
*Assistant Examiner*—David Vu
*Attorney, Agent, or Firm*—Morrison & Foerster LLP

[57] ABSTRACT

A dielectric antenna duplexer used in a high frequency radio device such as a portable telephone, and a dielectric filter for forming the duplexer of the SIR (stepped impedance resonator) composed by cascade connection of first transmission lines having one end grounded and second transmission lines having one end open and lower in characteristic impedance than in the first transmission lines, first transmission lines and second transmission lines are individually coupled in electromagnetic field, thereby forming an antenna duplexer and a dielectric filter of small insertion loss, high bandwidth selectivity, excellent band pass characteristic, and low cost.

42 Claims, 48 Drawing Sheets

OTHER PUBLICATIONS

T. Ishizaki et al; "A Very Small Dielectric Planar Filter For Portable Telephones" 1993 IEEE MTT-S Digest, pp. 177-180.

H. Kagata et al; "Low-Fire Microwave Dielectric Ceramics and Multilayer Devices With Silver Internal Electrode", Ceramic Transactions, vol. 32, 1993, pp. 81-90.

Partial European Search Report dated Dec. 7, 1995.

Curtis, J.A. et al., "Multi-Layered Planar Filters Based on Aperture Coupled, Dual Mode Microstrip or Stripline Resonators," IEEE MTT-S Int'l Microw. Symposium-Digest, vol. 3, 1992, Albuquerque, pp. 1203-1206.

Ishizaki, T. et al., "A Very Small Dielectric Planar Filter for Portable Telephones," IEEE MTT-S Int'l Microw. Symposium—Digest, vol. 1, 1993, Atlanta, pp. 177-180.

Kagata, H. et al., "Low-Fire Bismuth-Based Dielectric Ceramics for Microwave Use," Japanese Journal of Applied Physics, vol. 31, No. 9b, Sep. 1992, Tokyo, pp. 3152-3155.

Lo, Wen-Teng et al., "KBand Quasi-Planar Tapped Combline Filter and Diplexer," IEEE Transactions on Microwave Theory and Techniques, vol. 41, No. 2, Feb. 1993, New York, pp. 215-223.

Nishikawa, T., "RF Front End Circuit Components Miniaturized Using . . . ," Transactions of the Institute of Electronics, Information and Communication Engineers of Japan, vol. E74, No. 6, 1991, Tokyo, pp. 1556-1562.

Partial European Search Report dated Jan. 30, 1996.

PRIOR ART

PRIOR ART

DIELECTRIC FILTER WITH MULTIPLE RESONATORS

FIELD OF THE INVENTION

This invention relates to a dielectric antenna duplexer and a dielectric filter used mainly in high frequency radio devices such as mobile telephones. An antenna duplexer is a device for sharing one antenna by a transmitter and a receiver, and it is composed of a transmission filter and a reception filter. The invention is particularly directed to a laminated dielectric antenna duplexer having a laminate structure by laminating a dielectric sheet and an electrode layer and baking into one body. It also related to a laminated dielectric filter. The invention is further directed to a block type dielectric filter applying a circuit construction of the laminated dielectric filter of the invention into a conventional dielectric block structure.

BACKGROUND OF THE INVENTION

Along with the advancement of mobile communications, recently, the antenna duplexer is used widely in many hand-held telephones and car-mounted telephones. An example of a conventional antenna duplexer is described below with reference to a drawing.

FIG. 46 is a perspective exploded view of a conventional antenna duplexer. In FIG. 46, reference numerals 701 to 706 are dielectric coaxial resonators, 707 is a coupling substrate, 708 is a metallic case, 709 is a metallic cover, 710 to 712 are series capacitors, 713 and 714 are inductors, 715 to 718 are coupling capacitors, 721 to 726 are coupling pins, 731 is a transmission terminal, 732 is an antenna terminal, 733 is a reception terminal, and 741 to 747 are electrode patterns formed on the coupling substrate 707.

The dielectric coaxial resonators 701, 702, 703, series capacitors 710, 711, 712, and inductors 713, 714 are combined to form a transmission band elimination filter. The dielectric coaxial resonators 704, 705, 706, and coupling capacitors 715, 716, 717, 718 compose a reception band pass filter.

One end of the transmission filter is connected to a transmission terminal which is electrically connected with a transmitter, and the other end of the transmission filter is connected to one end of a reception filter, and is also connected to an antenna terminal electrically connected to the antenna. The other end of the reception filter is connected to a reception terminal which is electrically connected to a receiver.

The operation of an antenna duplexer is described below. First of all, the transmission band elimination filter shows a small insertion loss to the transmission signal in the transmission frequency band, and can transmit the transmission signal from the transmission terminal to the antenna terminal while hardly attenuating it. By contrast, it shows a larger insertion loss to the reception signal in the reception frequency band, and reflects almost all input signal in the reception frequency band, and therefore the reception signal entering from the antenna terminal returns to the reception band pass filter.

On the other hand, the reception band filter shows a small insertion loss to the reception signal in the reception frequency band, and transmits the reception signal from the antenna terminal to the reception terminal while hardly attenuating it. The transmission signal in the transmission frequency band shows a large insertion loss, and reflects almost all input signal in the transmission frequency band, so that the transmission signals coming from the transmission filter is sent out to the antenna terminal.

In this design, however, in manufacturing dielectric coaxial resonators, there is a limitation in fine processing of ceramics, and hence it is hard to reduce its size. Downsizing is also difficult because many parts are used such as capacitors and inductors, and another problem is the difficulty in lowering the assembling cost.

The dielectric filter is a constituent element of the antenna duplexer, and is also used widely as an independent filter in mobile telephones and radio devices, and there is a demand that they be smaller in size and higher in performance. Referring now to a different drawing, an example of a conventional block type dielectric filter possessing a different constitution from the above described structure is described below.

FIG. 47 is a perspective oblique view of a block type dielectric filter of the prior art. In FIG. 47, reference numeral 1200 is a dielectric block, 1201 to 1204 are penetration holes, and 1211 to 1214, and 1221, 1222, 1230 are electrodes. The dielectric block 1200 is entirely covered with electrodes, including the surface of the penetration holes 1201 to 1204, except for peripheral parts of the electrodes on the surface of which the electrodes 1221, 1222 and others are formed.

The operation of the thus constituted dielectric filter is described below. The surface electrodes in the penetration holes 1201 to 1204 serve as the resonator, and the electrode 1230 serves as the shield electrode. The electrodes 1211 to 1214 are to lower the resonance frequency of the resonator composed of the electrodes in the penetration holes, and functions as the loading capacity electrode. By nature, a ¼ wavelength front end short-circuit transmission line is not coupled at the resonance frequency and shows a band stop characteristic, but by thus lowering the resonance frequency, an electromagnetic field coupling between transmission lines occurs in the filter passing band, so that a band pass filter is created. The electrodes 1221, 1222 are input and output coupling capacity electrodes, and input and output coupling is effected by the capacity between these electrodes and the resonator, and the loading capacity electrode.

The operating principle of this filter is a modified version of a comb-line filter disclosed in the literature (for example, G. L. Matthaei, "Comb-Line Band-pass Filters of Narrow or Moderate Bandwidth"; the Microwave Journal, August 1963). The block type filter in this design is a comb-line filter composed of a dielectric ceramic (for example, see U.S. Pat. 4,431,977). The comb-line filter always requires a loading capacity for lowering the resonance frequency in order to realize the band pass characteristic.

FIG. 48 shows the transmission characteristic of the comb-line type dielectric filter in the prior art. The transmission characteristic shows the Chebyshev characteristic increasing steadily as the attenuation outside the bandwidth departs from the center frequency.

In this construction, however, it is not possible to realize the elliptical function characteristic possessing the attenuation pole near the bandwidth of the transmission characteristic, and hence the range of selection is not sufficient for filter performance.

Also, in such dielectric filter, for smaller and thinner constitution, the flat type laminate dielectric filter that can be made thinner than the coaxial type is expected henceforth, and several attempts have been made to design such a device. A conventional example of a laminated dielectric filter is described below. The following explanation relates to a laminated "LC filter" (trade mark) that is put into practical use as a laminated dielectric filter by forming lumped element type capacitors and inductors in a laminate structure.

FIG. 49 is a perspective exploded view showing the structure of a conventional laminate "LC filter". In FIG. 49, reference numerals 1 and 2 are thick dielectric layers. On a dielectric sheet 3 are formed inductor electrodes 3*a*, 3*b*, and capacitor electrodes 4*a*, 4*b* are formed on a dielectric sheet 4, capacitor electrodes 5*a*, 5*b* on a dielectric sheet 5, and shield electrodes 7*a*, 7*b* on a dielectric sheet 7. By stacking up all these dielectric layers and dielectric sheets together with a dielectric sheet 6 for protecting the electrodes, an entirely laminated structure is formed.

The operation of the thus constituted dielectric filter is described below. First, the confronting capacitor electrodes 4*a* and 5*a*, and 4*b* and 5*b* respectively compose parallel plate capacitors. Each parallel plate capacitor functions as a resonance circuit as connected in series to the inductor electrodes 3*a*, 3*b* through side electrodes 8*a*, 8*b*. Two inductors are coupled magnetically. The side electrode 8*b* is a grounding electrode, and the side electrode 8*c* is connected to terminals 3*c*, 3*d* connected to the inductor electrode to compose a band pass filter as input and output terminals (for example, Japanese Laid-open Patent No. 3-72706(1991)).

In such a constitution, however, when the inductor electrodes are brought closer to each other to narrow the interval in order to reduce in its size, the magnetic field coupling between the resonators becomes too large, and it is hard to realize a favorable band pass characteristic narrow in the bandwidth. It is moreover difficult to heighten the unloaded Q value of the inductor electrodes, and hence the filter insertion loss is large.

Another different conventional example of a laminated dielectric filter is described below with reference to an accompanying drawing. FIG. 50(*a*) and (*b*) shows the structure of a conventional laminated dielectric filter. In FIG. 50(*a*) and (*b*), ¼ wavelength strip lines 820, 821 are formed on a dielectric substrate 819. Input and output electrodes 823, 824 are formed on the same plane as the strip lines 820, 821. The strip line 820 is composed of a first portion 820*a* ($L_1$ indicates the length of 820*a*) having a first line width $W_1$ ($Z_1$ indicates the characteristic impedance of $W_1$) confronting the input and output electrodes 823, a second portion 820*b* ($L_2$ indicates the length of 820*b*) having a second line width narrower than the first line width $W_1$, and a third portion 820*c* having a third line width narrower than the first line width $W_1$ but broader than the second line width $W_2$ ($Z_2$ indicates the characteristic impedance of $W_2$). Similarly, the strip line 821 is composed of a first portion 821*a* having a first line width $W_1$ confronting the input and output electrodes 824, a second portion 821*b* having a second line width narrower than the first line width $W_1$, and a third portion 821*c* having a third line width narrower than the first line width $W_1$ but broader than the second line width $W_2$. The strip lines 820, 821 are connected with a short-circuit electrode 822, and the resonator 801*b* is in a pi-shape. A dielectric substrate 819 is covered by grounding electrodes 825, 826 at both surfaces. At one side 819*a*, side electrodes 827,828 are formed, and the grounding electrodes 825, 826, and short-circuit electrodes 822 are connected. On the other side 819*b*, side electrodes to be connected with the input and output electrodes 823, 824 respectively are formed. The strip lines 820, 821 are capacitively coupled with the input and output electrodes 823, 824, respectively, thereby constituting a filter as described for example, in U.S. Pat. No. 5,248,949.

In such constitution, however, same as the conventional block type dielectric filter, the elliptical function characteristic possessing the attenuation pole near the passing band of the transmission characteristic cannot be realized, and hence the scope of performance of the filter is not wide enough.

SUMMARY OF THE INVENTION

In view of the above-mentioned problems, it is hence a primary object of the invention to provide an antenna duplexer and dielectric filter at low cost which has an excellent band pass characteristic with small insection loss and high bandwidth selectivity. Another object is to provide a laminated dielectric antenna duplexer and laminate dielectric filter having a small and thin flat structure. It is a further object of the invention to provide a block type dielectric filter having low insection cost, possessing low insection loss and high band width selectivity and having the same circuit constitution as in the laminated dielectric filter described above.

In order to accomplish these and other objects and advantages, the first case of this invention provides a dielectric filter comprising at least two TEM (transverse electromagnetic) mode resonators having a stepped impedance resonator (SIR) structure with a total line length shorter than the quarter wavelength comprised by cascade connection of both ends of first transmission lines grounded at one end, and second transmission lines opened at one end having a characteristic impedance lower than the characteristic impedance of the first transmission lines, wherein the first transmission lines are coupled electromagnetically, the second transmission lines are coupled electromagnetically, each of electromagnetic field coupling amounts are set independently, and a passing band and an attenuation pole are generated in the transmission characteristic. According to the specified constitution, in the dielectric filter of the invention, not only is the resonator length shortened by the SIR structure, but also the passing band and attenuation pole can be freely formed at the designed frequency, so that a superior degree of selectivity is realized in a small size.

It is preferable that the open end of the TEM mode resonator is grounded with an electrical capacity. It is preferable that the TEM mode resonators and input and output terminals are coupled capacitively. In the dielectric filter of those embodiments, the resonance frequency can be further lowered by the loading capacity, and the resonator line length is shortened, so that the filter may be further reduced in size. In the capacitive coupling method, the filter can be reduced in size because the magnetic field coupling line in the conventional comb-line filter is not necessary. Further, because of capacitive coupling at the open end, a small coupling capacity is sufficient.

It is preferable that the attenuation pole frequency of the transmission characteristic is adjusted by varying the line distance of the first transmission lines and the line distance of the second transmission lines. In the dielectric filter of this embodiment, by adjusting the even/odd mode impedance ratio of the transmission line by the distance between lines, the degree of coupling can be changed only by changing the electrode pattern, and it is easy to realize, and it is free from deterioration of unloaded Q value of the resonator.

It is preferable that the line length of the first transmission lines and the line length of the second transmission lines are equalized. In the dielectric filter of this embodiment, by equalizing the line length of each transmission line of the SIR, not only can the resonator length be set to the shortest possible distance, but also a very complicated design formula can be summed up in a simple form, making it possible to design analytically.

It is preferable that the TEM mode resonator is comprised of an integrated coaxial resonator formed of a penetration hole provided in a dielectric block. It is preferable that the TEM mode resonator is comprised of a strip line resonator formed on a dielectric sheet. In the dielectric filter of the invention, when a block type coaxial resonator is used, it is easy to manufacture by pressing and baking the dielectric ceramic, and materials of high baking temperature and high dielectric constant can be selected, and the filter can be reduced in size. Additionally, since the unloaded Q value is high, the insertion loss can be reduced. On the other hand, when a strip line resonator is used, the thickness can be significantly reduced owing to the flat structure.

It is preferable that the value of dividing the even mode impedance by the odd mode impedance of the first transmission lines is set larger than the value of dividing the even mode impedance by the odd mode impedance of the second transmission lines. It is preferable that the value of dividing the even mode impedance by the odd mode impedance of the first transmission lines is set smaller than the value of dividing the even mode impedance by the odd mode impedance of the second transmission lines. In the dielectric filter of the invention as set forth in those embodiments, when the even/odd mode impedance ratio of the first transmission line is smaller than the even/odd mode impedance ratio of the second transmission line, a band pass filter possessing an attenuation pole at the low attenuation band (low-zero filter) can be made. Furthermore, when the even/odd mode impedance ratio of the first transmission line is larger than the even/odd mode impedance ratio of the second transmission line, a band pass filter possessing an attenuation pole at the high attenuation band (high-zero filter) can be made.

It is preferable that the value of dividing the even mode impedance of the second transmission lines by the even mode impedance of the first transmission lines is set at 0.2 or more and 0.8 or less. It is preferable that the value of dividing the even mode impedance of the second transmission lines by the even mode impedance of the first transmission lines is set at 0.4 or more and 0.6 or less. In the dielectric filter of the invention, by setting the even mode impedance ratio at 0.2 to 0.8, preferably 0.4 to 0.6, both the magnitude of the line width and gap that can be actually manufactured, and the shortening of the resonator length can be achieved at the same time, and manufacturing is made easier.

It is preferable that the TEM mode resonators are capacitively coupled by capacity coupling means provided separately, and coupling of the TEM mode resonators is achieved by a combination of electromagnetic field coupling and capacity coupling. It is preferable that the capacity coupling by the capacity coupling means is achieved in the second transmission lines. It is also preferable that the capacity coupling by the capacity coupling means is achieved at the open end of the TEM mode resonator.

For this specific constitution of the first invention, the following features which are similar to those mentioned above are also provided. It is preferable that the open end of the TEM mode resonator is grounded through the capacity. In addition, it is preferable that the TEM mode resonators and input and output terminals are coupled capacitively. In the dielectric filter of the invention, an attenuation pole can be generated very closely to the passing band of the transmission characteristic, and the resonator line length can be further shortened, so that a dielectric filter of small size having a high selectivity can be realized.

It is preferable that the attenuation pole frequency of the transmission characteristic is adjusted by varying the line distance of the first transmission lines and the line distance of the second transmission lines. In the laminated dielectric filter of the invention, by adjusting the even/odd mode impedance ratio of the transmission line, the degree of coupling can be adjusted by only changing the electrode pattern, and it is easy to realize. Also, the unloaded Q value of the resonator does not deteriorate.

It is preferable that the line length of the first transmission lines and the line length of the second transmission lines are equalized. In the laminated dielectric filter of the invention as set forth in the embodiment, by equalizing the line length of each transmission line of the SIR, not only can the resonator length be set to the shortest possible distance, but also a very complicated design formula can be summed up in a simple form, making it possible to design analytically.

It is preferable that the TEM mode resonator is comprised of an integrated coaxial resonator formed of a penetration hole provided in a dielectric block. It is preferable that the TEM mode resonator is comprised of a strip line resonator formed on a dielectric sheet. In the dielectric filter of the invention, when a block type coaxial resonator is used, it is easy to manufacture by pressing and baking the dielectric ceramic, and materials of high baking temperature and high dielectric constant can be selected, and the filter can be reduced in size, and moreover, since the unloaded Q value is high, the insertion loss can be reduced. On the other hand, when a strip line resonator is used, the thickness can be significantly reduced owing to the flat structure.

It is preferable that the value of dividing the even mode impedance by the odd mode impedance of the first transmission lines is set larger than the value of dividing the even mode impedance by the odd mode impedance of the second transmission lines. It is preferable that the value of dividing the even mode impedance by the odd mode impedance of the first transmission lines is set smaller than the value of dividing the even mode impedance by the odd mode impedance of the second transmission lines. In the dielectric filter of the invention as set forth in those embodiments, by setting the even/odd mode impedance ratio of the first transmission line smaller or larger than the even/odd mode impedance ratio of the second transmission line, a band pass filter of low-zero or of high zero can be freely composed.

It is preferable that the attenuation pole of transmission characteristic is formed in a frequency range of within 15% on both sides of the polarity of the center frequency. In the dielectric filter of the invention as set forth in the embodiment, a filter having a high selectivity can be realized.

It is preferable that the value of dividing the even mode impedance of the second transmission lines by the even mode impedance of the first transmission lines is set at 0.2 or more and 0.8 or less. It is preferable that the value of dividing the even mode impedance of the second transmission lines by the even mode impedance of the first transmission lines is set at 0.4 or more and 0.6 or less. In the dielectric filter of the invention by setting the even mode impedance ratio at 0.2 to 0.8, preferably 0.4 to 0.6, both the magnitude of the line width and gap that can be actually manufactured, and the shortening of the resonator length can be achieved at the same time, and manufacturing is made easier.

A second aspect of the invention provides a laminated dielectric filter comprising a strip line resonator electrode layer forming plural strip line resonators, and a capacity electrode layer, wherein the strip line resonator electrode layer and capacity electrode layer are enclosed by two shield electrode layers, and the two shield electrode layers are filled with a dielectric, and the thickness between the strip line resonator electrode layer and capacity electrode layer is set thinner than the thickness between the strip line resonator electrode layer and shield electrode layer and the thickness between the capacity electrode layer and shield electrode layer. In the laminated dielectric filter of the invention as set forth in this second aspect, by forming a thick dielectric sheet by laminating several thin green sheets, all dielectric sheets can be constituted in the same standardized thickness, and it is easy to manufacture. Moreover, when the dielectric sheet between the shield electrode layer and strip line resonator electrode layer is thick, the unloaded Q value of the resonator is high, and hence a filter of low loss can be realized.

It is preferable that the dielectric between the strip line resonator electrode layer and the shield electrode layer, and the dielectric between the capacity electrode layer and the shield electrode layer are respectively formed by laminating a plurality of thin dielectric sheets. It is preferable that the strip line resonator possesses a front end short-circuit structure, and the short-circuit end is connected and grounded electrically to the grounding terminal formed at the side of the dielectric through a broad common grounding electrode formed on the same electrode layer as the strip line resonator electrode layer. In the laminated dielectric filter of the invention, grounding is effected securely, and fluctuations in the resonance frequency due to cutting errors when cutting the dielectric sheet can be reduced.

It is preferable that the interstage coupling capacity electrode, or input and output coupling capacity electrode, or loading capacity electrode formed on the capacity electrode layer has a dent shape narrowed in the electrode width in the region overlapping the outer edge of the strip line resonator electrode of the strip line resonator electrode layer. In the laminated dielectric filter of the invention, the dent formed in the capacity electrode enables a reduction in the changes of the area of the overlapping region when position deviation occurs between the strip line resonator electrode layer and capacity electrode layer. As a result, in the manufacturing process, fluctuations of filter characteristics due to deviation of position of the strip line resonator electrode layer and the capacity electrode layer can be suppressed effectively.

It is preferable that the laminate dielectric filter possesses an input and output coupling capacity electrode on the capacity electrode layer, and the strip line resonator possesses a front end short-circuit structure, moreover, it is preferable that the input and output coupling capacity electrode and strip line resonator are coupled capacitively at an intermediate position between the open end and short-circuit end of the strip line resonator. It is preferable that the input and output terminals electrically connected to the input and output coupling capacity electrode are formed of side electrodes provided in the lateral direction of the strip line resonator. In the laminated dielectric filter of this embodiment of the invention, by a series resonance circuit comprised of the open end line portion of the strip line resonator and the loading capacitor, an attenuation pole is added to the filter transmission characteristic, and an excellent selection characteristic can be realized. Moreover, the distance between two input and output electrodes can be separated, the spatial coupling between input and output can be reduced, and thus the isolation can be increased.

It is preferable that the multiple factor of shrinkage in baking the dielectric is set smaller than the multiple factor of shrinkage in baking the electrode material for making the strip line resonator electrode layer and capacity electrode layer. In the laminated dielectric filter of the invention, a terminal electrode having the electrode terminal formed on the side in a state projected by several microns to scores of microns can be favorably and securely connected to the end face of the laminate.

It is preferable that the laminated dielectric filter possesses at least two capacity electrode layers which enclose the strip line resonator electrode layer from above and below. Thus a laminated dielectric filter of small size, low loss, and easy to manufacture can be realized.

A third aspect of the invention provides a laminated dielectric filter where a first strip line resonator disposed on a first shield electrode through a first dielectric sheet with thickness $t_1$, disposing second to n-th strip line resonators on the first strip line resonator through second to n-th dielectric sheets thickness $t_2$ to $t_n$ (n being the number of strip line resonators, that is, 2 or more), disposing a second shield electrode on the n-th strip line resonator through the (n+1)-th dielectric sheet with thickness $t_{n+1}$, and setting thicknesses $t_2$ to $t_n$ different from thickness $t_1$ or $t_{n+1}$. In the laminated dielectric filter of the third aspect, a large coupling degree between resonators and a high unloaded Q-value are obtained, thereby realizing a small-sized filter having excellent filter characteristics such as low loss and high selectivity, and not requiring a wide floor area if formed in multiple stages.

It is preferable that the maximum value of thicknesses $t_2$ to $t_n$ is set smaller than thickness $t_1$ or $t_{n+1}$. It is preferable that the maximum value of thicknesses $t_2$ to $t_n$ is set smaller than the maximum value of thicknesses $t_1$ and $t_{n+1}$. It is also preferable that the maximum value of thicknesses $t_2$ to $t_n$ is set smaller than either thickness $t_1$ or $t_{n+1}$. Additionally, it is preferable that the number n of strip line resonators is 3 or more (it is well-known to the skilled person that the number n can be 3 or more), and the thickness is equal in all from $t_2$ to $t_n$. In the laminated dielectric filter of this, a large coupling degree between resonators and a high unloaded Q-value are obtained, thereby realizing a small-sized filter having excellent filter characteristics such as low loss and high selectivity, and not requiring a wide floor area if formed in multiple stages.

It is preferable that the first shield electrode and second shield electrode are formed of inner layer electrodes enclosed by dielectric sheets. The shield electrode can be formed at the same process step as the strip line resonator electrode and capacity electrode, and hence manufacturing is easier.

It is preferable that the first dielectric sheet and the (n+1)th dielectric sheet are formed by laminating a plurality of thin dielectric sheets. By forming the thick dielectric sheet with thin dielectric sheets of standardized thickness, the manufacturing cost can be further reduced.

It is preferable that the input and output coupling capacity electrode is each formed respectively in one of the thin dielectric sheets for composing the first dielectric sheet, and in one of the thin dielectric sheets for composing the (n+1)-th dielectric sheet. The filter can be smaller in size than in the magnetic field coupling system, by coupling the strip line resonator and input and output terminal by capacitive coupling. The calculation of the coupling amount is easy, and the input and output coupling amount can be adjusted by only varying the area of the electrode pattern, so that it is easy to design.

It is preferable that the position of the center line of the first to n-th strip line resonators is shifted parallel in the lateral direction in every one of the first to n-th dielectric sheets. In the laminated dielectric filter of this embodiment, the coupling amount between the strip line resonators can be adjusted very easily.

Furthermore, it is preferable that the first to n-th strip line resonators are used as front end short-circuit strip line resonators, and are laminated by aligning the direction of the short-circuit ends. Thus, the laminated dielectric filter is easy to design, and a small-sized filter can be attained.

In addition, it is preferable that the broad grounding electrodes are formed at the short-circuit end side of the first to n-th strip line resonators, grounding side shield electrodes are formed of outer electrodes on the side of the short-circuit end side of the strip line resonator of the dielectric composed of the first to (n+1)-th dielectric sheets, and the short-circuit end of the strip line resonator is connected and grounded to the grounding side shield electrode through the grounding electrode. In the laminated dielectric filter of the invention as set forth in this embodiment, a change in length of the broad grounding electrodes has a smaller effect on the resonance frequency than a change in length of the strip line resonator electrode, thereby suppressing the fluctuations of the resonance frequency due to variations from cutting the dielectric sheet. In addition, since the side is shielded by the side electrode of the grounding end grounding terminal, the field characteristic is hardly effected by external effects.

It is preferable that the input and output coupling capacity electrode is each formed respectively in one of the thin dielectric sheets of the first dielectric sheet, and in one of the thin dielectric sheets of the (n+1)-th dielectric sheet, the take-out direction of the input and output coupling capacity electrode is the right side direction of the strip line resonator in one, and the left side direction of the strip line resonator in the other, and they are connected as input and output terminals to the side input and output electrodes formed of outer electrodes, provided at the right and left sides of the laminate composed of the first to (n+1)-th dielectric sheets. The take-out direction of the input and output terminal is set in the right side direction and left side direction of the strip line, and the input and output terminals can be isolated.

Furthermore, it is preferable that the side shield electrodes are formed of outer electrodes at the sides of the laminate composed of the first to (n+1)-th dielectric sheets. It is preferable that the open side shield electrode is formed of outer electrode at the side of the open end side of the strip line resonator of the laminate composed of the first to (n+1)-th dielectric sheets. In the laminated dielectric filter of this embodiment, a change in filter characteristic by external effects can be prevented by the shield effect, and moreover the resonance of the shield electrode is suppressed to prevent deterioration of the filter characteristic.

It is preferable that the line width at the short-circuit end side of the first to n-th strip line resonators is narrower than the line width of the open end side. In the laminated dielectric filter of the invention, the strip line has a wide part and a narrow part to compose the SIR structure, and therefore the length of the resonator is shorter than ¼ wavelength, so that the filter can be reduced in size.

It is also preferable that the line distance of the short-circuit end side narrow parts of the first to n-th strip line resonators is different from the line distance of the open end side broad parts. It is preferable that the positions of the line center lines of the open end side broad parts of the first to n-th strip line resonators are aligned vertically, and the positions of the line center lines of the short-circuit end side narrow parts are shifted parallelly in the lateral direction in every one of the first to n-th dielectric sheets. In the laminated dielectric filter of this invention, the electromagnetic coupling amount of wide parts and the electromagnetic coupling amount of narrow parts of the strip line can be independently set, and hence it is possible to design the attenuation pole at a desired frequency. By arranging up and down the positions of the line center lines of the wide parts of the strip line, the maximum coupling amount can be realized in the wide parts. Furthermore, the lateral width of the filter can be set at the smallest distance.

It is preferable that the line width of the short-circuit end side of the first to n-th strip line resonators is set broader than the line width of the open end side. It is preferable that the line distance of the short-circuit end side broad parts of the first to n-th strip line resonators is different from the line distance of the open end side narrow parts. It is also preferable that the positions of the line center lines of the short-circuit end side broad parts of the first to n-th strip line resonators are aligned vertically, and the positions of the line center lines of the open end side narrow parts are shifted parallelly in the lateral direction in every one of the first to n-th dielectric sheets. In the laminated dielectric filter of the invention as set forth in this embodiment, the resistance loss of the high frequency current can be decreased by widening the grounding end side of the strip line resonator, so that the unloaded Q value can be improved. Furthermore, by arranging up and down the positions of the line center lines of the wide parts of the strip line, the maximum coupling amount can be realized in the wide parts. In addition, the lateral width of the filter can be set at the smallest distance.

A fourth aspect of this invention provides a laminated dielectric filter by forming front end short-circuit strip line resonators on a plurality of first dielectric sheets, forming coupling shield electrodes possessing electric coupling windows or magnetic coupling windows on a different plurality of fifth dielectric sheets, laminating the first dielectric sheets and fifth dielectric sheets alternately by aligning the direction of short-circuit ends of the strip line resonators, grounding the coupling shield electrodes, and disposing shield electrodes through second dielectric sheets laminated above and beneath. In the laminated dielectric filter of the fourth embodiment, it is easy to control from a large coupling degree to a small coupling degree, the size, shape and position of the coupling window, so that a filter characteristic in a wide range from wide band to narrow band can be attained easily.

A fifth aspect of this invention provides a laminated dielectric antenna duplexer by providing a laminate by laminating and baking integrally a plurality of dielectric sheets, at least three layers or more of shield electrode layers, and at least two layers or more of strip line resonator electrode layers, dividing the laminate into upper and lower laminate parts by at least one layer of shield electrode layer, providing a reception filter in one part of the laminate by at least one layer of strip line resonator electrode layer, providing a transmission filter in another part of the laminate by at least one layer of the strip line resonator electrode layer, and shielding the upper and lower parts of the laminate by using the shield electrode layers, thereby laminating the reception filter and transmission filter in upper and lower layers. In the laminated dielectric filter antenna duplexer of the fifth embodiment, by forming the reception filter and transmission filter into one body in a vertical laminate structure, an antenna duplexer of small size, thin type, and low cost can be attained. By being shielded entirely, moreover, this can be formed as surface mounting device (SMD), and coupling elements of input and output are all formed in the inner layer electrode patterns, so that external parts are not necessary.

It is preferable that the transmission terminal and reception terminal are comprised of side electrodes of different sides. In the laminated dielectric filter antenna duplexer of the invention as set forth in this embodiment, by forming the transmission terminal and reception terminal by side electrodes of different sides, sufficient isolation is established between the transmission terminal and reception terminal.

It is preferable that the strip line resonator electrode layers are comprised of plural front end short-circuit strip line resonators, respectively, and the short-circuit end directions of the strip line resonator to be coupled directly with the transmission terminal and the strip line resonator to be coupled directly with the reception terminal are set in mutually different side directions. The capacitive coupling system can be formed through coupling capacitors, and hence the magnetic coupling line that is required in the comb-line filter is not necessary, and both transmission filter and reception filter can be reduced in size.

It is preferable that the laminate is divided into two upper and lower laminate parts by a separation layer comprised by a plurality of dielectric sheets enclosed in at least two layers of shield electrode layers, and an impedance matching element formed by an electrode pattern on the dielectric sheet of the separation layer. In the laminated dielectric filter antenna duplexer of this embodiment, by forming an inductor or capacitor as an impedance matching element on the dielectric sheet between separation layers, a favorable matching characteristic between the antenna terminals between the transmission filter and reception filter can be realized.

DETAILED DESCRIPTION OF THE INVENTION

An antenna duplexer is comprises a combination of a transmission filter and a reception filter. In the following illustrative examples, first, the individual filters which are used in the antenna duplexer, particularly the laminated and block dielectric filters are described, and then the laminated antenna duplexers using such filters are described.

EXAMPLE 1

Figure 1:
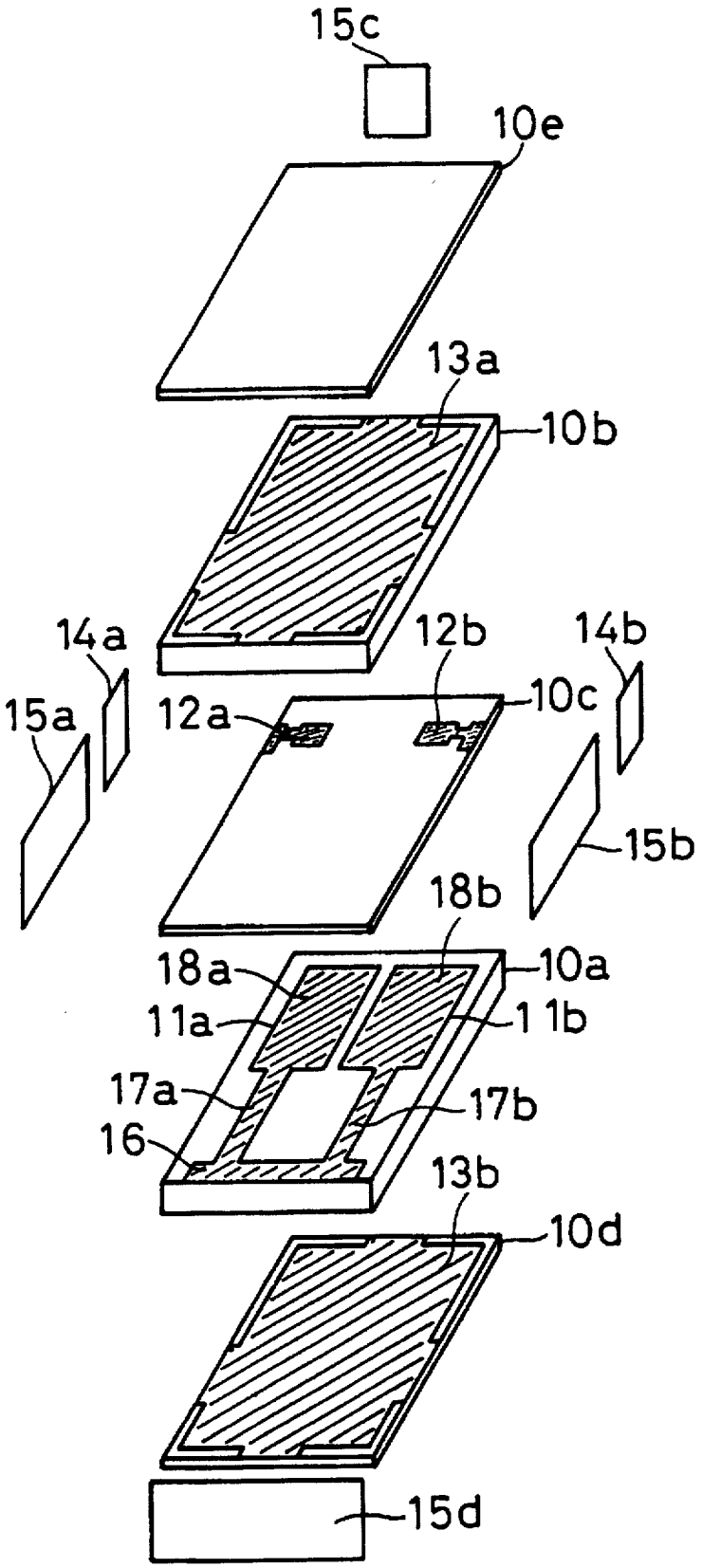
FIG. 1 is a perspective exploded view of a laminated dielectric filter in a first embodiment of the invention.

A laminated dielectric filter in a first embodiment of the invention is described below with reference to the drawings. FIG. 1 is a perspective view of a dielectric filter in the first embodiment of the invention. In FIG. 1, reference numerals 10*a*, 10*b* are thick dielectric sheets. Strip line resonator electrodes 11*a*, 11*b* are formed on the dielectric sheet 10*a*, and capacity electrodes 12*a*, 12*b* are formed on the dielectric sheet 10*c*.

The strip line resonator electrodes 11*a*, 11*b* have a SIR (stepped impedance resonator) structure in which the overall line length is shorter than a quarter wavelength composed by the cascade connection of the other ends of first transmission lines 17*a*, 17*b* with high characteristic impedance grounded at one end, and second transmission lines 18*a*, 18*b* with low characteristic impedance opened at one end. The SIR structure is described in M. Makimoto et al., "Compact Bandpass Filters Using Stepped Impedance Resonators," Proceedings of the IEEE, Vol. 67, No. 1, pp. 16–19, January 1979 and is disclosed in U.S. Pat. No. 4,506,241 which are incorporated by reference. It is known in the art that the line length of the resonator can be cut shorter than a quarter wavelength.

By contrast, the structure of the invention differs greatly from the prior art in that each resonator has the SIR structure, and the first transmission-lines are mutually coupled electromagnetically, and the second transmission lines are mutually coupled electromagnetically, with each electromagnetic field coupling amount set independently by varying the line distance of the transmission lines.

The short-circuit end side of the first transmission line is grounded through a common grounding electrode 16. By grounding through the common grounding electrode 16, grounding is done securely, and fluctuations in the resonance frequency due to cutting errors when cutting off the dielectric sheet can be decreased.

The strip line resonator electrodes 11*a*, 11*b* and input and output terminals 14*a*, 14*b* are coupled capacitively through the capacity electrodes 12*a*, 12*b* at the open ends of the strip line resonator electrodes. In the capacitive coupling method, as compared with the magnetic field coupling method generally employed in comb-line filters, since the coupling line is not necessary, the filter can be reduced in size. Application of the capacitive coupling method in this filter structure is accomplished for the first time by the establishment of the design method mentioned below. Another feature is that only a small capacity is enough for the coupling capacity because of coupling at open ends.

A shield electrode 13*a* is formed on the dielectric sheet 10*b*, and a shield electrode 13*b* is formed on the dielectric sheet 10*d*. Each shield electrode is grounded by the grounding terminals 15*a*, 15*b*, 15*c*, 15*d* formed on the side electrodes. In the structure of the invention, the entire filter is covered with the shield electrodes, and hence the filter characteristic is hardly affected by external effects.

By laminating the dielectric sheet 10*e* for electrode protection and laminating all other dielectric sheets, an entirely laminated structure is formed. Using a dielectric material of, for example, Bi—Ca—Nb—O ceramics with dielectric constant of 58 disclosed in H. Kagata et al.: "Low-fire Microwave Dielectric Ceramics and Multilayer Devices with Silver Internal Electrode," Ceramic Transactions, Vol. 32, The American Ceramic Society Inc., pp. 81–90, or other ceramic materials that can be baked at 950 degrees C or less, a green sheet is formed, and an electrode pattern is printed with metal paste of high electric conductivity such as silver, copper and gold, thereby laminating and baking integrally. In this way, when the laminate structure is formed by using the strip line resonators, the thickness can be reduced significantly.

Operation of the thus constituted dielectric filter is described by reference to FIG. 1 and FIG. 2.

Figure 2:
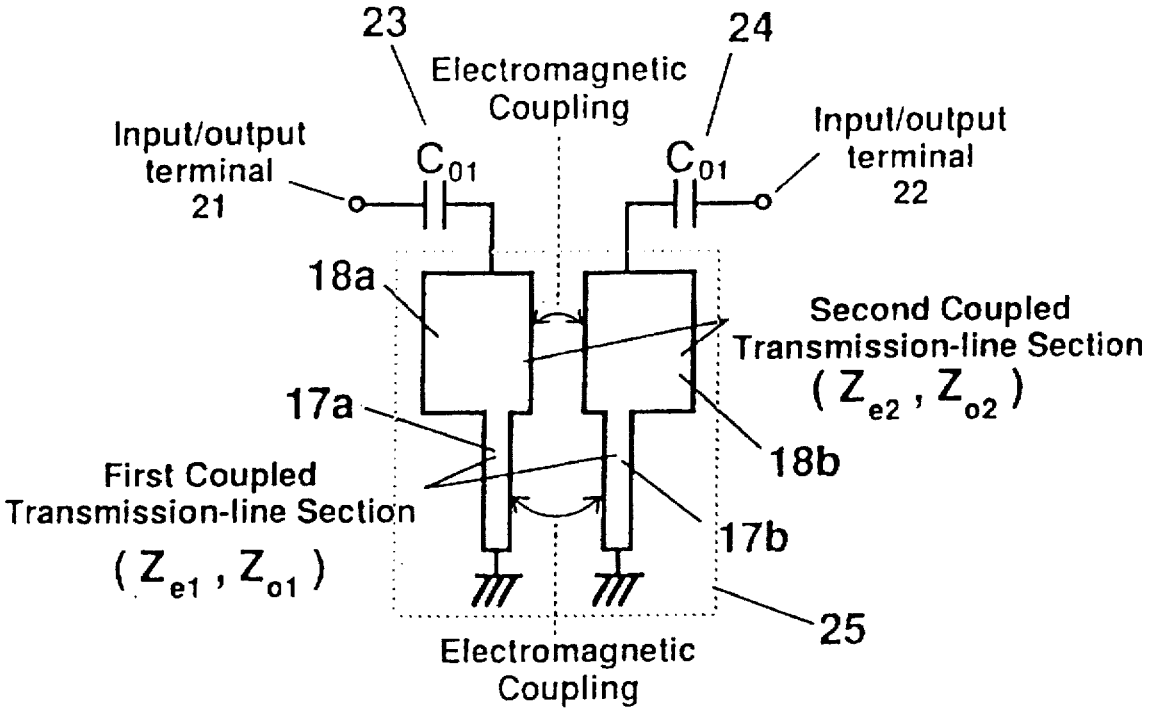
FIG. 2 is an equivalent circuit diagram of the laminated dielectric filter in the first embodiment of the invention.

FIG. 2 shows an equivalent circuit diagram of the dielectric filter in the first embodiment. The filter transmission characteristic in FIG. 2 can be calculated by using the even/odd mode impedance of the parallel coupling transmission line. In FIG. 2, reference numerals 21, 22 are input and output terminals, 17*a*, 17*b* are first transmission lines of the strip line resonator, 18*a*, 18*b* are second transmission lines of the strip line resonator, and capacitors 23, 24 are input and output coupling capacitors located between the strip line resonator electrodes 11*a*, 11*b*, and capacity electrodes 12*a*, 12*b*.

In the case of a two-stage filter or a two-pole filter, the filter designing method in the first embodiment of the invention is described below.

The even/odd mode impedances of the first transmission lines are supposed to be $Z_{e1}$, $Z_{o1}$, and the even/mode impedances of the second transmission lines to be $Z_{e2}$, $Z_{o2}$. The four-port impedance matrix of each transmission line is given in formula (1) by referring to, for example, the literature (T. Ishizaki et al., "A Very Small Dielectric Planar Filter for Portable Telephones": 1993 IEER MTT-S, Digest H-1).

$$Z=\begin{bmatrix} j\frac{(t-1/t)\cdot(Z_e+Z_o)}{4} & j\frac{(t-1/t)\cdot(Z_e-Z_o)}{4} & -j\frac{(t+1/t)\cdot(Z_e+Z_o)}{4} & j\frac{(t+1/t)\cdot(-Z_e+Z_o)}{4} \\ j\frac{(t-1/t)\cdot(Z_e-Z_o)}{4} & j\frac{(t-1/t)\cdot(Z_e+Z_o)}{4} & j\frac{(t+1/t)\cdot(-Z_e+Z_o)}{4} & -j\frac{(t+1/t)\cdot(-Z_e+Z_o)}{4} \\ -j\frac{(t+1/t)\cdot(Z_e+Z_o)}{4} & j\frac{(t+1/t)\cdot(-Z_e+Z_o)}{4} & j\frac{(t-1/t)\cdot(Z_e+Z_o)}{4} & j\frac{(t-1/t)\cdot(Z_e-Z_o)}{4} \\ j\frac{(t+1/t)\cdot(-Z_e+Z_o)}{4} & -j\frac{(t+1/t)\cdot(Z_e+Z_o)}{4} & j\frac{(t-1/t)\cdot(Z_e-Z_o)}{4} & j\frac{(t-1/t)\cdot(Z_e+Z_o)}{4} \end{bmatrix}$$

$$t=\tan\left(\frac{\pi fL}{ck}\right)$$

Formula (1)

Therefore, the two-port admittance matrix of two-terminal pair circuit 25 is newly calculated as in formula (2) for the structure of the invention, by connecting them in cascade, grounding one end, and using the other end as an input and output terminal.

Formula (2)

$$Y=\begin{bmatrix} j\frac{-K_o\alpha-K_e\beta+(\alpha+\beta)t'^2}{2\alpha\beta t'} & j\frac{K_o\alpha-K_e\beta-(\alpha-\beta)t'^2}{2\alpha\beta t'} \\ j\frac{K_o\alpha-K_e\beta-(\alpha-\beta)t'^2}{2\alpha\beta t'} & j\frac{-K_o\alpha-K_e\beta+(\alpha+\beta)t'^2}{2\alpha\beta t'} \end{bmatrix}$$

However, the line length of the first transmission lines and second transmission lines is set at the same line length L. By equalizing the line length, not only can the resonator length be set to the shortest, but also a very complicated calculation formula can be summarized into a simple form, thereby making it possible to design analytically. $K_e$, $K_o$, $\alpha$, $\beta$, and $t'$ are defined in Formula (3).

Formula (3)

$$\left.\begin{aligned} K_e &= \frac{Z_{e2}}{Z_{e1}} \\ K_o &= \frac{Z_{o2}}{Z_{o1}} \\ \alpha &= K_e(1+K_e)Z_{e1} \\ \beta &= K_o(1+K_o)Z_{o1} \\ t' &= \tan\left(\frac{2\pi fL}{ck}\right) \end{aligned}\right\}$$

Where L is the line length of first transmission line or second transmission line, c is the velocity of light, and k is the propagation velocity ratio.

To design a filter, first, from the design specification, the center frequency $f_o$, attenuation pole frequency $f_p$, bandwidth bw, and in-band ripple $L_r$ are determined. From these values, the value of g necessary for filter design is determined, and therefore the interstage admittance $Y_3$ and the shunt admittance of the modified admittance inverter $Y_{01}^e$, and input and output coupling capacities ($C_{01}$) 23, 24 are determined. Calculation of g, $Y_3$, $Y_{01}^e$, $C_{01}$ is, shown in the literature (G. L. Matthaei et al., "Microwave Filters, Impedance-Matching Networks, and Coupling Structures": McGraw-Hill, 1964).

Herein, t' in formula (3), replacing f with $f_o$ or $f_p$, is defined as $t'_o$, $t'_p$. Therefore, the formulas necessary for realizing the filter characteristic to be designed are formula (4) for giving the attenuation pole frequency $f_p$, $$t'^2_p=\frac{K_o\alpha-K_e\beta}{\alpha-\beta}$$

Formula (4)

formula (5) for giving the filter center frequency $f_o$, $$Y^e_{01}=j\frac{K_o\alpha+K_e\beta-(\alpha+\beta)t'^2_o}{2\alpha\beta t'_o}$$

Formula (5)

and formula (6) for giving the interstage admittance $Y_3$.

$$Y_3=-j\frac{K_o\alpha-K_e\beta-(\alpha-\beta)t'^2_o}{2\alpha\beta t'_o}$$

Formula (6)

The solution that satisfies these three formulas simultaneously is the design value of the dielectric filter in Example 1 of the invention.

Next, considering the structural parameters of the strip line, $Z_{e1}$ and $Z_{e2}$, that is, $Z_{e1}$ and $K_e$ ($=Z_{e2}/Z_{e1}$) are properly determined. From formula (2) and formula (3), $\beta$ can be eliminated, and $t'_o$ and $t'_p$ are determined. Hence, the line length L of each transmission line is determined.

If the loading capacity is present at the open end of the strip line, formula (5) can be changed to formula (7) in the filter design formula.

$$Y_{01}^{*} + Y_L = j\frac{K_e\alpha + K_e\beta - (\alpha+\beta)\,\ell_o^2}{2\alpha\beta\ell_o} \qquad \text{Formula (7)}$$

where $Y_L$ is the admittance due to loading capacity.

A design example of the filter of the embodiment is shown. Table 1 shows circuit parameter design values, with the center frequency $f_o$ of 1000 MHz, bandwidth bw of 50 MHz, in-band ripple $L_r$ of 0.2 dB, and attenuation pole frequency $f_p$ of 800 MHz in a first trial filter, and 1200 MHz in a second trial filter.

TABLE 1

Circuit parameter design values

| | First filter | Second filter |
|---|---|---|
| $Z_{e1}$ | 20Ω | 20Ω |
| $Z_{o1}$ | 18.46Ω | 14.88Ω |
| $Z_{e2}$ | 10Ω | 10Ω |
| $Z_{o2}$ | 7.02Ω | 7.41Ω |
| L | 3.00 mm | 3.20 mm |
| $C_{01}$ | 1.34 pF | 1.34 pF |

Herein, the dielectric constant of the dielectric sheet is 58, and hence k is 0.131, $Z_{e1}$ is 20Ω, and $K_e$ is 0.5. The loading capacity due to the discontinuous part at the open end is estimated at 3 pF.

Figure 3:
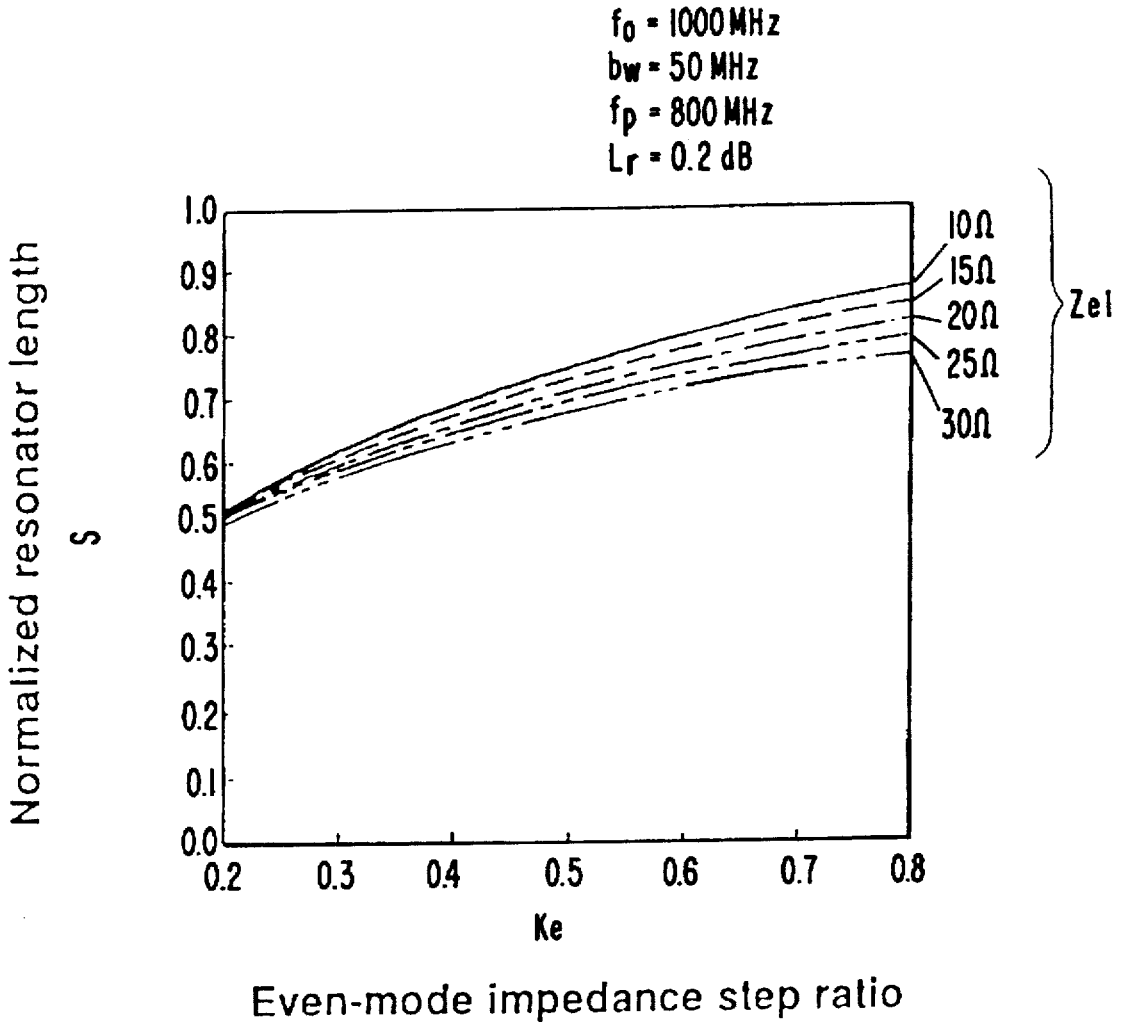
FIG. 3 is a graph showing the relationship between the even mode impedance step ratio and normalized resonator line length in the laminated dielectric filter in the first embodiment of the invention.

For an arbitrary value of the even mode impedance step ratio $K_e$, the relation between $K_e$ and normalized resonator line length S is as shown in FIG. 3. The normalized resonator line length S is the value of the resonator line length of the filter divided by a quarter wavelength of the propagation wavelength. In the filter of the embodiment, in this way, by designing the resonator in the SIR structure, the line length can be set shorter than the quarter wavelength if loading capacity is not available, so that the filter can be reduced in size. That is, the resonator line length is shorter when the even mode impedance step ratio $K_e$ is smaller.

Figure 4:
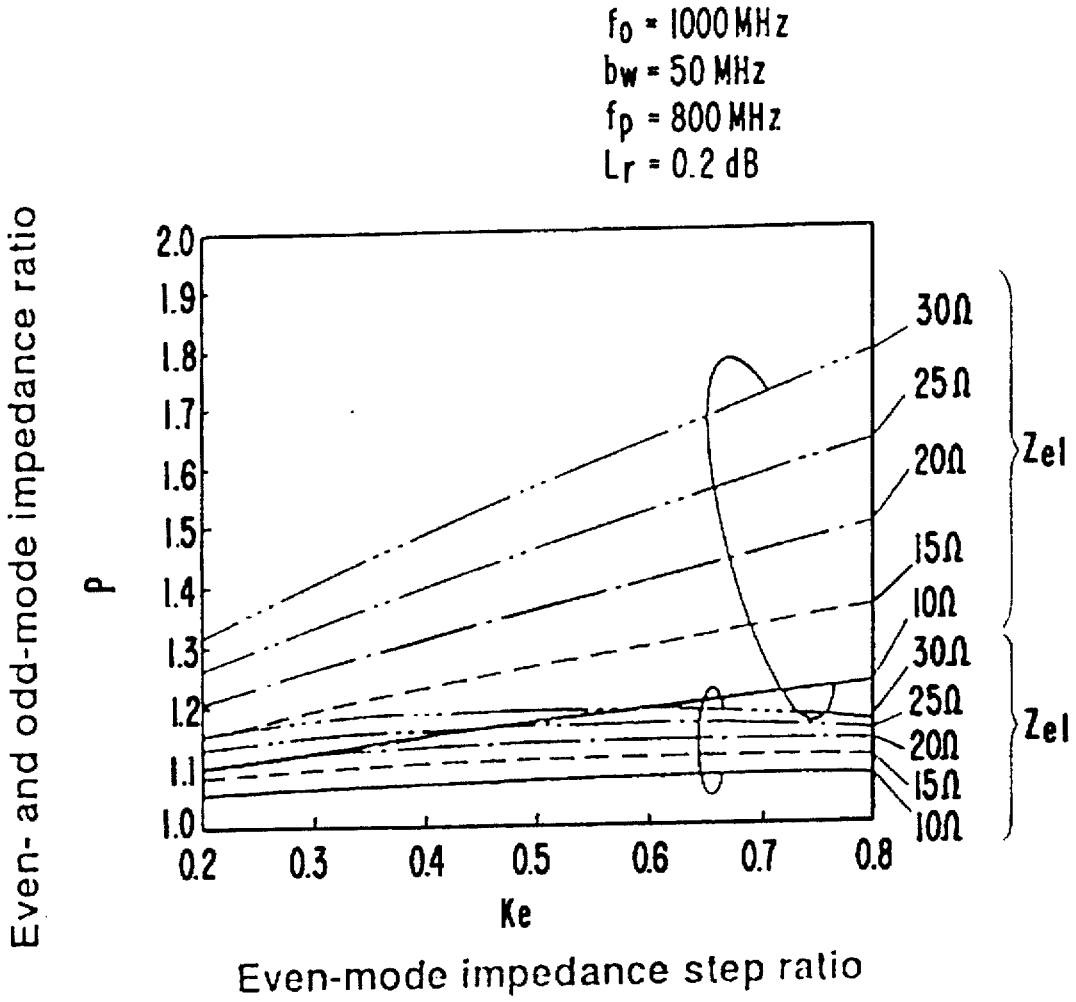
FIG. 4 is a graph showing the relationship between the even mode impedance step ratio and even/odd mode impedance ratio in the laminated dielectric filter in the first embodiment of the invention.

Moreover, the relation of $K_e$ with the even/odd mode impedance ratio $P_1$ ($=Z_{e1}/Z_{o1}$) of the first transmission line and the even/odd mode impedance ratio $P_2$ ($=Z_{e2}/Z_{o2}$) of the second transmission line is shown in FIG. 4. The larger the value of $K_e$, the larger the even/odd mode impedance ratio $P_2$ of the second transmission line, and hence the gap between the strip line resonators must be decreased, which is more difficult. On the other hand, if $K_e$ is small, the even mode impedance $Z_{e1}$ of the first transmission line is considerably high, and the line width of the strip line may be narrower, which is also difficult to accomplish. To realize a favorable filter characteristic in the constitution of the embodiment, as determined from FIG. 4, the even/odd mode impedance ratio $P_1$ of the first transmission line and the even/odd mode impedance ratio $P_2$ of the second transmission line must be 1.05 or more and 1.1 or more respectively.

Figure 5:
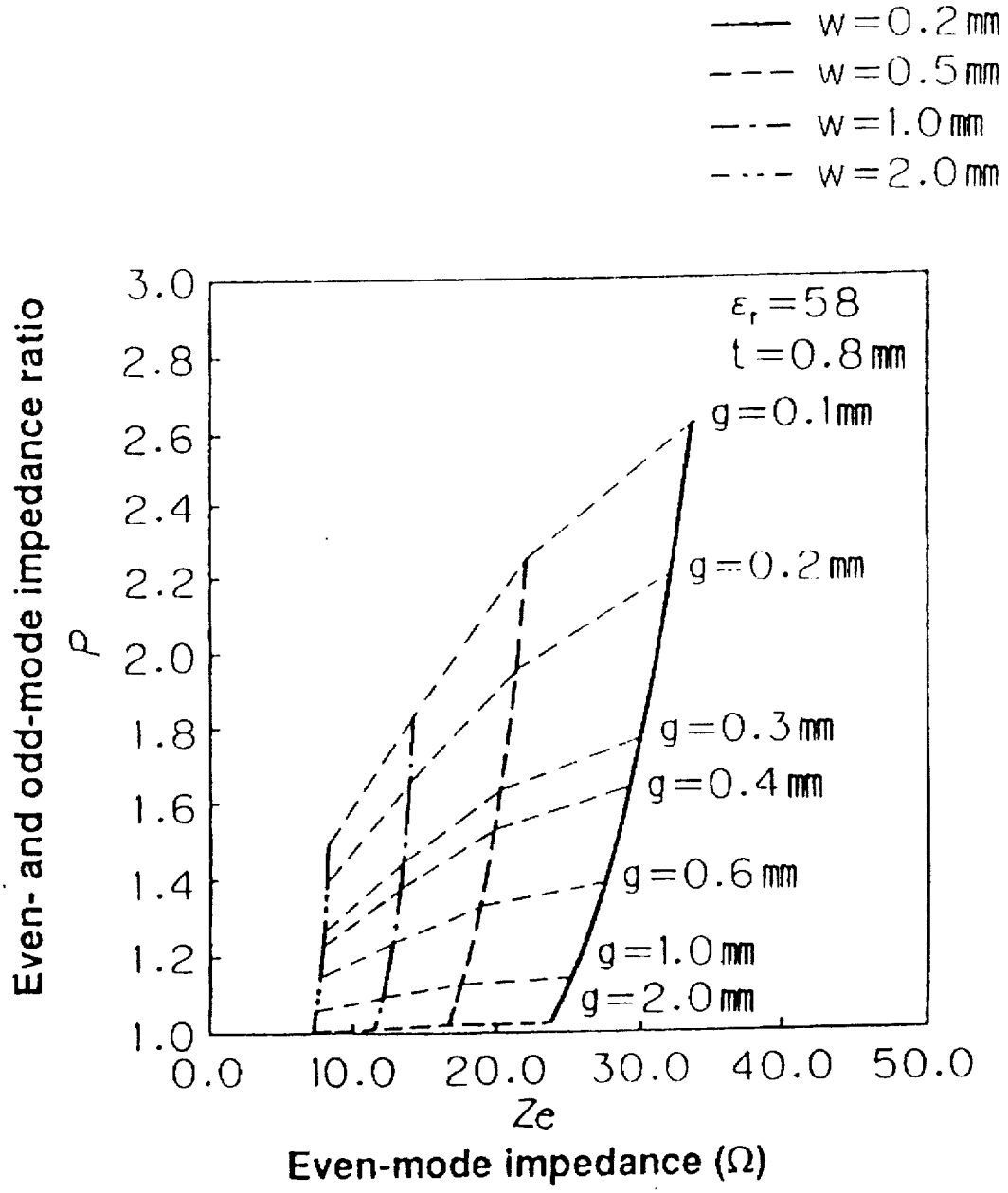
FIG. 5 is a graph showing the relationship between the even mode impedance and even/odd mode impedance ratio to the structural parameters of a parallel coupling strip line of the invention.

FIG. 5 is a design chart for explaining the relation between the even mode impedance $Z_e$ and even/odd mode impedance ratio P as the parameter of strip line structure. In FIG. 5, at the dielectric constant of 58, the thickness of the dielectric sheet between strip line and upper and lower shield electrodes of 0.8 mm respectively, is calculated by varying the line width w of the strip line from 0.2 mm to 2.0 mm, and the gap between parallel strip lines from 0.1 mm to 2.0 mm.

FIG. 5 enables checking whether the even/odd mode impedance ratio P of the transmission lines in FIG. 4 can be obtained. As a result, the value of the structural parameter for realizing the circuit parameter in Table 1 is determined as shown in Table 2 by referring to FIG. 5.

TABLE 2

Structural parameter design values

| | First filter | Second filter |
|---|---|---|
| $W_1$ | 0.35 mm | 0.44 mm |
| $g_1$ | 1.22 mm | 0.54 mm |
| $W_2$ | 1.55 mm | 1.51 mm |
| $g_2$ | 0.20 mm | 0.27 mm |

In the design in Table 2, the even/odd mode impedance ratio P of the transmission line is adjusted by varying the line distance, that is, the gap g. The coupling degree adjustment by the line distance is possible only by varying the electrode pattern, and it is easier to realize by far as compared with the method of, for example, varying the thickness of the dielectric sheet, and it is advantageous that the unloaded Q value of the resonator does not deteriorate.

Figure 6:
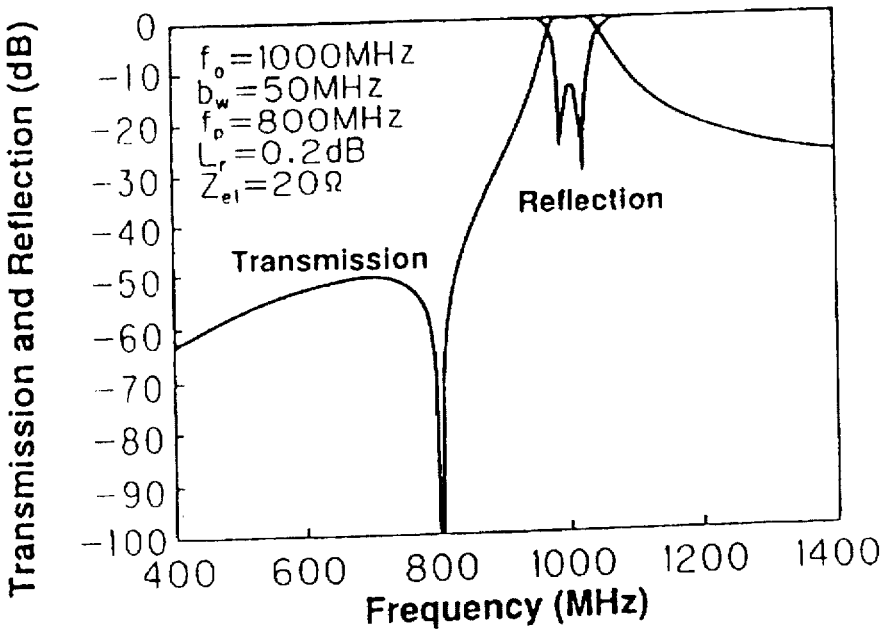
FIG. 6(*a*) and (*b*) are graphs showing simulation results of design value of transmission characteristic of the laminated dielectric filter in the first embodiment of the invention, FIG. 6(*a*) showing the characteristic of a first trial filter with a low-zero, and FIG. 6(*b*) showing the characteristic of a second trial filter with a high-zero.
Figure 6:
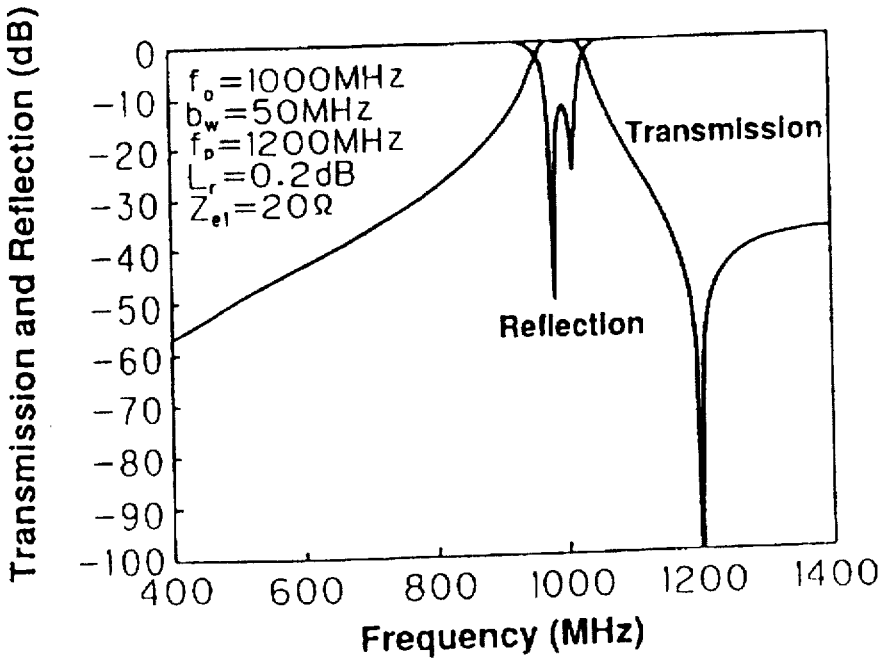
Figure 7:
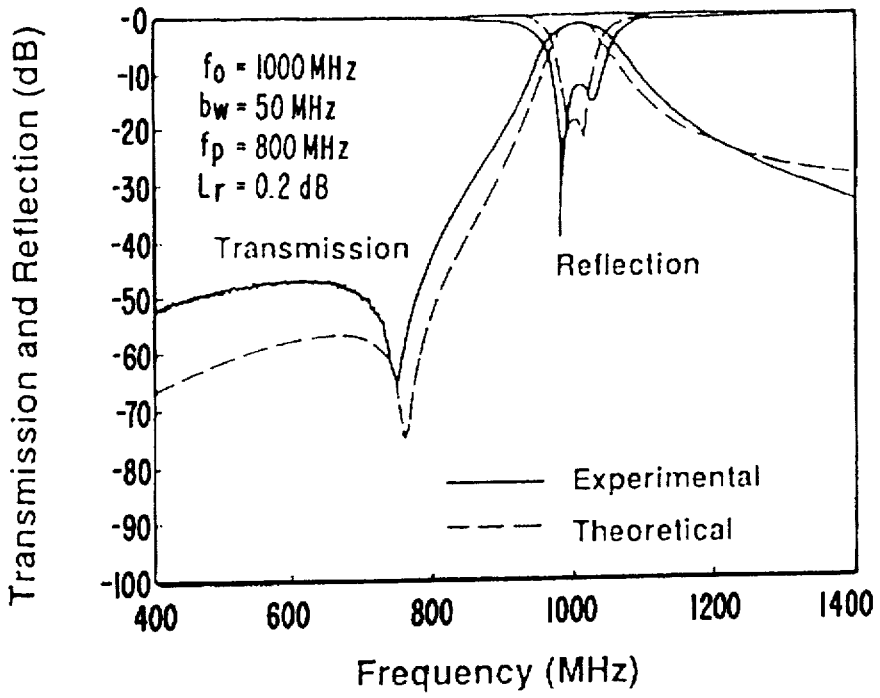
FIG. 7(*a*) and (*b*) are graphs showing the measured value and calculated value of transmission characteristic of the laminated dielectric filter in the first embodiment of the invention, FIG. 6(*a*) showing the characteristic of a first trial filter with a low-zero, and FIG. 6(*b*) showing the characteristic of a second trial filter with a high-zero.
Figure 7:
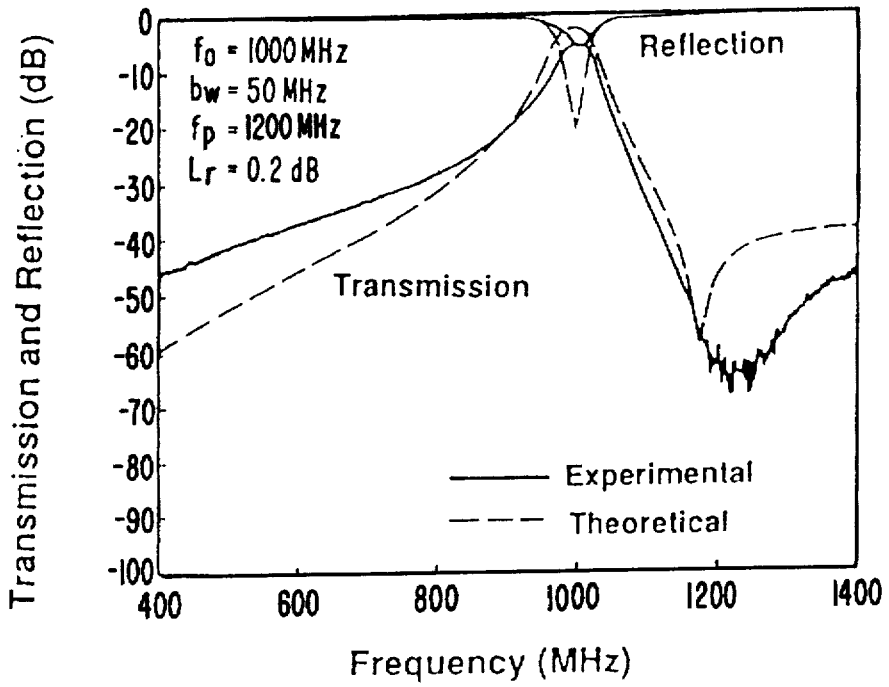

FIG. 6 is a graph showing the simulation results of the design value of transmission characteristic of the dielectric filter in the first embodiment. FIG. 7 shows the characteristic of the trial production of the filter of the embodiment, in which the solid line shows the measured value, and the broken line shows the calculated value about the actual dimensions of the trial product. In both diagrams, (a) shows the characteristic of the first trial filter with a low-zero, and (b) shows the characteristic of the second trial filter with a high-zero. These diagrams indicate that an attenuation pole is generated at the design frequency.

The invention attains a novel effect of realizing superior selectivity by mutual electromagnetic coupling of the first transmission lines and second transmission lines of the resonator of the SIR structure, thereby not only shortening the resonator length, but also forming an attenuation pole at the design frequency.

Thus, according to the embodiment, at least two or more TEM mode resonators are comprised in the SIR (stepped impedance resonator) structure with the overall line length shorter than a quarter wavelength constituted by cascade connection of other ends of the first transmission lines having one end grounded and the second transmission lines having one end open with the characteristic impedance lower than that of the first transmission lines. The first transmission lines are coupled electromagnetically, and the second transmission lines are coupled electromagnetically, and both electromagnetic field coupling amounts are set independently, and therefore a passing band and an attenuation pole are generated in the transmission characteristic, thereby realizing a small dielectric filter having a high selectivity.

In this embodiment, a strip line resonator is shown, but a resonator of any structure may be used as far as it is a TEM mode resonator, and it is the same in the following examples.

Figure 8:
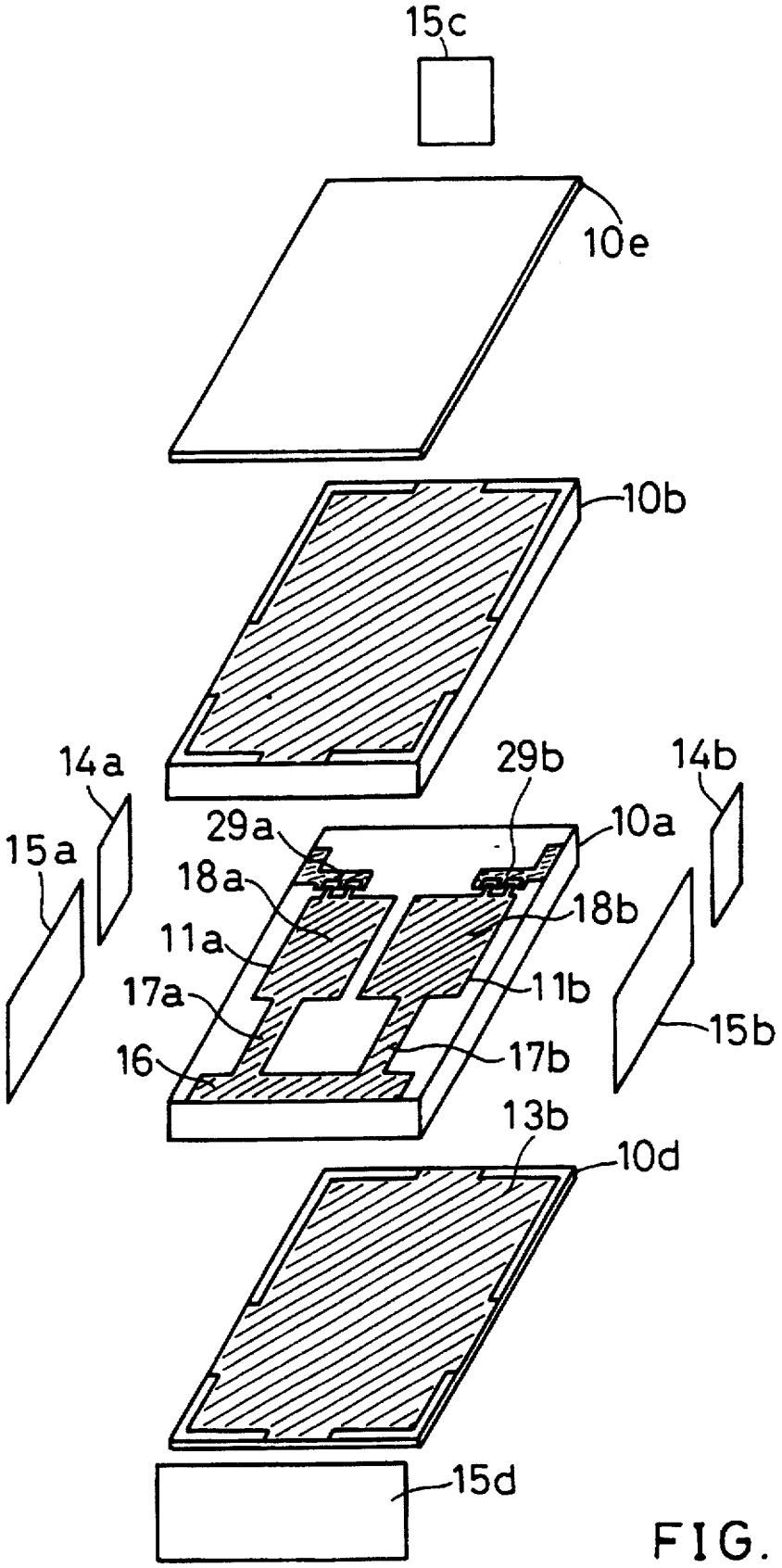
FIG. 8 is a perspective view of a modified form of laminated dielectric filter in the first embodiment of the invention.

A laminated dielectric filter in a modified Example 1 of the invention is described below with reference to a drawing. FIG. 8 is a perspective exploded view of the laminated dielectric filter showing a modified first example of the invention. In FIG. 8, those same as the constitution in FIG. 1 are identified with the same reference numerals.

The operating principle of this embodiment is the same as in the first embodiment. This embodiment differs from the first embodiment shown in FIG. 1 in that capacity electrodes 29a, 29b are formed on the dielectric sheet 10a, the same as the strip line resonator electrode layer. Accordingly, the dielectric sheet 10c in the first embodiment is not necessary, and the number of times of printing of the electrodes can be reduced by one, and it is free from the control of the thickness of the dielectric sheet 10c which is a cause of fluctuation in filter characteristic.

Moreover, by forming a capacitor comprised of a capacity electrode as an interdigital type capacitor, a large capacity can be obtained easily, so that a wide range characteristic can be also realized.

EXAMPLE 2

Figure 9:
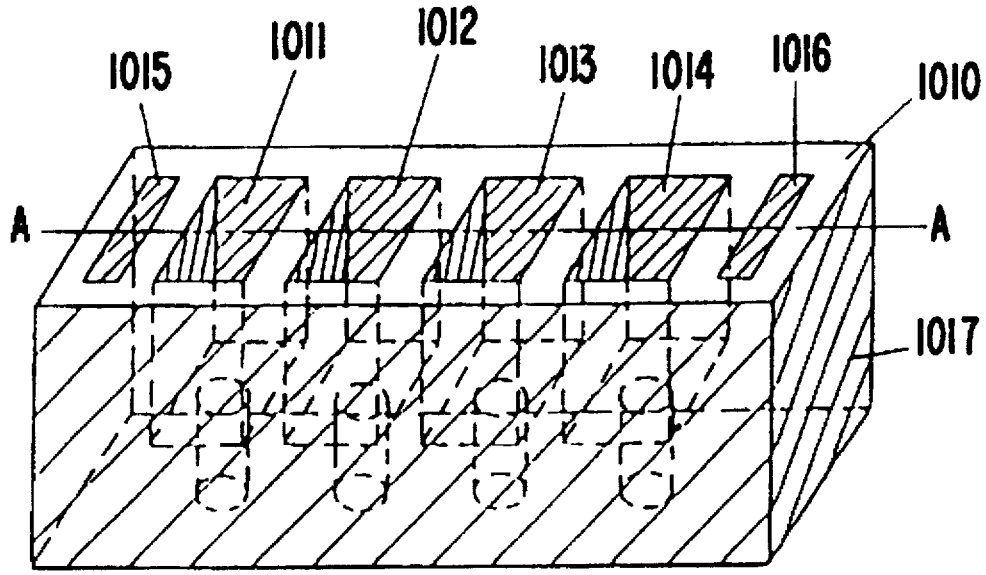
FIG. 9(*a*) is a perspective oblique view of a block type dielectric filter in a second embodiment of the invention, and FIG. 9(*b*) is a sectional view on plane A–A' of the invention.
Figure 9:
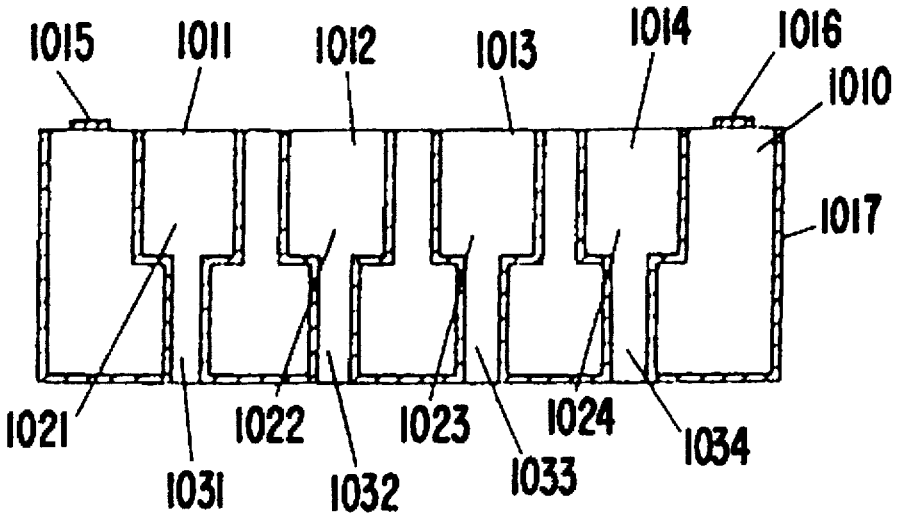

A block type dielectric filter in an embodiment of the invention is described below with reference to the drawings. FIG. 9(*a*) is a perspective oblique view of the block type dielectric filter showing the second embodiment of the invention, and FIG. 9(*b*) is a sectional view of section A–A' of the block type dielectric filter showing the second embodiment of the invention. The example differs from Example 1 in that the block coaxial resonator formed in the penetration hole of the dielectric block is used instead of the strip line resonator as the TEM mode resonator.

In FIG. 9(*a*) and (*b*), reference numeral 1010 denotes a dielectric block, 1011, 1012, 1013, 1014 are resonator electrodes, 1015, 1016 are input and output coupling capacity electrodes, and 1017 is a shield electrode. The resonator electrodes are individually composed of first transmission lines 1031, 1032, 1033, 1034 of high characteristic impedance, and second transmission lines 1021, 1022, 1023, 1024 of low characteristic impedance, and they are mutually coupled in an electromagnetic field.

The magnitude of the electromagnetic field coupling can be adjusted by varying the distance between the transmission lines, or shaving off the dielectric by forming a notch or small hole in the dielectric block.

In the example, aside from the same effects as in Example 1 by using a coaxial resonator, it is sufficient to press and bake the dielectric ceramic, and hence it is easy to manufacture. Also, since a ceramic material having high baking temperature can be used, materials of high dielectric constant can be used, and the filter may be reduced in size. In addition, since the unloaded Q value is slightly higher than in the strip line resonator, the insertion loss of the filter can be decreased.

EXAMPLE 3

Figure 10:
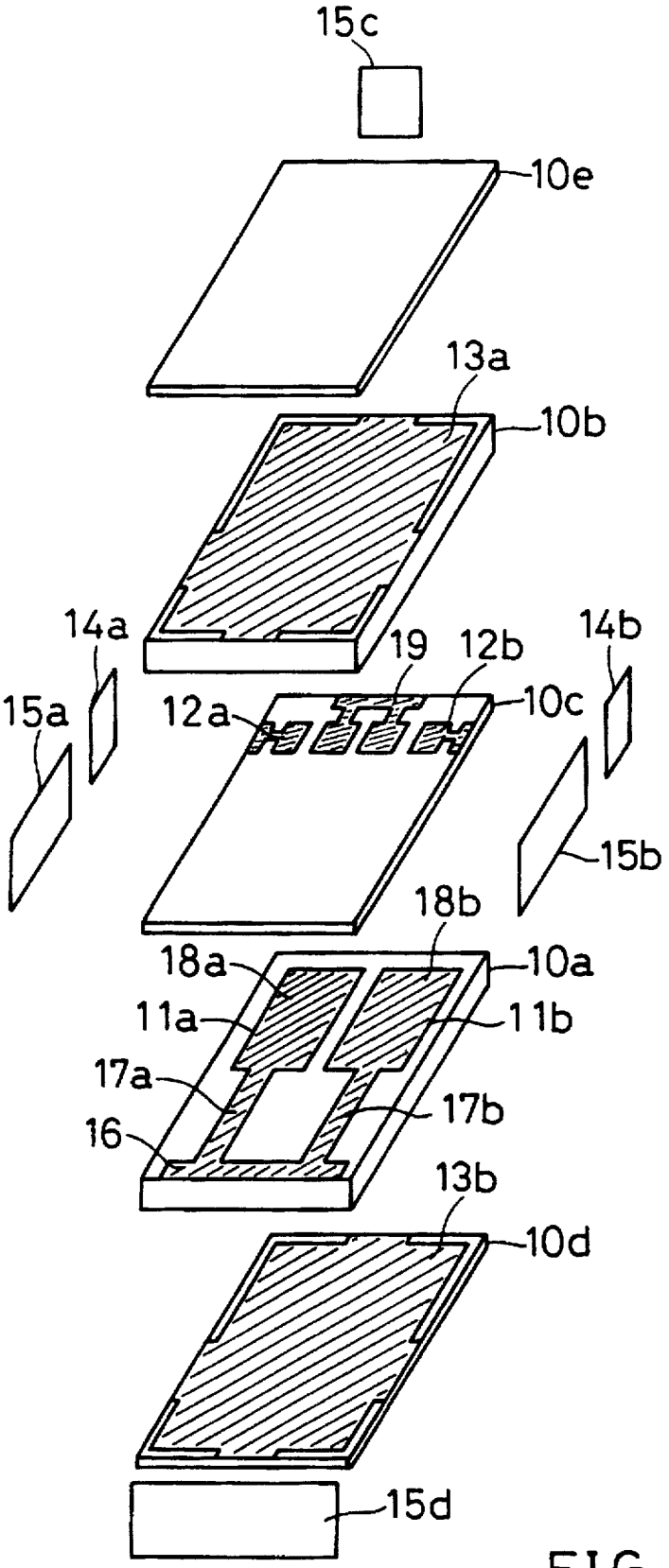
FIG. 10 is a perspective exploded view of a laminated dielectric filter in a third embodiment of the invention.

A laminated dielectric filter in an embodiment of the invention is described below with reference to a drawing. FIG. 10 is a perspective exploded view of the laminated dielectric filter. In FIG. 10, those structure that are the same as in FIG. 1 are identified with same reference numerals. What differs from FIG. 1 is that a loading capacity electrode 19 is provided so as to confront the open end portion of the strip line resonator electrodes 11a and 11b. In this embodiment, the resonance frequency can be further lowered by inserting the loading capacitor parallelly to the strip line resonator.

As the filter design formula in this embodiment, formula (4) and formula (6) are the same as in Example 1, and only formula (5) is changed to the above described formula (7).

Figure 11:
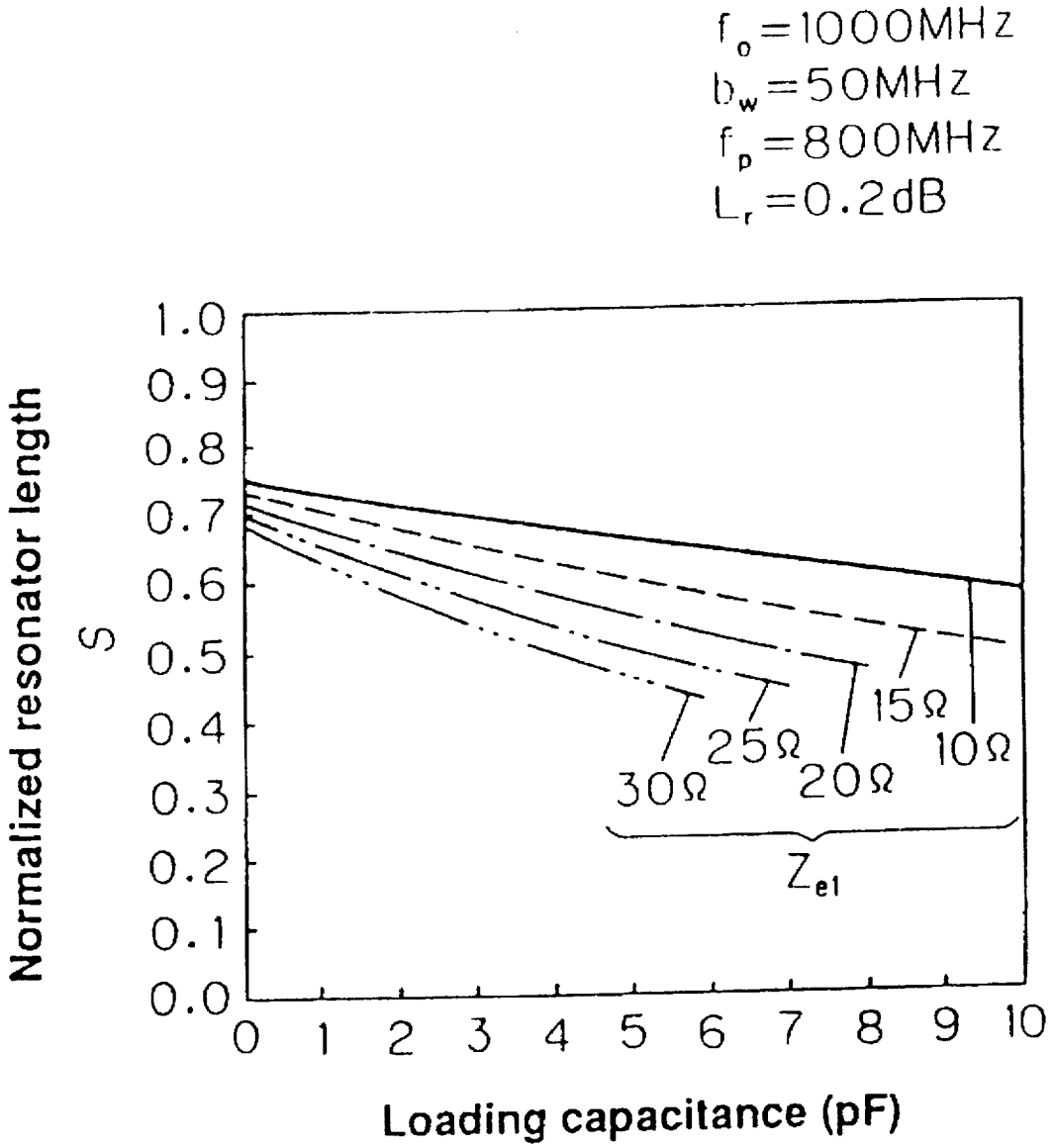
FIG. 11 is a graph showing the relationship between the loading capacity and the normalized resonator line length in the laminated dielectric filter in the third embodiment of the invention.

FIG. 11 is a graph for explaining the relation between the loading capacity and resonator line length in the third embodiment. By adding the loading capacity, it is known that the resonator line length is further shortened.

Thus, by providing the loading capacity electrode 19 confronting the open end portion of the strip line resonator electrodes 11a and 11b, the length of the resonator line can be further shortened, and the filter size can be reduced.

EXAMPLE 4

Figure 12:
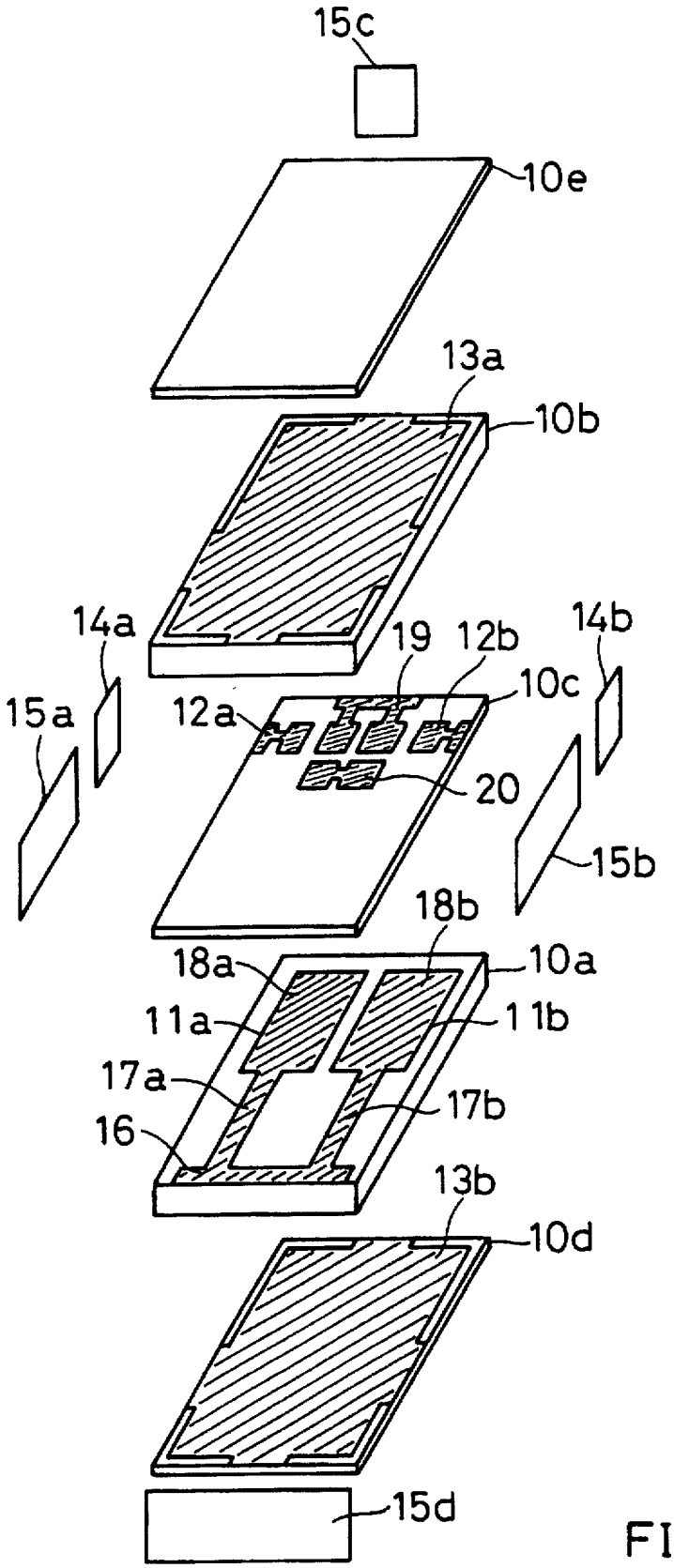
FIG. 12 is a perspective exploded view of a laminated dielectric filter in a fourth embodiment of the invention.
Figure 13:
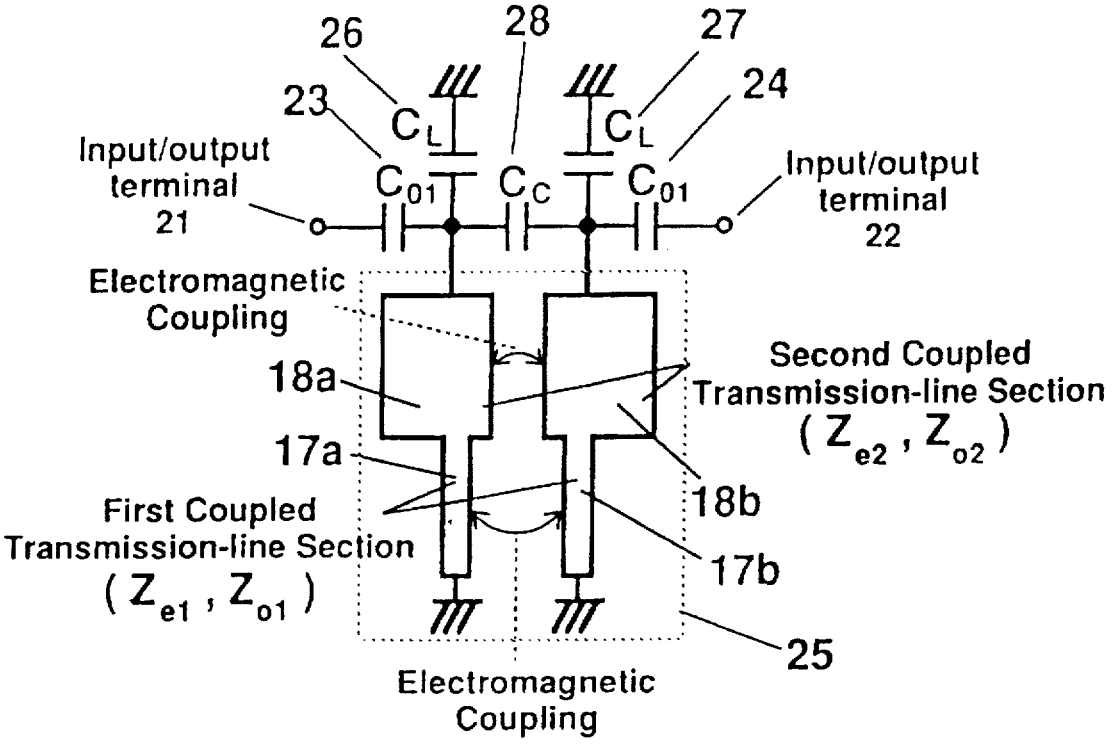
FIG. 13 is an equivalent circuit diagram of the laminated dielectric filter in the fourth embodiment of the invention.

A laminated dielectric filter in an embodiment of the invention is described below referring to the drawings. FIG. 12 is a perspective exploded view of the laminated dielectric showing the fourth embodiment of the invention. FIG. 13 is an equivalent circuit diagram of the laminated dielectric filter of the fourth embodiment. In FIG. 12, those structures same as in the structures in FIG. 1 are identified with same reference numerals. This embodiment differs from the first embodiment in FIG. 1 in that the coupling capacity electrode 20 and loading capacity electrode 19 are provided confronting the open end portion of the strip line resonator electrodes 11a, 11b.

Figure 14:
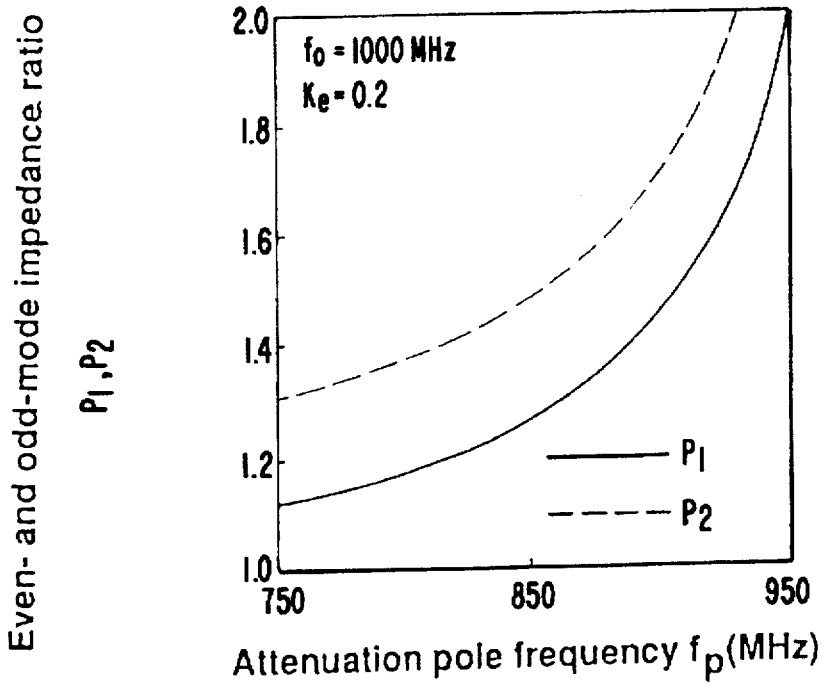
FIG. 14(*a*) and (*b*) are graphs showing the relation between the attenuation frequency and even/odd mode impedance ratio of the laminated dielectric filter in the fourth embodiment of the invention, FIG. 14(*a*) showing the case for a low-zero filter and FIG. 14(*b*) showing the case for a high-zero filter.
Figure 14:
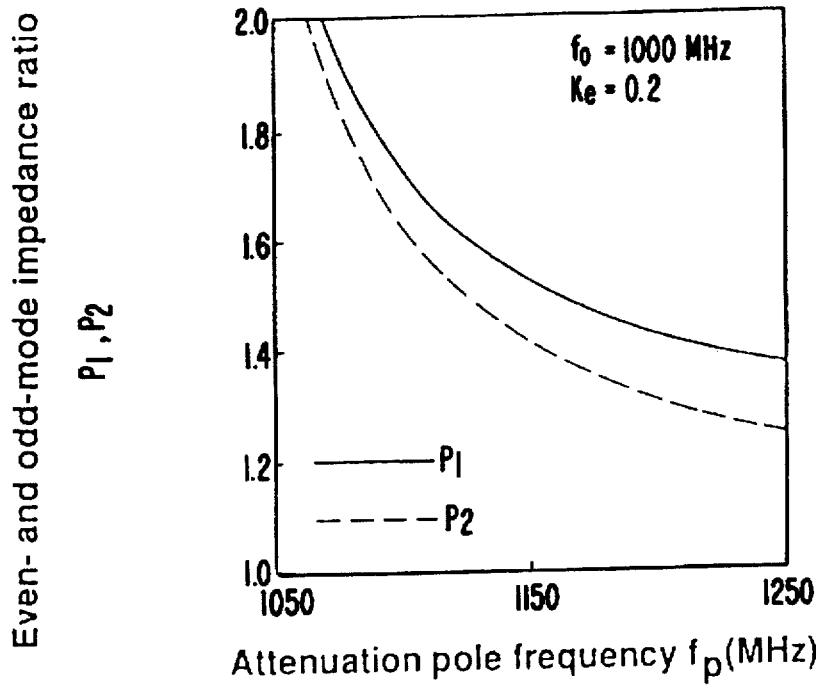

Prior to describing the operation of the dielectric filter of the embodiment, the difficulty in forming the attenuation pole near the passing band in the first embodiment is explained. FIG. 14(*a*) and (*b*) are graphs showing the even/odd mode impedance ratio necessary for the attenuation pole frequency of the dielectric filter in the first embodiment. FIG. 14(*a*) shows the filter with a low-zero, and FIG. 14(*b*) shows the filter with a high-zero. As the attenuation pole frequency approaches the center frequency, the required even/odd mode impedance ratios $P_1$, $P_2$ become larger.

As the guideline for manufacture of actual filter, supposing the minimum value of the manufacturable line width w and gap g to be 0.2 mm, and their maximum value due to the request of the size of the filter to be 2 mm, the even mode impedance $Z_e$ that can be realized is in the range of 7Ω to 35Ω as shown in FIG. 5. That is, the minimum even mode impedance step ratio $K_e$ is 0.2. Moreover, if $K_e$ is large, the resonator length cannot be shortened, and hence there is a proper range for $K_e$, and in relation to the structural parameter of the strip line, it is preferably 0.2 to 0.8, and more preferably 0.4 to 0.6. Hence, the even/odd mode impedance ratio P that can be realized is about 1.4 or less when the even mode impedance is 7Ω, 1.9 or less at 20Ω, and 2.2 or less at 35Ω.

Limitations on these values are restrictions on how closely the attenuation pole can be brought to the vicinity of the center frequency. In FIG. 14(*a*) and (*b*), based on the condition of $P_2$ being 1.4 or less, in the dielectric filter of the first embodiment, it is determined that the highest frequency of the lower attenuation pole frequency is 814 MHz, and the lowest frequency of the upper attenuation pole frequency is 1154 MHz.

To alleviate these limitations, the coupling capacity and loading capacity are introduced, and the result is the dielectric filter of the fourth embodiment of the invention shown in FIG. 12.

The operations of the laminated dielectric filter of the fourth embodiment is described referring to FIG. 12 and FIG. 13. The transmission characteristic of the filter in the fourth embodiment shown in FIG. 13 can be calculated the same as in the filter in the first embodiment in FIG. 2 by using the even/odd mode impedance of the parallel coupling transmission line. In FIG. 13, those structures that are the same as in FIG. 2 are identified with the same reference numerals. What differs from FIG. 2 is that a coupling capacity ($C_c$) 28 formed between coupling capacity electrode 20 and strip line resonator electrodes 11a, 11b, and loading capacities ($C_L$) 26, 27 formed between the loading capacity electrode 19 and strip line resonator electrodes 11a, 11b are added.

Concerning the two-pole filter of the fourth embodiment, a designing method is described below. The two-port admittance of the two-terminal pair circuit 25 of parallel coupling SIR resonator is given in formula (2) as mentioned above. Therefore, in the structure of the embodiment, as the formula necessary for realizing the design filter characteristic, the formulas (4), (5), (6) given in the first embodiment should be rewritten as follows. That is, the formula (8) for giving the attenuation pole frequency $f_p$, $$f_p = \frac{-\alpha\beta Y_C + \sqrt{(\alpha-\beta)(K_o\alpha - K_e\beta) + \alpha^2\beta^2 Y_C^2}}{\alpha-\beta} \quad \text{Formula (8)}$$

the formula (9) for giving the filter center frequency $f_o$, $$Y_{01}^{e} + Y_L + Y_C = j\frac{K_o\alpha + K_e\beta - (\alpha+\beta) f_o^2}{2\alpha\beta f_o} \quad \text{Formula (9)}$$

and the formula (10) for giving the interstage admittance $Y_3$.

$$Y_3 - Y_C = -j\frac{K_o\alpha - K_e\beta - (\alpha-\beta) f_o^2}{2\alpha\beta f_o} \quad \text{Formula (10)}$$

The solution that satisfies these three formulas simultaneously is the design value of the dielectric filter of the fourth embodiment of the invention.

Figure 15:
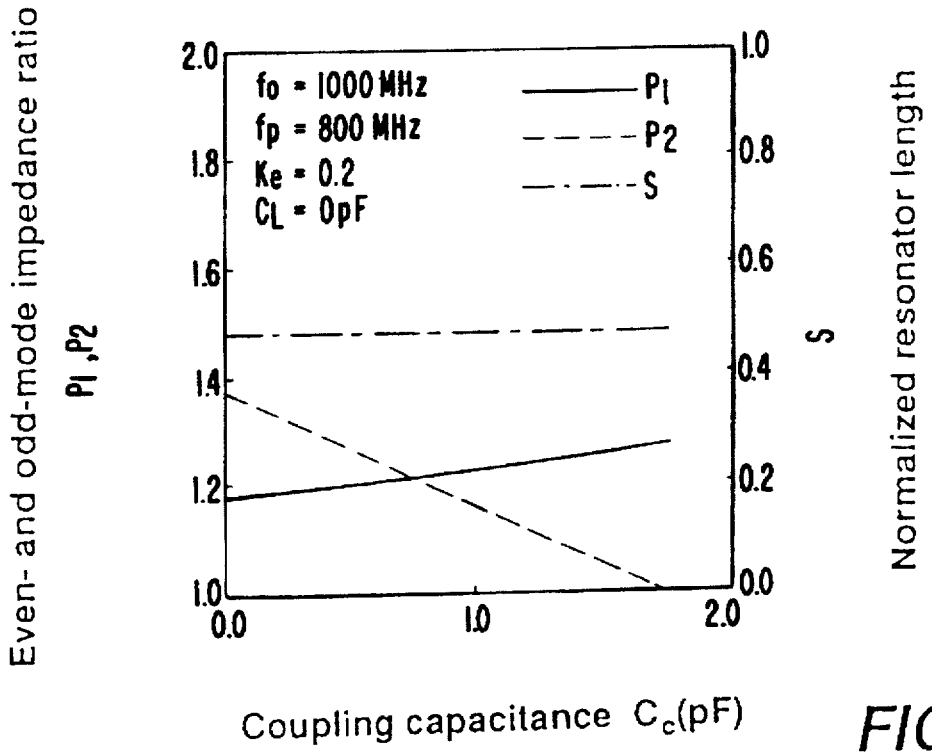
FIG. 15 is a graph showing the relationship of the coupling capacity, the even/odd mode impedance ratio, and normalized resonator line length of the laminated dielectric filter in the fourth embodiment of the invention.
Figure 16:
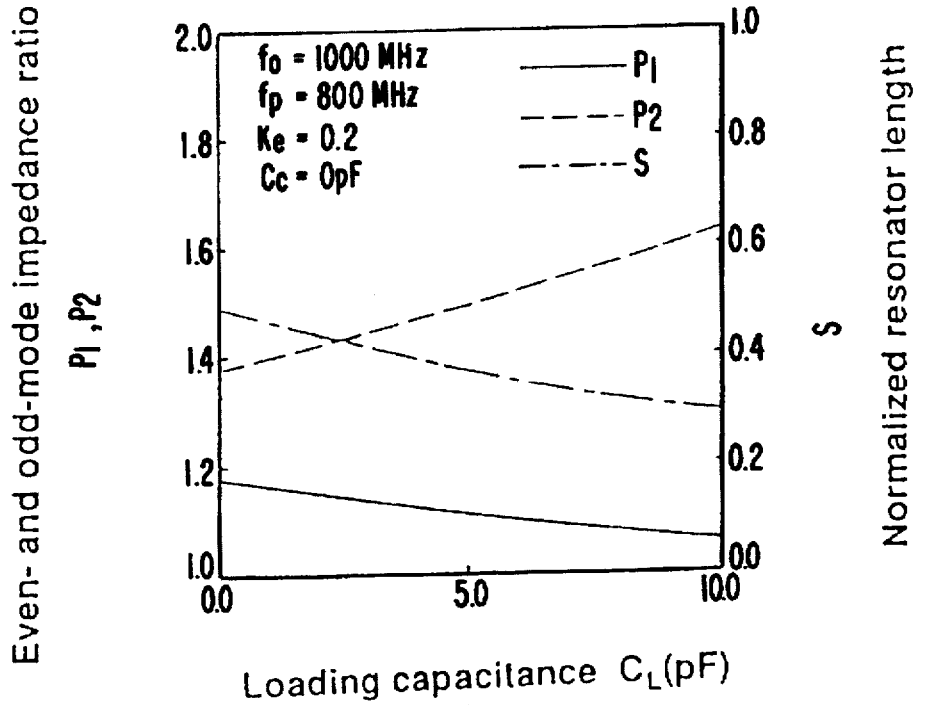
FIG. 16 is a graph showing the relationship of the loading capacity, even/odd mode impedance ratio, and normalized resonator line length of the laminated dielectric filter in the fourth embodiment of the invention.

The relation of the coupling capacity $C_c$ of the dielectric filter with a low-zero in the fourth embodiment with the corresponding even/odd mode impedance ratio ($P_1$, $P_2$) and normalized resonator line length S is shown in FIG. 15. The relation of the loading capacity $C_L$ with the even/odd mode impedance ratio ($P_1$, $P_2$) and normalized resonator length S is shown in FIG. 16. These diagrams are calculated at the center frequency $f_o$ of 1000 MHz, attenuation pole frequency $f_p$ of 800 MHz, and even mode impedance step ratio $K_e$ of 0.2. In FIG. 15, the loading capacities ($C_L$) 26, 27 are fixed at 0 pF, and in FIG. 16 the coupling capacity ($C_c$) 28 is fixed at 0 pF.

When the coupling capacity $C_c$ increases, $P_1$ increases, $P_2$ decreases, and S is unchanged. On the other hand, when the loading capacity $C_L$ increases, $P_1$ decreases, $P_2$ increases, and S decreases. Therefore, by the combination of the coupling capacity ($C_c$) 28 and loading capacities ($C_L$) 26, 27, the even/odd mode impedance ratio ($P_1$, $P_2$) can be adjusted to a practical value. Hence, an attenuation pole may be made up in the vicinity of the passing band.

FIG. 14(*a*), shows that when the even/odd mode impedance ratio $P_1$ of the first transmission lines is smaller than the even/odd mode impedance ratio $P_2$ of the second transmission lines, a low-zero is formed in the dielectric filter in the first embodiment. When the even/odd mode impedance ratio $P_1$ of the first transmission lines is larger than the even/odd mode impedance ratio $P_2$ of the second transmission lines, FIG. 14(*a*) shows that an a high-zero is formed in the dielectric filter in the first embodiment. On the other hand, FIGS. 15, 16 of the fourth embodiment show the possibility that their relation may be exchanged depending on the magnitude of the coupling capacity and loading capacity. Therefore, by thus properly setting the relation of $P_1$ and $P_2$, the attenuation pole can be freely formed at a specified frequency in the structure of the invention.

Figure 17:
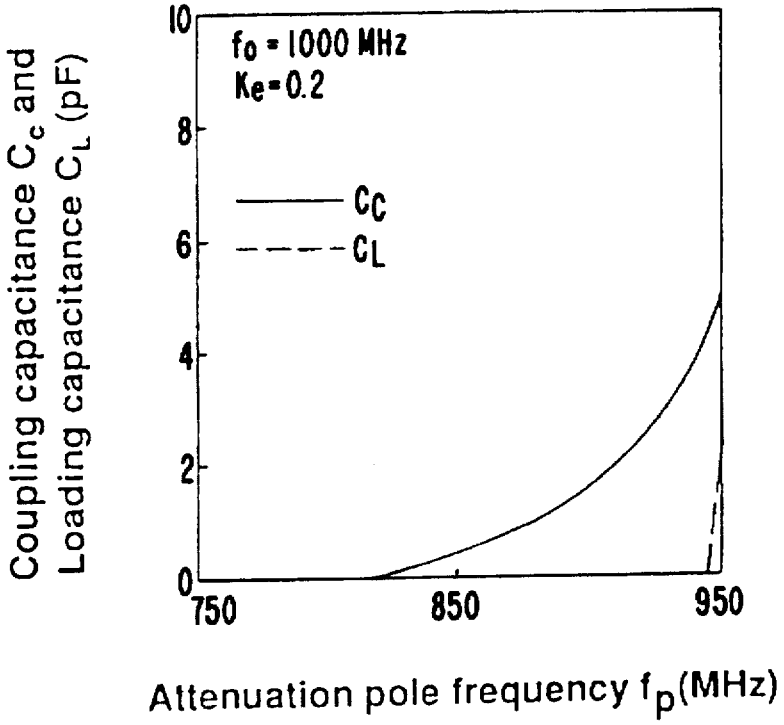
FIG. 17(*a*) and (*b*) are graphs showing the relationship of the attenuation frequency, coupling capacity, and loading capacity of the laminated dielectric filter in the fourth embodiment of the invention, FIG. 17(*a*) showing the case for a low-zero filter and FIG. 17 (*b*) showing the case for a high-zero filter.
Figure 17:
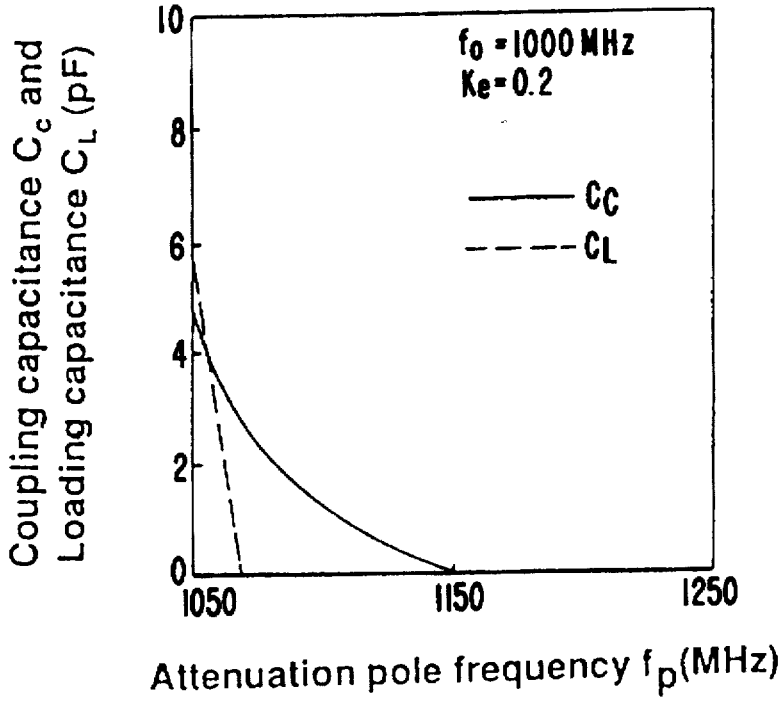

FIG. 17(*a*) is a graph showing the minimum required coupling capacity and loading capacity values for the attenuation pole frequency of the dielectric filter possessing the lower electrode in the fourth embodiment. FIG. 17(*b*) is a graph showing the minimum required coupling capacity and loading capacity values for the attenuation pole frequency of the dielectric filter with a high-zero in the fourth embodiment. As known from the curves of the graphs, although not created by the dielectric filter of the structure in the first embodiment, the attenuation pole in a frequency range of within 15% on both sides of the polarity of the center frequency, specifically the attenuation pole in a frequency range of 814 MHz to 1154 MHz can be manufactured in the dielectric filter of the structure in the fourth embodiment. It is also shown that the loading capacity is essential in the close vicinity to the passing band. By forming an attenuation pole in the frequency range of within 15% on both sides of the polarity of the center frequency, a band pass filter having a high selectivity can be realized.

Figure 18:
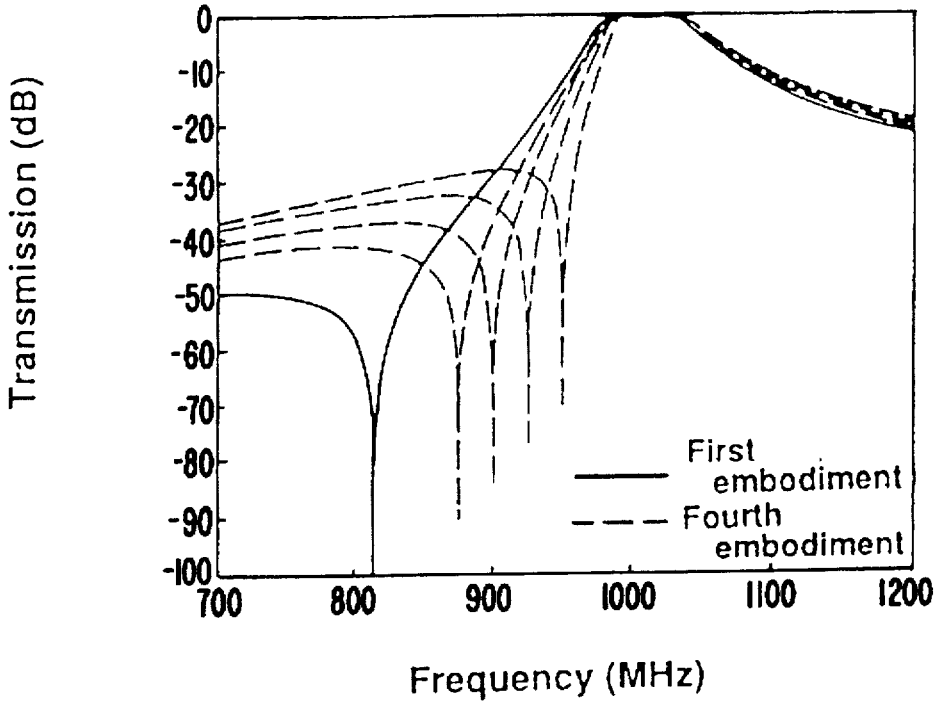
FIG. 18(*a*) and (*b*) are graphs showing the simulation results of transmission characteristic of the laminated dielectric filter of the first embodiment and the laminated dielectric filter in the fourth embodiment of the invention, FIG. 18(*a*) showing the characteristic of the low-zero filter and FIG. 18(*b*) showing the characteristic of the high-zero filter.
Figure 18:
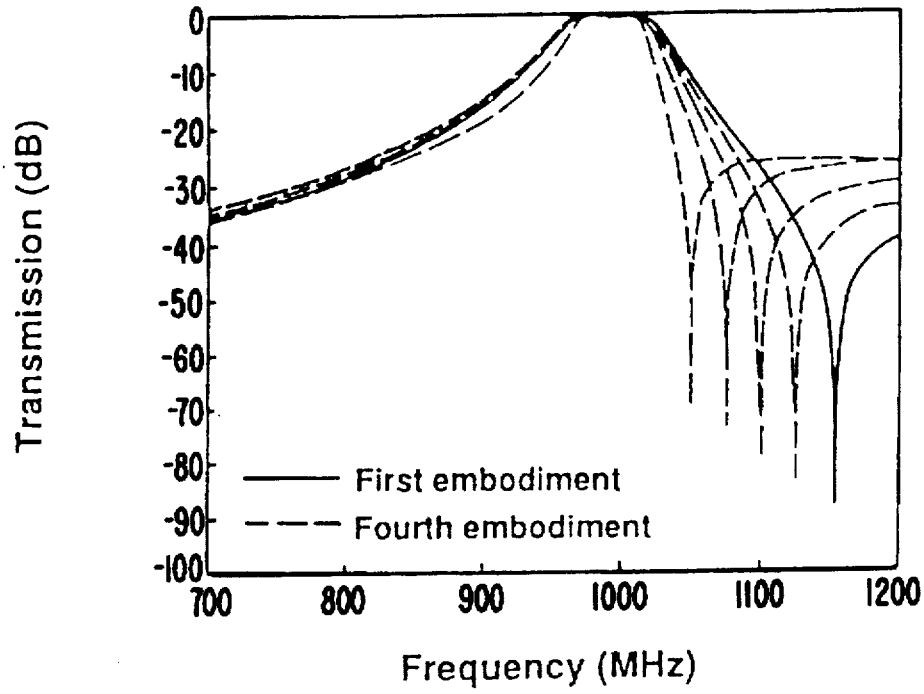

FIG. 18(*a*) and (*b*) are graphs showing the transmission characteristic simulation result for improving the attenuation amount near the passing band of the dielectric filter in the first embodiment and fourth embodiment. FIG. 18(*a*) relates to a filter with low-zero, and FIG. 18(*b*) shows a filter with a high-zero. In both cases, the solid line shows the characteristic when the attenuation pole is brought closest to the passing band in the filter of the first embodiment, and the broken line shows the characteristic obtained in the filter of the fourth embodiment. In the filter of the fourth embodiment, a superior selectivity characteristic to that of the filter of the first embodiment is obtained.

Thus, this embodiment comprises at least two or more TEM mode resonators in the SIR (stepped impedance resonator) structure with an overall line length shorter than a quarter wavelength constituted by cascade connection of other ends of the first transmission lines having one end grounded and the second transmission lines having one end open with the characteristic impedance lower than that of the first transmission lines. The first transmission lines are coupled electromagnetically, and the second transmission lines are coupled electromagnetically. Both electromagnetic coupling amounts are set independently, while at least two TEM mode resonators are capacitively coupled through separate coupling means, so that an attenuation pole can be generated near the passing band of transmission characteristic, which is an excellent characteristic. Also, in the fourth embodiment, by inserting the loading capacity parallelly to the strip line resonator, the resonator line length can be further shortened, and therefore the filter can be reduced in size. Therefore, a small dielectric filter with high selectivity can be realized. Such characteristic is very preferable for a high frequency filter for use in, for example, a portable telephone.

EXAMPLE 5

Figure 19:
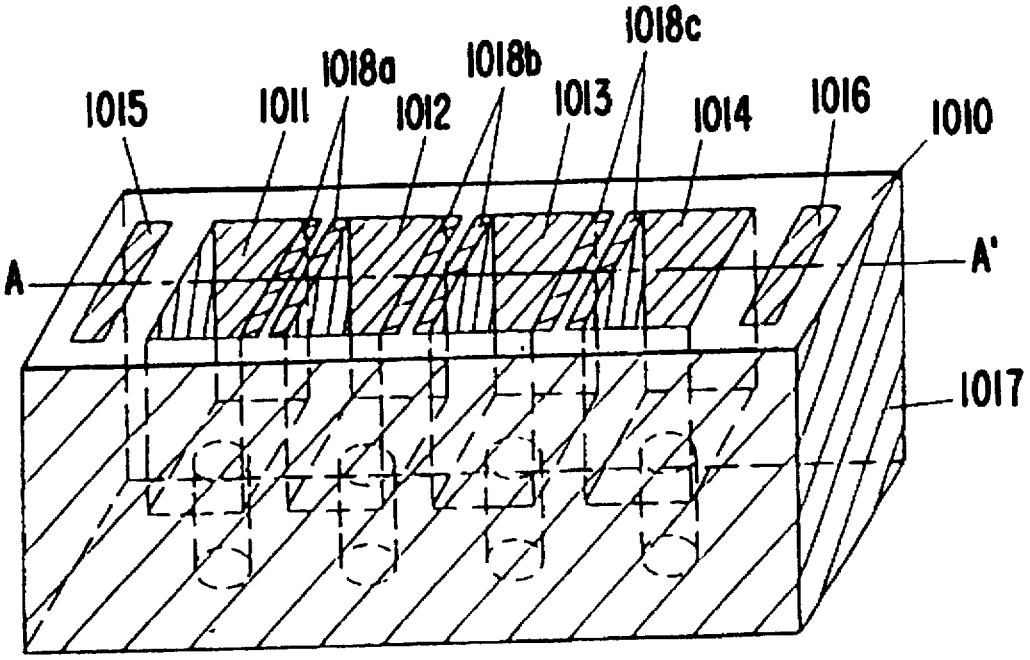
FIG. 19(*a*) is a perspective view of a block type dielectric filter in a fifth embodiment of the invention, and FIG. 19(*b*) is a sectional view of section A–A' in FIG. 19(*a*).
Figure 19:
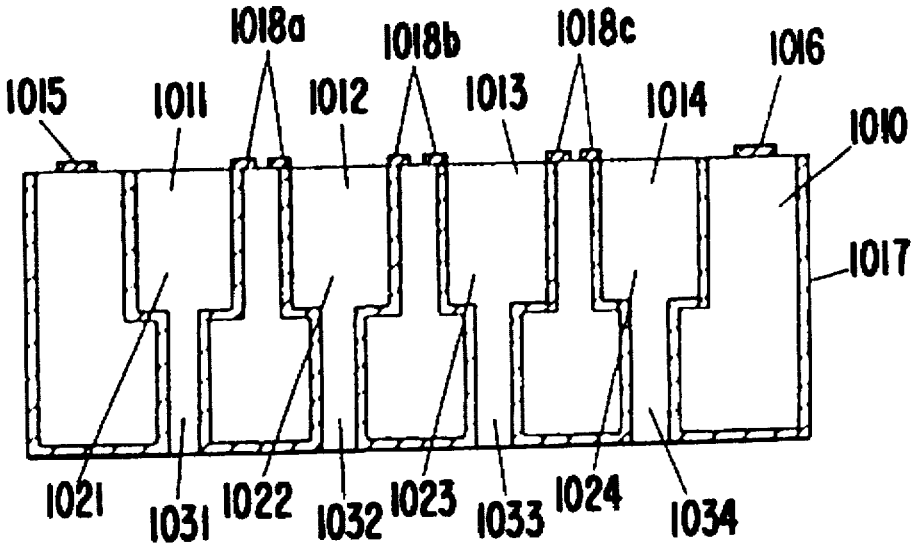

A block type dielectric filter in an embodiment of the invention is described below referring to the drawings. FIG. 19(*a*) is a perspective oblique view of the block type dielectric filter showing the fifth embodiment of the invention, and FIG. 19(*b*) is a sectional view of section A–A' of the block type dielectric filter showing the fifth embodiment of the invention. The fifth embodiment differs from the fourth embodiment in that an integrated coaxial resonator formed through a penetration hole of the dielectric block is used instead of the strip line resonator, as the TEM mode resonator.

In FIG. 19(*a*) and (*b*), those same structures as in the constitution in FIG. 9 are identified with same reference numerals. Reference numeral 1010 is a dielectric block, 1011, 1012, 1013, 1014 are resonator electrodes, 1015, 1016 are input and output coupling capacity electrodes, 1017 is a shield electrode, and 1018*a*, 1018*b*, 1018*c* are coupling capacity electrodes. The resonator electrodes are respectively composed of first transmission lines 1031, 1032, 1033, 1034 of high characteristic impedance, and second transmission lines 1021, 1022, 1023, 1024 of low characteristic impedance, and they are mutually coupled electromagnetically. Capacitive coupling is effected by the capacity in the gaps of the coupling capacity electrodes 1018*a*, 1018*b*, and 1018*c*.

The magnetitude of the electromagnetic field coupling can be adjusted by varying the distance between transmission lines, or shaving off the dielectric by forming a notch or a tiny hole in the dielectric block.

In the fifth embodiment, aside from the same effects as in the fourth embodiment, by using the integrated coaxial resonator, it is sufficient to press, form and bake the dielectric ceramic, and it is easy to manufacture. Ceramic materials of high baking temperature can be used, and hence materials of high dielectric constant can be used. In addition, since the unloaded Q value is slightly higher than in the strip line resonator, the filter insertion loss can be decreased.

EXAMPLE 6

Figure 20A:
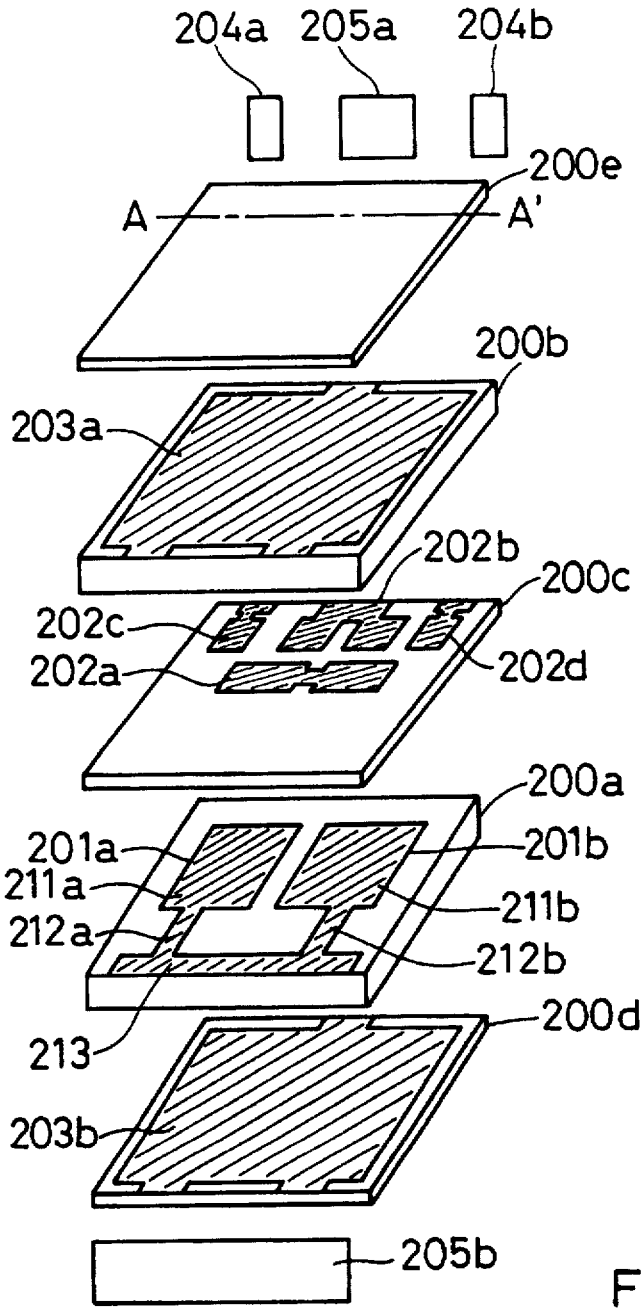
FIG. 20(*a*) is perspective exploded view of a laminated dielectric filter in a sixth embodiment of the invention, and FIG. 20(*b*) is a sectional view of section A–A' in FIG. 20(*a*).
Figure 20B:
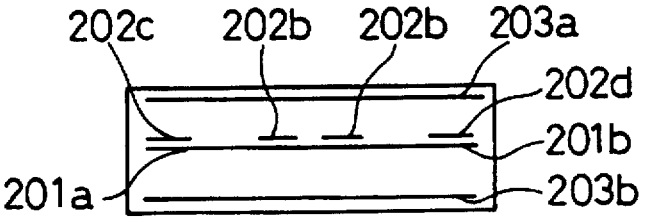
Figure 21:
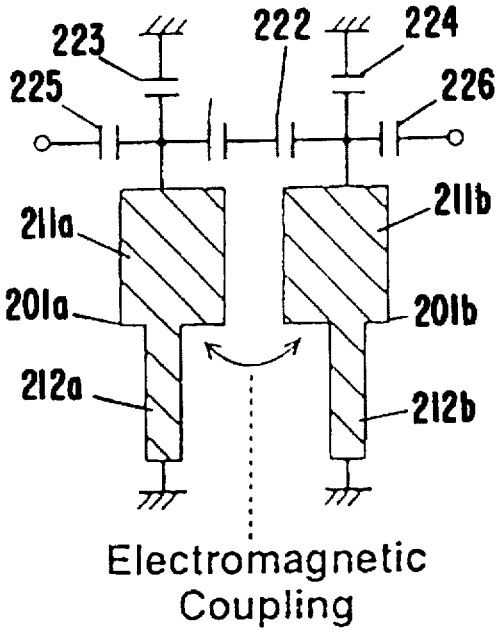
FIG. 21 is an equivalent circuit diagram of the laminated dielectric filter in the sixth embodiment of the invention.

Referring now to the drawings, a laminated dielectric filter in a sixth embodiment of the invention is described below. FIG. 20(*a*) is a perspective exploded view of the laminated dielectric filter showing the sixth embodiment of the invention, and FIG. 20(*b*) is a sectional view of section A–A' of the laminated dielectric filter showing the sixth embodiment of the invention. FIG. 21 is an equivalent circuit diagram for description of the operation in the laminated dielectric filter of the sixth embodiment shown in FIG. 20.

The filter circuit constitution of the embodiment has many points common with the fourth embodiment in appearance. However, each resonator is not necessarily required to be in SIR structure composed of the first transmission line and the second transmission line lower in characteristic impedance than the first transmission line. Therefore, in the constitution of the embodiment, an independent electromagnetic field coupling amount of the first transmission lines or second transmission lines is not taken into consideration at all.

In FIG. 20, reference numerals 200*a*, 200*b* are thick dielectric sheets. Strip line resonator electrodes 201*a*, 201*b* are formed on the dielectric sheet 200*a*, and a second electrode 202*a*, a third electrode 202*b*, and fourth electrodes 202*c*, 202*d* of a parallel flat plate capacitor are formed on the dielectric sheet 200*c*.

A shield electrode 203*a* is formed on the dielectric sheet 200*b*, and a shield electrode 203*b* is formed on the dielectric sheet 200*d*. A dielectric sheet 200*e* for the protection of the electrode is laminated together with all other dielectric sheets, and an entirely laminated structure is formed. As the dielectric material, for example, ceramics of Bi—Ca—Nb—O system with the dielectric constant of 58, or other ceramic material that can be baked at 950° C. or less can be used. A green sheet is formed, and an electrode pattern is printed by using metal paste of high electric conductivity such as silver, copper and gold, and the materials are laminated and baked into one body.

By baking, the dielectric sheets and electrode layers shrink and contract by about 10 to 20% in the horizontal direction and vertical direction. If the multiple factor of the shrinkage of the electrode layer is larger than that of the dielectric sheet, the terminal of the electrode is indented inward at the end of the laminate, and it cannot be connected with the terminal electrode formed on the side. To avoid this, using an electrode material in which the multiple factor of the shrinkage in baking is slightly smaller than that of the dielectric sheet, strip line resonator electrodes and shield electrodes are formed on respective dielectric sheets, and the dielectric sheets are laminated and baked into one body. In this way, the electrode terminal is projected to the end face of the laminate by several to scores of micrometers, thus attaining a successful connection with the terminal electrode formed on the side.

The thick dielectric sheets 200*a*, 200*b* can be formed into a specified thickness by laminating a plurality of thin green sheets. Thus, all dielectric sheets can be formed in a normalized thickness, so that it is easy to manufacture.

The fourth electrodes 202*c*, 202*d* are connected to side electrodes 204*a*, 204*b* of the input and output terminals. The upper and lower shield electrodes 203*a*, 203*b* are connected to the side electrodes 205*a*, 205*b* of the grounding terminals. The side electrodes at grounding terminals are grounded by providing at two side surfaces of the strip line resonator, that is, the side surface of the open end and the side surface at the short-circuit end, thereby suppressing the resonance of the shield electrodes and preventing deterioration in filter characteristic. Moreover, by forming a side electrode 205*a* as the grounding terminal between the input terminal and output terminal, it is effective to isolate between the input and output terminals. By forming asymmetrically by varying the number or shape of the side electrodes provided at the side surfaces, the mounting direction of the laminated dielectric filter can be easily recognized.

The shape of the shield electrodes 203*a*, 203*b* is formed by leaving a marginal blank space so that the outer periphery of the shield electrode may settle within the outer periphery of the dielectric sheet, except for the connecting position of the side electrode as a grounding terminal and its surroundings, forming the shield electrode one size smaller than the dielectric sheet. The adhesion strength of the green sheets of laminated ceramics is weak in the holding area of the metal paste for forming the electrode pattern, and particularly in the outer periphery of the dielectric sheet, a blank space of the shield electrode is provided so that the ceramics may adhere directly with each other.

Besides, by forming two layers of shield electrodes in the same shape, one kind of screen is sufficient for printing a shield electrode pattern.

Moreover, by forming both upper and lower layers of the shield electrodes with the inner layer electrode, the forming method is the same as in the strip line resonator electrode layer and capacity electrode layer, so that manufacturing is easy. On the uppermost layer, by laminating the dielectric sheet 200*e* for protecting the electrode, it is possible to protect the upper shield electrode layer 203*a* formed of an inner layer electrode that is not sufficient in mechanical strength. Of course, since the lower shield electrode layer 203b is also printed on the dielectric sheet 200*d*, it is protected from the external environment.

The strip line resonator is reduced in size by narrowing the line width of the short-circuit side of the strip line in the midst of the strip line, in steps from the broad parts 211*a*, 211*b* to the narrow parts 212*a*, 212*b*. The short-circuit side of the electrodes 212*a*, 212*b* at the narrow side of the strip line resonator is connected to the side electrode 205*b* of the grounding terminal through the broad common grounding electrode 213, and is grounded. The length change of the broad common grounding electrode 213 has a smaller effect on the resonance frequency than the length change of the strip line resonator electrodes 201*a*, 201*b*, and therefore it is possible to suppress the fluctuations in resonance frequency due to variations when cutting off the dielectric sheet.

In this embodiment, the line width of the strip line resonator is changed in steps on the way toward the strip line. But different from the first to fifth embodiments, the strip line resonator having a constant line width may be also used. Other modifications such as slope change of line width may be also be applicable.

The operation of thus formed laminated dielectric filter in the embodiment of the invention is described below referring to FIGS. 20(*a*), 20(*b*) and 21. First, the strip line resonator electrodes 201*a*, 201*b*, and the second, third and fourth electrodes 202*a*, 202*b*, 202*c*, 202*d* respectively have parallel flat plate capacitors 221, 222, 223, 223, 225, 226 between them. The parallel flat plate capacitor 221 between the second electrode 202*a* and strip line resonator electrode 201*a*, and the parallel flat plate capacitor 222 between the second electrode 202*a* and strip line resonator electrode 201*b* function as interstage coupling capacitors. Therefore, the interstage coupling between resonators is achieved by the combination of electromagnetic field coupling between strip line resonators and electric field coupling through the parallel flat plate capacitors 221 and 222 connected in series.

When the distance between the strip line resonator electrodes is shortened for reduction of size, usually, the interstage coupling by electromagnetic field coupling becomes too large, and it is hard to realize a favorable narrow band characteristic. However, in the constitution of the invention, the interstage coupling can be reduced by cancellation of couplings by the combination of electromagnetic field coupling and electric field coupling, and a narrow band characteristic can be realized. At the same time, by the resonance phenomenon by combination of electromagnetic field coupling and electric field coupling, an attenuation pole can be composed in the transmission characteristic, so that excellent selectivity characteristic may be obtained.

What is of note here is that the generation method of the attenuation pole in the transmission characteristic is radically different from the generation method of attenuation pole in the dielectric filters in the first to fifth embodiments. That is, in the dielectric filters of the first to fifth embodiments, the first transmission lines and the second transmissions lines of the resonator in SIR structure are mutually coupled electromagnetically, whereas, in the constitution of this embodiment, the attenuation pole is generated by the parallel resonance by the combination of electromagnetic field coupling between resonators and electric field coupling due to interstage coupling capacitor. The principle of generation of attenuation pole in the embodiment is described specifically in Japanese Laid-open Patent No. 5-95202 and T. Ishizaki et al., "A Very Small Dielectric Planar Filter for Portable Telephones," 1993, IEEE MTT-S Digest, H-1, pp. 177–180, 1993. The related technology is also disclosed in U.S. Pat. No. 4,742,562 and R. Pregla, "Microwave Filters of Coupled Lines and Lumped Capacitances," IEEE Trans. on Microwave Theory and Tech., Vol. MTT-18, No. 5, pp. 278–280, May 1970.

The capacity electrode of the interstage coupling capacitor is composed of a second electrode 202*a* which is a floating electrode not electrically connected to any terminal electrode provided in the capacity electrode layer. The feature of this embodiment is that the electrode surface 201*a* and 201*b* of the strip line resonator are used dualistically as the first electrode for the comprising the parallel flat plate capacitor, and the parallel flat plate capacitors 221, 222 are connected in series, thereby realizing the interstage coupling capacitor in a flat laminatable structure.

The parallel flat plate capacitor 223 located between the third electrode 202*b* and the strip line resonator electrode 201*a*, and the parallel flat plate capacitor 224 located between the third electrode 202*b* and strip line resonator electrode 201*b* function as parallel loading capacitors for lowering the resonance frequency of the strip line resonator. Therefore, the length of the strip line resonators 201*a*, 201*b* can be set shorter than a quarter wavelength, so that the filter size can be reduced.

In FIG. 20, the third electrode 202*b* is integrated to confront the both two strip line resonator electrodes 201*a* and 201*b*, but the third electrode 202*b* may be separated into two divisions, and the third electrode may be independently provided and grounded in the strip line resonator electrodes 201*a* and 201*b*.

The parallel flat plate capacitor 225 disposed between the fourth electrode 202*c* and the strip line resonator electrode 201*a*, and the parallel flat plate capacitor 226 disposed between the fourth electrode 202*d* and strip line resonator electrode 201*b* function as input and output coupling capacitors.

In the constitution of the embodiment, since the shield electrode layer and capacity electrode layer are composed of different layers, a large coupling capacity may be formed between the strip line resonator electrode and capacity electrode, while keeping thick the thickness of the dielectric sheet between the strip line resonator electrode and shield electrode, so that a large capacity may be used for input and output coupling or interstage coupling. Supposing, for example, the capacity electrode is positioned in the same layer as the shield electrode layer, the dielectric sheet between the shield electrode layer and capacity electrode layer must be thin, the unloaded Q value deteriorates, and it is very difficult to realize a required coupling degree in the filter of the invention. However, in the constitution of the invention, the capacity electrode layer formed separately from the shield electrode layer is confronting the strip line resonator electrode layer across the thin dielectric sheet, thereby efficiently solving the problem.

In this constitution, moreover, all strip line resonator electrodes are printed on the dielectric sheet 200*a*, and all capacity electrodes on the dielectric sheets 200*c*, and hence electrode printing is required only in the dielectric sheet and the shield electrode layer, and the number of printing steps is small and fluctuations in filter characteristic may be suppressed. That is, by placing the strip line resonator electrode layer in one electrode layer, the relative positional precision between the strip line resonator electrodes can be improved, so that fluctuations may be reduced. Additionally, by forming the capacity electrode layer in one layer in electrode layer, control of the thickness of dielectric sheet which has a large effect on the characteristic fluctuations of the filter is effected by only controlling one layer of dielectric sheet 200*c* between the strip line resonator electrode layer and the capacity electrode layer, so that manufacturing control is very easy, which is another great advantage.

Figure 22:
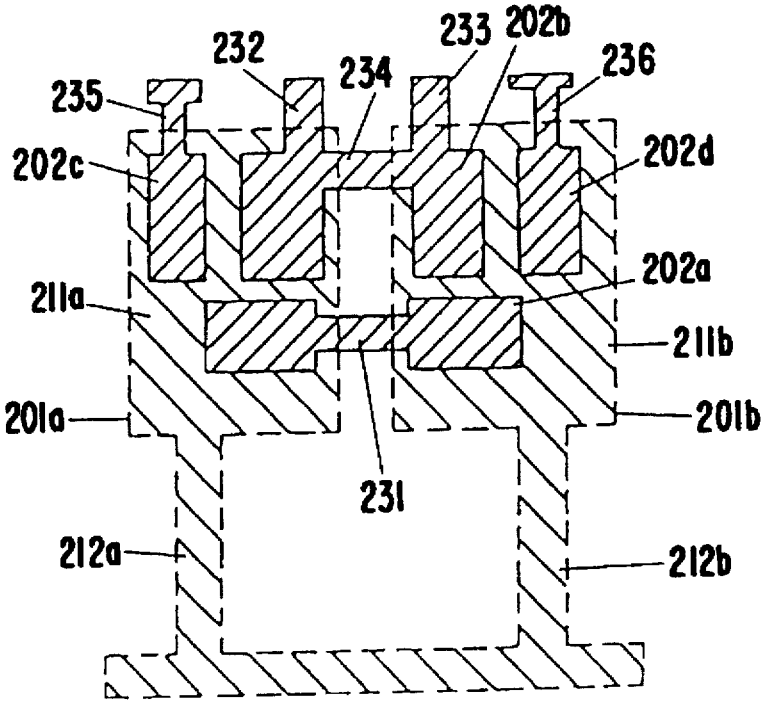
FIG. 22 is a perspective layout diagram of an electrode pattern of resonator electrode and capacity electrode of the laminated dielectric filter in the sixth embodiment of the invention.

FIG. 22 is a configuration perspective view of the capacity electrodes and strip line resonator electrodes of the laminated dielectric filter in the sixth embodiment of the invention. In the manufacturing processing of the laminated dielectric filter, it may be considered that the filter characteristic may fluctuate due to deviation in the position of the strip line resonator electrode layer and capacity electrode layer.

To eliminate such effect, as shown in FIG. 22, in the overlapping region of each capacity electrode with the outer edge of the strip line resonator electrode, a dent is formed in the capacity electrode to narrow the width of the electrode. A dent 231 is formed in the second electrode 202*a*, dents 232, 233, 234 are formed in the third electrode 202b, and dents 235, 236 are formed in the fourth embodiments 202c, 202d. By forming such narrow dent regions, the change in the area of the overlapping regions when position deviation occurs between the strip line resonator electrode layer and capacity electrode layer may be set considerably smaller as compared with the case without dents.

Meanwhile, as shown in the electrode configuration in FIG. 22, the electrode 202a of the interstage coupling capacitor is positioned between the open end and short-circuit end, not between the open ends of the strip line resonator electrodes 201a, 201b, because of the convenience of the electrode pattern layout, and it is different from the equivalent circuit in FIG. 21. When the position of the interstage coupling capacitor is moved from the open end to the short-circuit end, it has the same effect as decreasing the capacitance of the interstage coupling capacitor, equivalently. That is, the frequency of the attenuation pole moves to the higher side, and is deviated from the design value. However, for the convenience of description of the operation of the filter, the equivalent circuit in FIG. 21 is shown.

EXAMPLE 7

Figure 23:
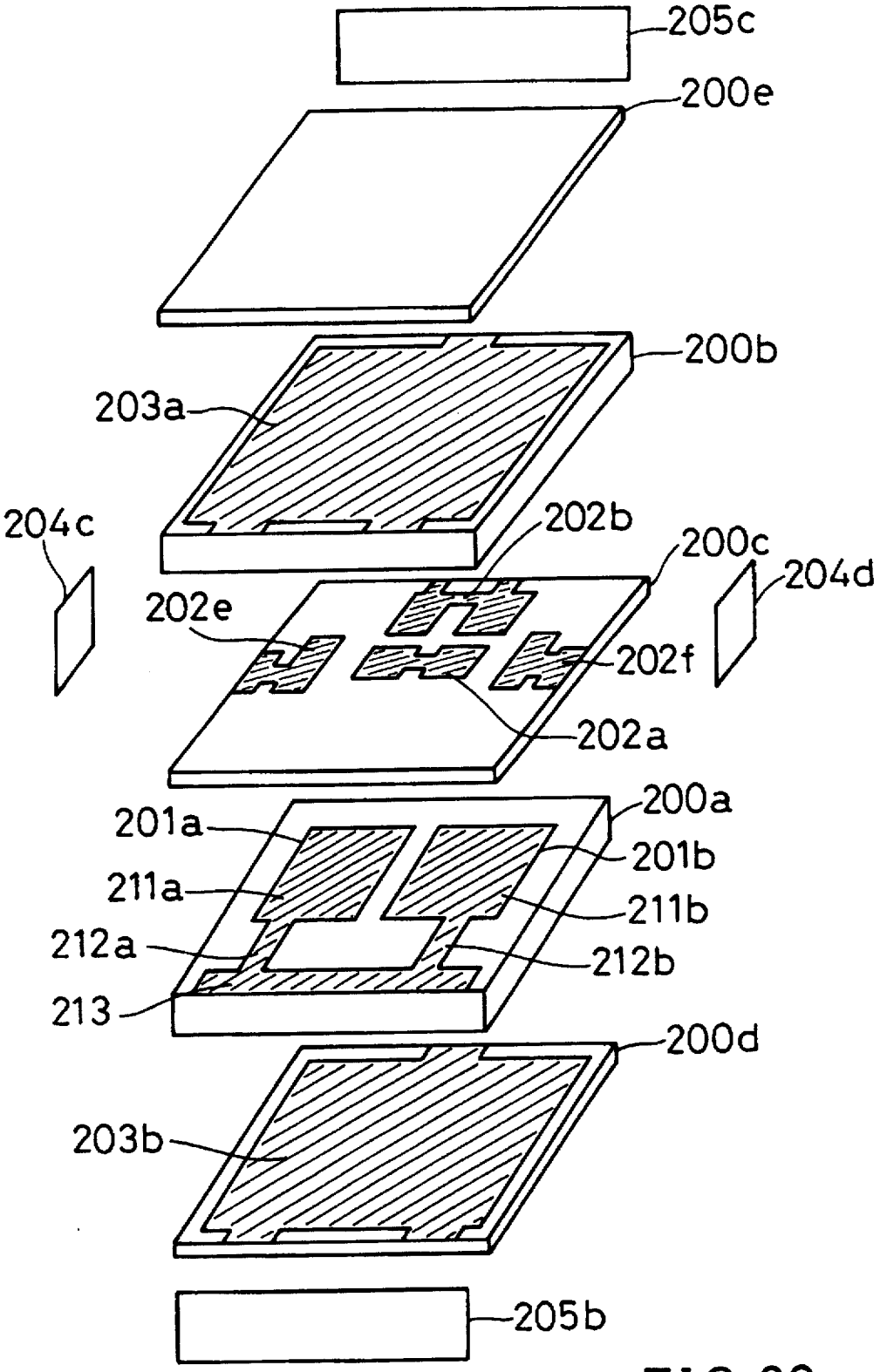
FIG. 23 is a perspective exploded view of a laminated dielectric filter in a seventh embodiment of the invention.

A laminated dielectric filter of a seventh embodiment of the invention is described by reference to a drawing. FIG. 23 is a perspective exploded view of a laminated dielectric filter in the seventh embodiment of the invention. In FIG. 23, the same elements as in FIG. 20 are identified with same reference numerals.

What differs from the sixth embodiment is that the fourth electrodes 202e, 202f taken out from the lateral direction of the strip line resonator electrode are used instead of the fourth electrodes 202c, 202d in the sixth embodiment. In this relation, the side electrodes as input and output terminals are changed from 204a, 204b to 204c, 204d, and the side electrode as a grounding terminal is changed from 205a to 205c.

By taking out the fourth electrodes as the input and output electrodes from the lateral direction, the distance between the input and output electrodes can be extended, and hence the spatial coupling between input and output can be decreased, so that the isolation can be wider.

Figure 24:
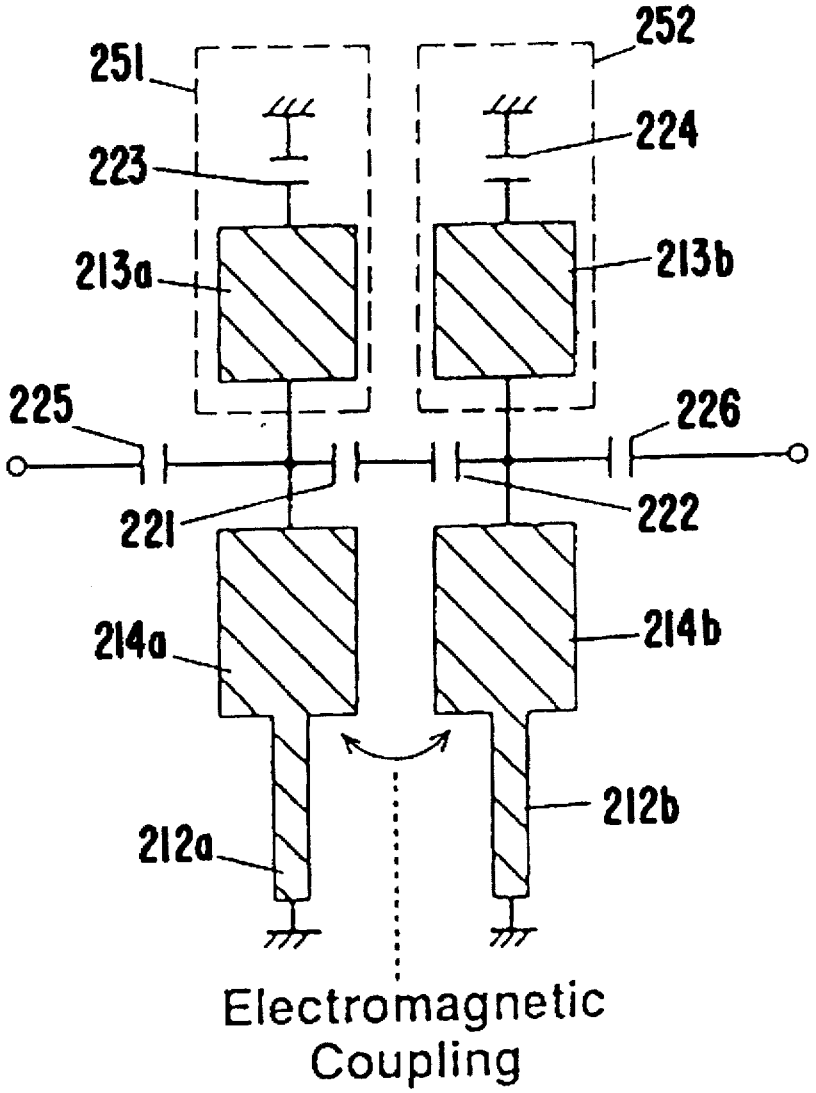
FIG. 24 is an equivalent circuit diagram of the laminated dielectric filter in the seventh embodiment of the invention.

In the seventh embodiment, the coupling position of the fourth electrodes is between the open end and short-circuit end of the strip line resonator electrodes. The equivalent circuit diagram of the laminated dielectric filter of the seventh embodiment is shown in FIG. 24. The input and output coupling capacitors 225, 226 are tapped down, and connected to the strip line resonator. Therefore, the broad parts 211a and 211b of the strip line resonator electrodes can be separately considered for the electrodes 213a and 214a, and 213b and 214b.

Herein, the series circuit 251 composed of electrode 213a and loading capacitor 223, and the series circuit 252 composed of electrode 213b and loading capacitor 224 both function as series resonance circuits. At the resonating frequency of the series circuits 251, 252, the impedance is zero, and hence an attenuation pole is formed in the filter transmission characteristic. That is, in the seventh embodiment, aside from the attenuation pole produced by the combination of electromagnetic field coupling and electric field coupling of the resonator in the sixth embodiment, the attenuation pole is also produced by the series resonance of the series circuits 251, 252, so that an excellent selectivity characteristic may be obtained.

EXAMPLE 8

Figure 25:
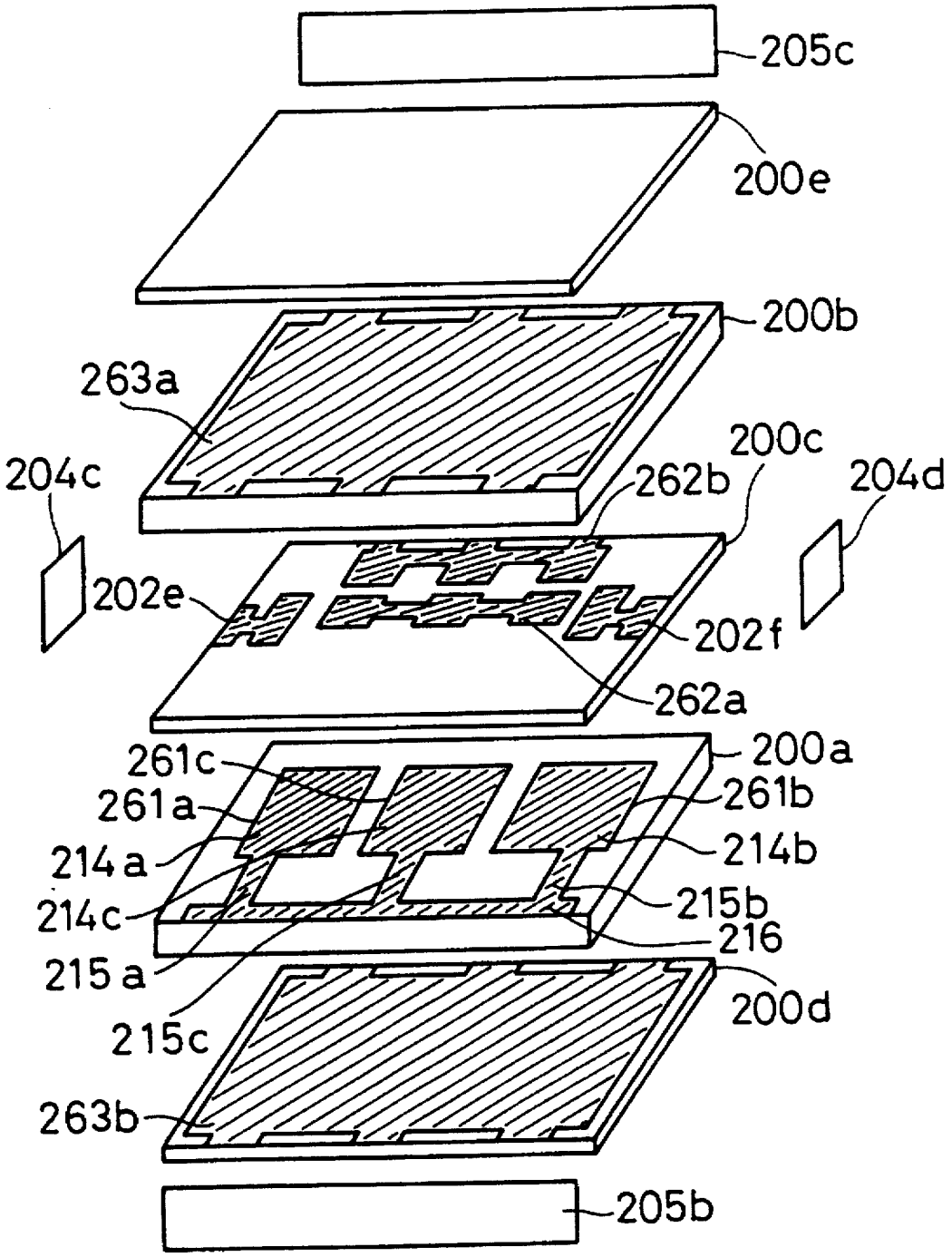
FIG. 25 is a perspective exploded view of a laminated dielectric filter in an eighth embodiment of the invention.
Figure 26:
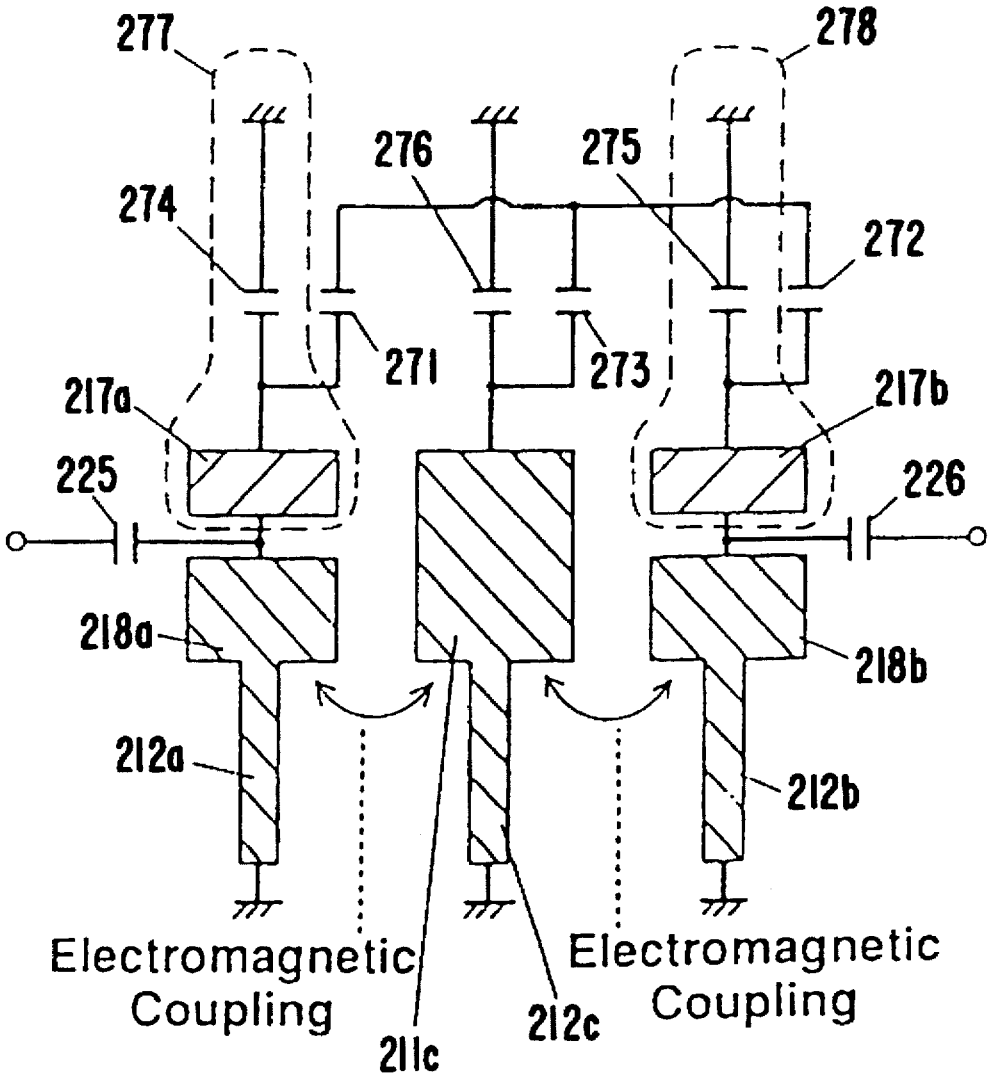
FIG. 26 is an equivalent circuit diagram of the laminated dielectric filter in the eighth embodiment of the invention.

A laminated dielectric filter in an eighth embodiment of the invention is described below with reference to the accompanying drawings. FIG. 25 is a perspective exploded view of the laminated dielectric filter showing the eighth embodiment of the invention. In FIG. 25, the same constituent elements as in FIG. 20 and FIG. 23 are identified with the same reference numerals. FIG. 26 is an equivalent circuit diagram for explaining the operation of the laminated dielectric filter in the eighth embodiment shown in FIG. 25.

The eighth embodiment differs from the seventh embodiment in that the filter is composed of three stages. Strip line resonator electrodes 261a, 261b, 261c are respectively composed of broad parts 2141, 214b, 214c, and narrow parts 215a, 215b, 215c, and the short-circuit side of the narrow parts is connected and grounded to the side electrode 205b as the grounding terminal through a broad common grounding electrode 216.

The second electrode 262a is formed on the dielectric sheet 200c, partly confronting all of the strip line resonator electrodes 261a, 261b, 261c, thereby realizing the interstage electric field coupling.

In the regions contacting the strip line resonator electrodes on the dielectric sheet 200c, the third electrode 262b is formed and grounded partly in the remaining region of the second electrode. The parallel flat plate capacitor composed between the third electrode 262b and the strip line resonator electrode functions as the parallel loading capacitor for lowering the resonance frequency of the strip line resonator. Therefore, the length of the strip line resonators 261a, 261b, 261c can be cut shorter than the quarter wavelength, so that the filter size can be reduced.

The shield electrodes 263a, 263b are formed on the dielectric sheets 200b, 200d so as to cover entirely over. By laminating the dielectric sheets 200e for protecting the electrode on the uppermost layer, it is possible to protect the upper shield electrode layer 263b formed of an inner layer electrode that not sufficient in the mechanical strength.

In this embodiment, since the coupling position of the fourth electrode is located between the open end and short-circuit end of the strip line resonator electrodes, the equivalent circuit diagram of the laminated dielectric filter of the embodiment is as shown in FIG. 26. The input and output capacitors 225, 226 are tapped down, and connected to the strip line resonator. Therefore, the broad parts 214a, 214b of the strip line resonator electrodes can be considered separately for the electrodes 217a and 218a, and 217b and 218b.

At the resonating frequency of the series circuit 277 composed of the electrode 217a and loading capacitor 274, and the series circuit 278 of the electrode 217b and loading capacitor 275, an attenuation pole is formed in the filter transmission characteristic. It is same as in the seventh embodiment.

The mutually adjacent strip line resonators are coupled electromagnetically, and are also coupled electrically through the interstage coupling capacitors 271, 272, 273, and by coupling the strip line resonators by the combination of electromagnetic field coupling and electric field coupling, two attenuation poles can be composed in the transmission characteristic by the resonance phenomenon by the combination of electromagnetic field coupling and electric field coupling, so that an excellent selectivity characteristic can be obtained.

The basic constitution in the eighth embodiment can be the same as in the seventh embodiment, or it may be constituted the same as in the sixth embodiment by setting the take-out direction of the input and output terminals the same as the direction of the open end of the strip line resonator electrodes.

Thus, in the eighth embodiment, by constituting the filter in three stages, excellent selectivity is obtained. The selectivity can be even further enhanced by composing in four or five stages.

EXAMPLE 9

Figure 27:
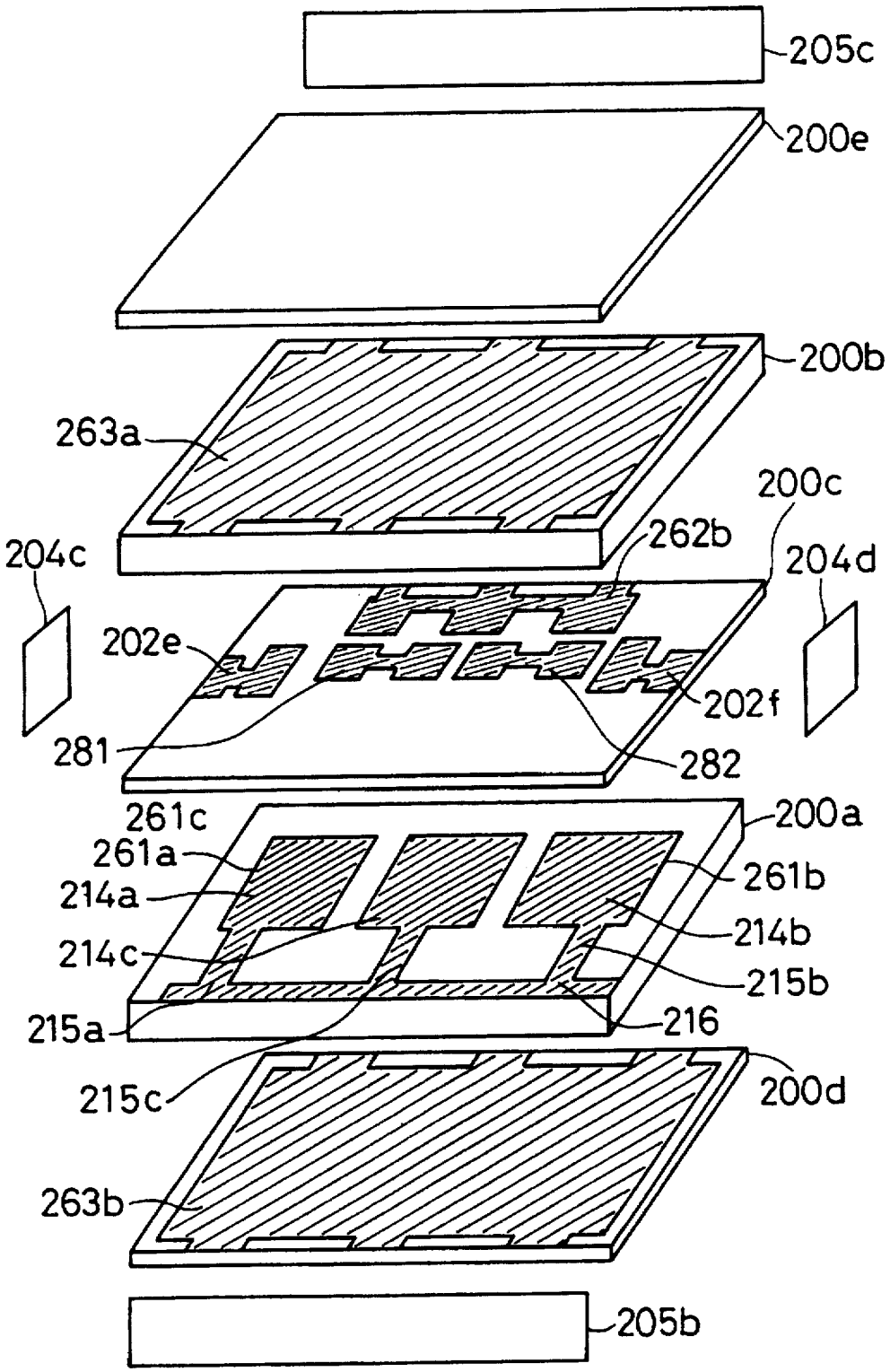
FIG. 27 is a perspective exploded view of a laminated dielectric filter in a ninth embodiment of the invention.
Figure 28:
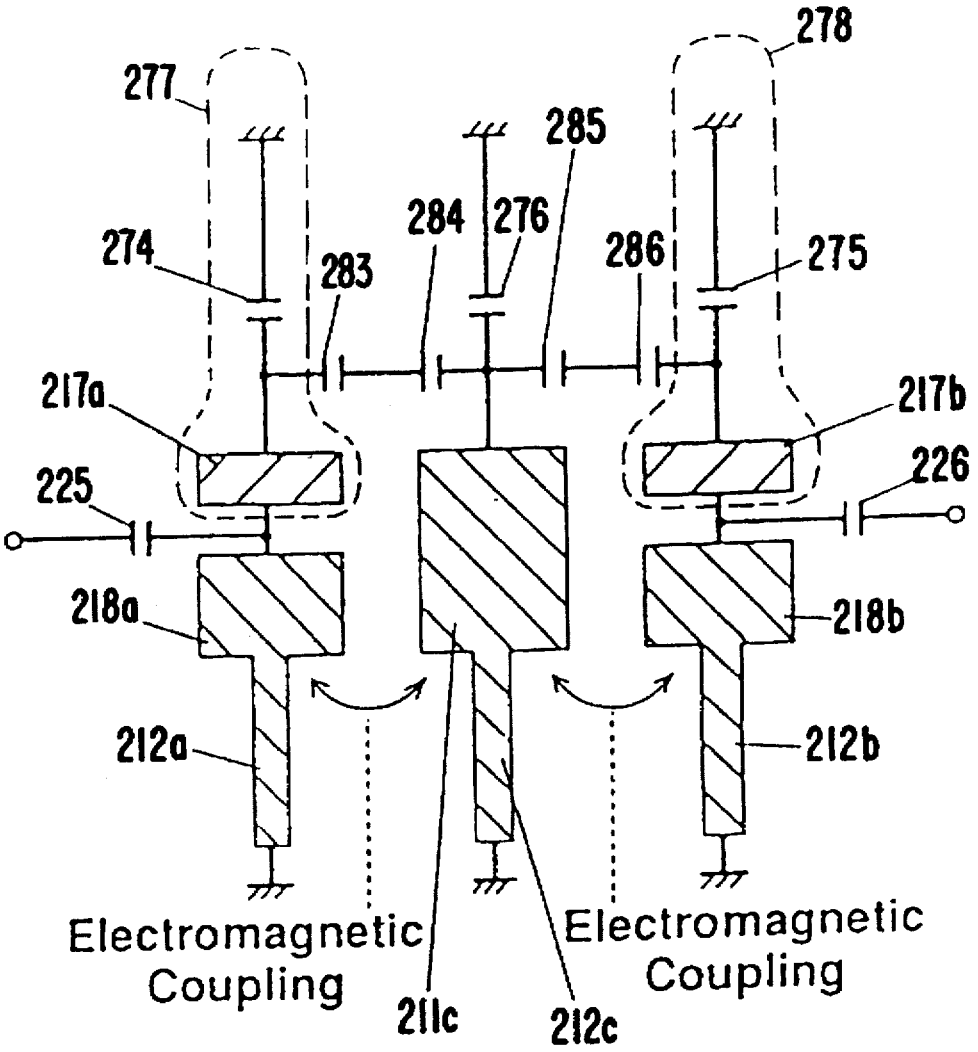
FIG. 28 is an equivalent circuit diagram of the laminated dielectric filter in the ninth embodiment of the invention.

Referring to the drawings, a laminated dielectric filter in a ninth embodiment of the invention is described below. FIG. 27 is a perspective exploded view of the laminated dielectric filter showing the ninth embodiment of the invention. In FIG. 27, the same constituent elements as in FIGS. 20, 23, 25 are identified with the same reference numerals. FIG. 28 is an equivalent circuit diagram for explaining the operation of the laminated dielectric filter of the ninth embodiment shown in FIG. 27.

The operation in the ninth embodiment is almost the same as in the eighth embodiment. The ninth embodiment differs from the eighth embodiment in the connecting method of the interstage coupling capacitor. In the eighth embodiment, the second electrode for forming the interstage coupling capacitor is composed of one electrode 262*a* confronting all strip line resonator electrodes, but in this embodiment, the second electrode is composed of the electrodes 281, 282 provided in every adjacent strip line resonator electrode.

The adjacent strip line resonators are coupled in electromagnetic field, and are also coupled in electric field through the interstage coupling capacitor composed of capacitors 283 and 284, and 285 and 286 connected in series, and the strip line resonators are coupled by combination of electromagnetic field coupling and electric field coupling, and therefore two attenuation poles are composed in the transmission characteristic by the resonance phenomenon by combination of electromagnetic field coupling and electric field coupling.

In this way, in the ninth embodiment, the same effect as in the eighth embodiment can be obtained, and the resonance characteristic can be designed by the combination of electromagnetic field coupling and electric field coupling in each adjacent strip line resonator, so that the design is easier than in the eighth embodiment.

EXAMPLE 10

Figure 29:
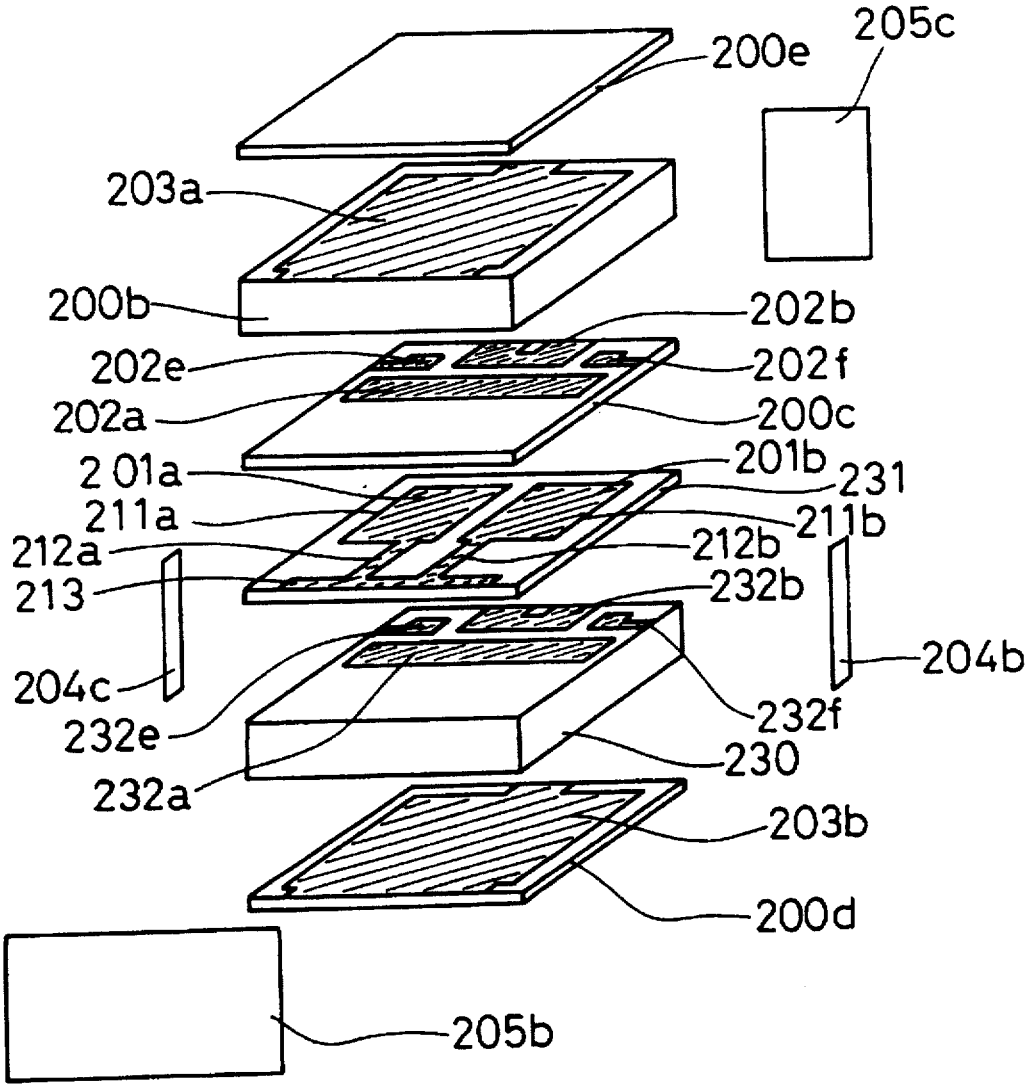
FIG. 29 is a perspective exploded view of a laminated dielectric filter in a tenth embodiment of the invention.

A laminated dielectric filter in a tenth embodiment of the invention is described below by reference to the accompanying drawing. FIG. 29 is a perspective exploded view of the laminated dielectric filter in the tenth embodiment of the invention. In FIG. 29, reference numerals 230, 200*b* are thick dielectric sheets, 231, 200*b* to 200*e* are thin dielectric sheets, 203*a*, 203*b* are shield electrodes, 202*e*, 202*f*, 232*e*, 232*f* are input and output coupling capacity electrodes, 202*b*, 232*b* are loading capacity electrodes, 201*a*, 201*b* are strip line resonator electrodes, 202*a*, 232*a* are interstage coupling capacity electrodes, 204*c*, 204*d* are input and output terminals, 205*b*, 205*c* are grounding terminals, and 213 is a common grounding electrode. The strip line resonators 201*a*, 201*b* are in SIR structure consisting of broad parts 211a, 211*b*, and narrow parts 212*a*, 212*b*, and the resonator length is shortened.

Operation in the thus constituted laminate dielectric filter in the tenth embodiment is described below. The basic operating principle of the filter in the embodiment is nearly same as that in the filters in the sixth and seventh embodiment. The filter of this embodiment differs from other embodiments in that the input and output coupling capacity electrodes 202*e*, 202*f*, 232*e*, 232*f*, loading capacity electrodes 202*b*, 232*b*, and interstage coupling capacity electrodes 202*a*, 232*a* are formed on the upper and lower layers of the dielectric sheets 230, 200*c* of the strip line resonator electrodes 201*a*, 201*b* so as to hold the strip line resonator electrode from both sides.

The conductor loss of the strip line is, as shown in the literature (Y. Konishi, "MAIKUROHA KAIRO NO KISO TO SONO OUYOU" (Basics of Microwave Circuit and Its Application), p. 52, SOGODENSHI-SYUPPANSYA, Tokyo, 1990), or is expressed in the following formula (11) if there is no edge effect. Formula (11)

$$L_c \times A/Z_c$$

Where $L_c$ is Conductor loss, A is Constant, $Z_c$ is Characteristic impedance.

That is, the conductor loss of the strip line is in inverse proportion to the characteristic impedance. Therefore, by providing the loading capacity electrode, the characteristic impedance of its region decreases, and it is generally predicted that the conductor loss may increase.

In the laminated dielectric filter of the embodiment, as a result of composing the loading capacity electrodes 202*b*, 232*b* for constituting the loading capacity at the upper and lower sides of the strip line resonator electrode, as compared with the case of forming on one side only, the electrode area for realizing the same loading capacity is halved. Accordingly, the insertion loss of the filter due to increase in conductor loss can be decreased.

In the embodiment, by constituting the input and output coupling capacity electrodes 202*e*, 202*f*, 232*e*, 232*f* above and beneath the strip line resonator electrode, the input and output coupling capacity is increased as compared with the case of positioning at one side, so that a broad filter can be composed in spite of its small size.

Furthermore, by forming the interstage coupling capacity electrodes 202*a*, 232*a* above and beneath the strip line resonator electrode, the interstage coupling capacity can be increased even in the same electrode area, and the range of realizing the filter design parameters may be wider, so that filter characteristics in various specifications may be realized.

Moreover, since the electrode patterns of the input and output coupling capacity electrode, loading capacity electrode and interstage coupling capacity electrode are the same in both upper and lower layers, and hence the printing screen of the electrode pattern can be shared, and controlling the manufacturing process becomes easier.

Thus, according to the embodiment, the laminated dielectric filter of small size, low loss and easy to manufacture can be obtained.

EXAMPLE 11

Figure 30:
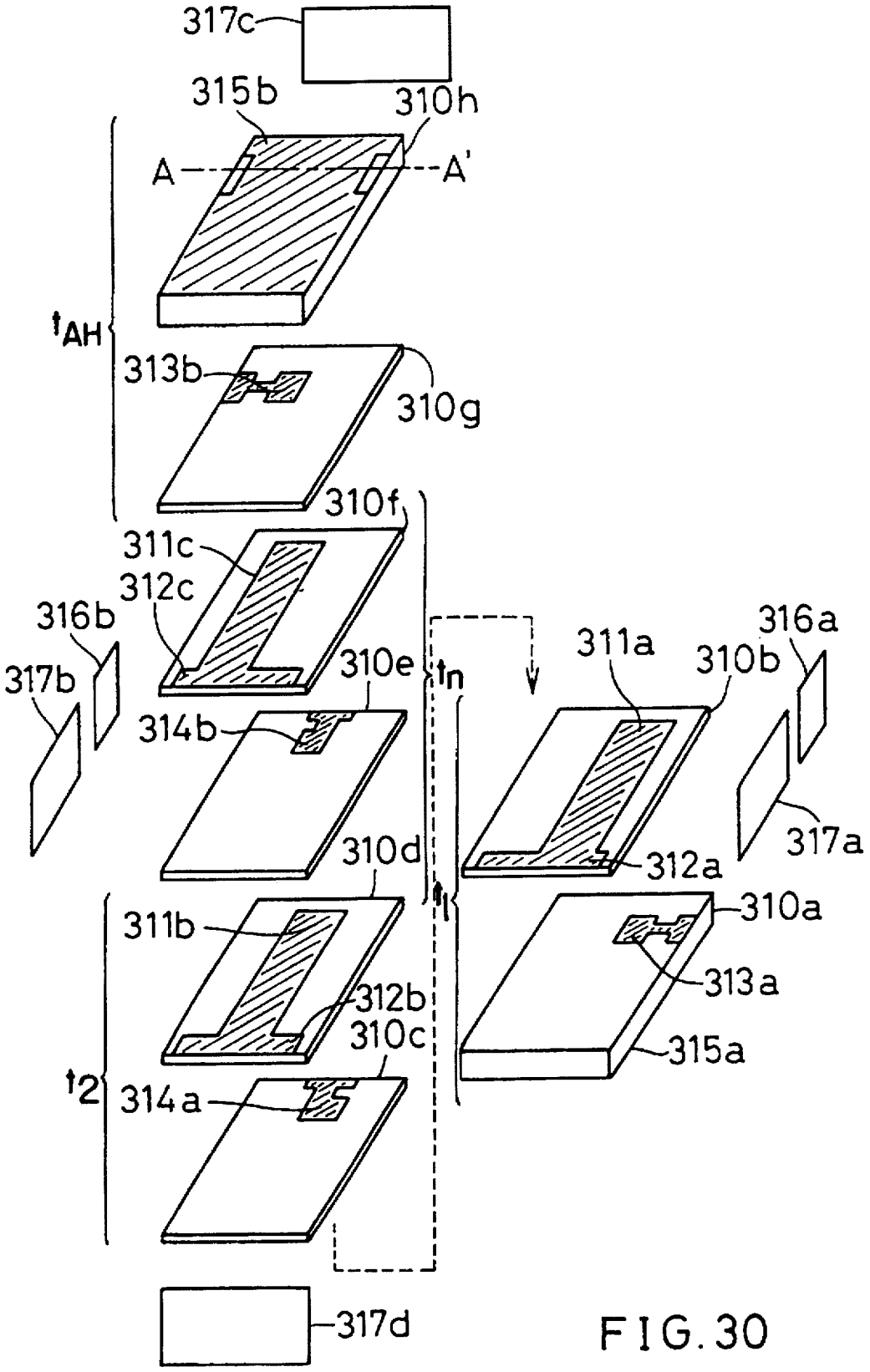
FIG. 30 is a perspective exploded view of a laminated dielectric filter in an eleventh embodiment of the invention.
Figure 31:
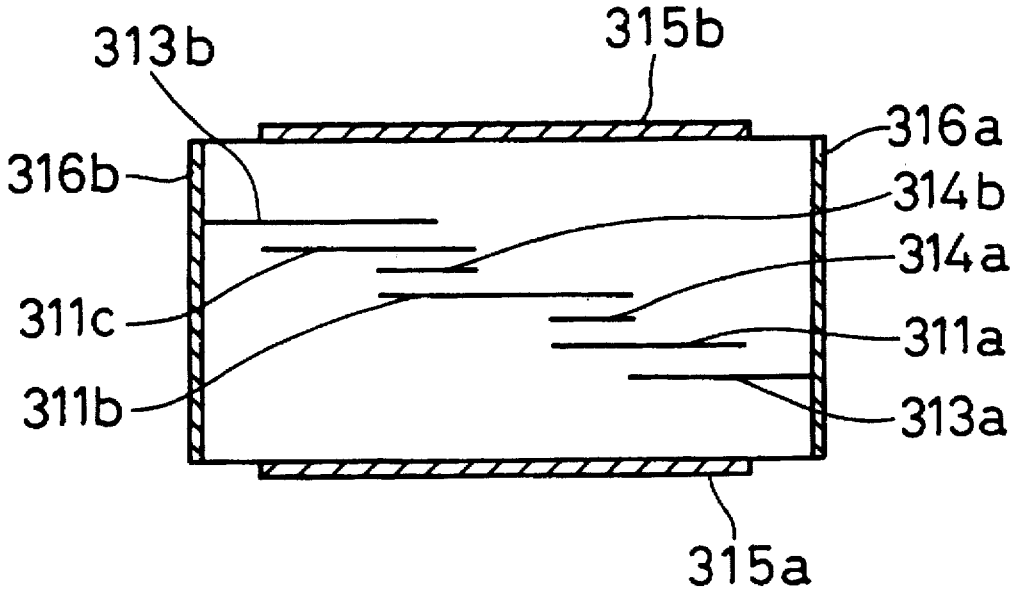
FIG. 31 is a sectional view of section A–A' of the laminated dielectric filter in the eleventh embodiment of the invention in FIG. 30.

A laminated dielectric filter in an eleventh embodiment of the invention is described below by reference to drawings. FIG. 30 is a perspective exploded view of the laminated dielectric filter in the eleventh embodiment of the invention. FIG. 31 is a sectional view of section A–A' in FIG. 30.

In FIG. 30, dielectric sheets 310*a*, 310*b*, 310*c*, 310*d*, 310*e*, 310*f*, 310*g*, 310*h* are made of low temperature baking dielectric ceramics, and as dielectric materials, for example, Bi—Ca—Nb—O ceramics with the dielectric constant of 58 and other ceramic materials that can be baked at 950 degrees C or less are used, and green sheets are formed. The inner electrodes for composing the strip line resonator electrodes 311*a*, 311*b*, 311*c*, input and output coupling capacity electrodes 313*a*, 313*b*, and loading capacity electrodes 314*a*, 314*b* are laminated with dielectric sheets and baked integrally, while printing with electrode patterns with metal paste of high electric conductivity such as silver, copper and gold. The outer electrodes of the shield electrodes 315*a*, 315*b*, side electrodes 316*a*, 316*b*, and 317*a*, 317*b*, 317*c*, 317*d* are baked later with metal paste in this embodiment.

The thicknesses $t_2, t_3, \ldots, t_n$ (n is the number of strip line resonators) of the dielectric sheet between the strip line resonator electrode layers, that is, the combined thickness of the dielectric sheets 310*c* and 310*d*, or the combined thickness of the dielectric sheets 310*e* and 310*f* is set differently from the thicknesses $t_1$, $t_{n+1}$ of the dielectric sheets between the strip line resonator electrode layer and shield electrode layer, that is, the combined thickness of the dielectric sheets 310*a* and 310*b*, or the combined thickness of the dielectric sheets 310*g* and 310*h*, and thereby a large coupling amount can be used without lowering the unloaded Q value of the resonator. More specifically, the maximum value of the thicknesses $t_2$ to $t_n$ is set smaller than either thickness $t_1$ or $t_{n+1}$, and preferably the total of thicknesses $t_2$ to $t_n$ is set smaller than either thickness $t_1$ or $t_{n+1}$. Moreover, when the number of strip line resonators is three or more, by equalizing all of thicknesses $t_2$ to $t_n$, the thickness of the dielectric sheet can be standardized to a specific value, so that the manufacturing cost can be lowered.

Furthermore, by forming the thick dielectric sheets 310a, 310h by laminating a plurality of thin dielectric sheets, all dielectric sheets can be formed of standardized same thin dielectric sheets, so that the manufacturing cost be further lowered.

The strip line resonator electrodes 311*a*, 311*b*, 311*c* are connected and grounded to the side electrode 317*d* of the grounding end grounding element through the grounding electrodes 312*a*, 312*b*, 312*c* at one end. The change in length of the broad grounding electrodes has a smaller effect on the resonance frequency, as compared with the change in length of the strip line resonator electrode, and therefore fluctuations of the resonance frequency due to variations in the precision of cutting off the dielectric sheet can be suppressed. Moreover, the side electrode 317*d* of the grounding end grounding terminal acts also as the shield electrode of the grounding side for shielding the side, the filter characteristic is hardly affected from outside.

In the embodiment, since the resonator is in laminate structure by aligning the direction of the short-circuit end, as the quarter wavelength end short-circuit type strip line resonator, it is therefore easy to design the same as in the comb-line filter, and a small-sized filter can be realized.

The parallel flat plate capacitor composed between the input and output coupling capacity electrode 313*a* and strip line resonator electrode 311*a*, and the parallel flat plate capacitor composed between the input and output coupling capacity electrode 313*b* and strip line resonator electrode 311*c* both function as input and output coupling capacitors. The individual input and output coupling capacity electrodes 313*a*, 313*b* are connected to the input and output terminals 316*a*, 316*b* formed of the side electrodes.

By coupling the strip line resonator and input and output terminals in capacity coupling system, the filter can be reduced in size in the magnetic field coupling system. In the capacity coupling system, calculation of coupling amount is easy, and the input and output coupling amount can be adjusted only by varying the electrode pattern area, so that it is easy to design.

By setting the take-out direction of the input and output terminals 316*a*, 316*b* in the right side direction of the strip line in one and in the left side direction of the strip line in the other, the input and output terminals can be isolated.

The parallel flat plate capacitor composed between the loading capacity electrodes 314*a*, 314*b*, and strip line resonator electrodes 311*a*, 311*b*, 311*c* function as the parallel loading capacitor for lowering the resonance frequency of the strip line resonator. Therefore, the length of the strip line resonators 311*a*, 311*b*, 311*c* can be set shorter than the quarter wavelength, thereby making it possible to operate a comb-line filter.

In the region of the input and output coupling capacity electrodes 313*a*, 313*b* and the loading capacity electrodes 314*a*, 314*b* overlapping with the outer edge of the strip line resonator electrodes 311*a*, 311*b*, 311*c*, a dent is formed in the input and output coupling capacity electrodes and loading capacity electrodes, and the width of the electrodes is narrowed. By forming a narrow dent region, the change in the area of the overlapping region when position deviation of the strip line resonator electrode layer and capacity electrode layer can be set smaller as compared with the case without a dent.

Since the entire filter is shielded by the upper and lower shield electrodes 315*a*, 315*b* formed of the outer electrodes, change of filter characteristic by the external effects can be prevented. The shield electrode is connected and grounded at the side electrodes 317*a*, 317*b* of the side grounding terminal, and the side electrode 317*c* of the grounding terminal at the open end, aside from the side electrode 317*d* of the grounding terminal at the grounding end side. By grounding the side electrode as the grounding terminal, at the open end, grounding side, and side surface of the strip line resonator, the resonance of shield electrode is suppressed, thereby preventing deterioration of the filter characteristic.

Since the side electrodes 317*a*, 317*b* of the side grounding terminal function as side shield electrodes, the same as the side electrodes 317*c*, 317*d*, they have a shield effect to prevent the filter characteristic from being influenced by external effects.

The open end capacity generated between the side electrode 317*c* of the open end side grounding terminal and the strip line resonator electrodes 311*a*, 311*b*, 311*c* is inserted parallel to the loading capacity, and hence the line length of the strip line resonator can be further shortened.

Operation of the thus constituted laminated dielectric filter, the operation is described below. The electric operating principle of the filter in the embodiment is nearly same as the comb-line filter. The operating principle of the comb-line filter is disclosed in the cited literature (G. L. Matthaei, "Comb-Line Bandpass Filters of Narrow or Moderate Bandwidth"; the Microwave Journal, August 1963).

First, the strip line resonator electrodes 311*a*, 311*b*, 311*c* are arranged by aligning in the direction of the grounding end, and by mutually coupling in the electromagnetic field, they operate a comb-line filter. The electromagnetic field coupling amount among the strip lines is adjusted by shifting the position of the center line of the strip line in every laminate sheet laminated up and down. Therefore, the adjustment of the coupling amount is very easy. The coupling amount is the largest when the positions of the center lines of the strip lines are matched.

In the conventional invention of arranging the strip lines laterally on a same plane, the gap between lines is about 200 μm at minimum due to limitations of the printing precision, and there was a limitation in the magnitude of the coupling amount. However, in the embodiment of overlapping the strip lines up and down in the innovation, the thickness of the dielectric sheets 310*d*, 310*f* between the strip lines may be set as thin as 20 μm, so that a very large coupling amount may be realized. In addition, since the two strip line resonator electrodes contact over a wide area, the coupling amount is further increased.

Since the electromagnetic field coupling between the strip lines is zero at a frequency corresponding to one quarter of the wavelength, the band pass filter cannot be composed in this state, but by shifting the resonance frequency by the loading capacity composed of the loading capacity electrodes 314*a*, 314*b*, and strip line resonator electrodes 311*a*, 311*b*, 311*c*, the required interstage coupling amount is obtained. In this embodiment, incidentally, by forming a capacity in both upper and lower directions of one loading capacity electrode, the number of loading capacity electrode layers is decreased, so that it is easy to manufacture.

The input and output coupling is effected by electric field coupling of the input and output terminals and strip lines by the input and output coupling capacity electrodes 313*a*, 313*b*. The input and output coupling capacity forms a part of the admittance inverter. The capacity coupling embodiment is advantageous because it can be realized easily in a small size since the coupling embodiment of the band pass filters a relatively narrow band.

Furthermore, in the embodiment of arranging the strip lines in the lateral direction, since the high frequency current is concentrated in the edge of the line, and the unloaded Q is lowered. However, in the embodiment of overlapping the strip lines up and down of the invention, the high frequency current is distributed relatively uniformly over the entire width of the line, so that a high unloaded Q value is realized. Hence, the insertion loss of the filter can be reduced.

Thus, according to the invention, possessing a filter characteristic of low loss, a planar laminated dielectric filter of small size and thin thickness can be realized.

EXAMPLE 12

Figure 32:
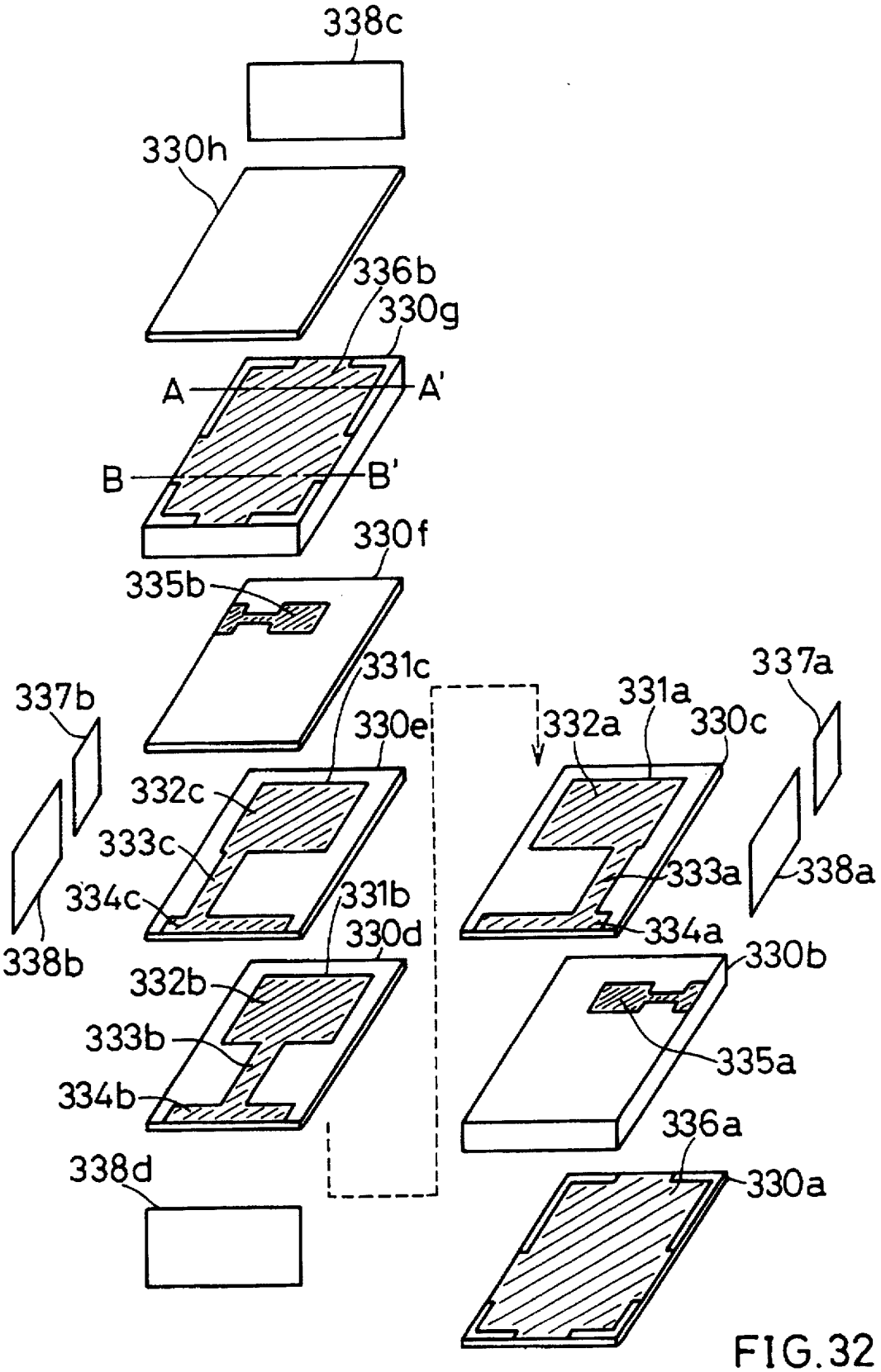
FIG. 32 is a perspective exploded view of a laminated dielectric filter in a twelfth embodiment of the invention.
Figure 33:
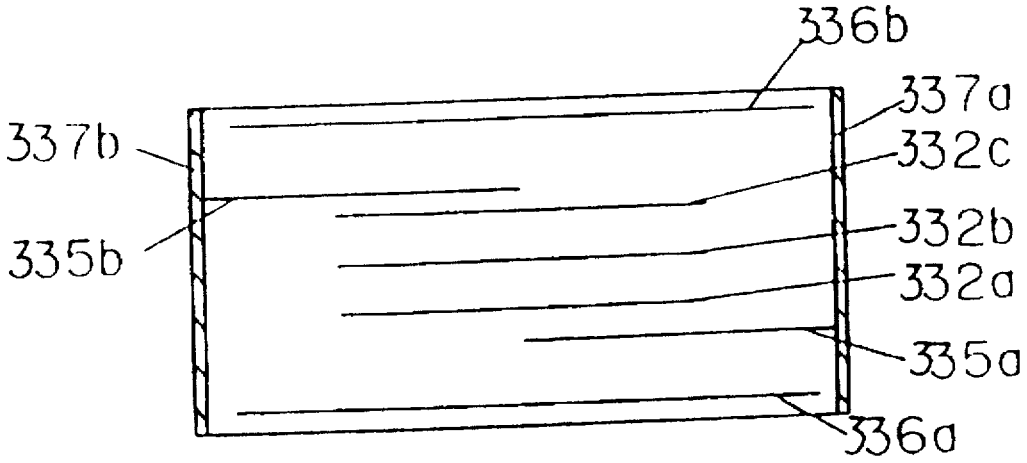
FIG. 33(*a*) is a sectional view of section A–A' of the laminated dielectric filter in the twelfth embodiment of the invention in FIG. 32, and FIG. 33(*b*) is a sectional view of section B–B'.
Figure 33:
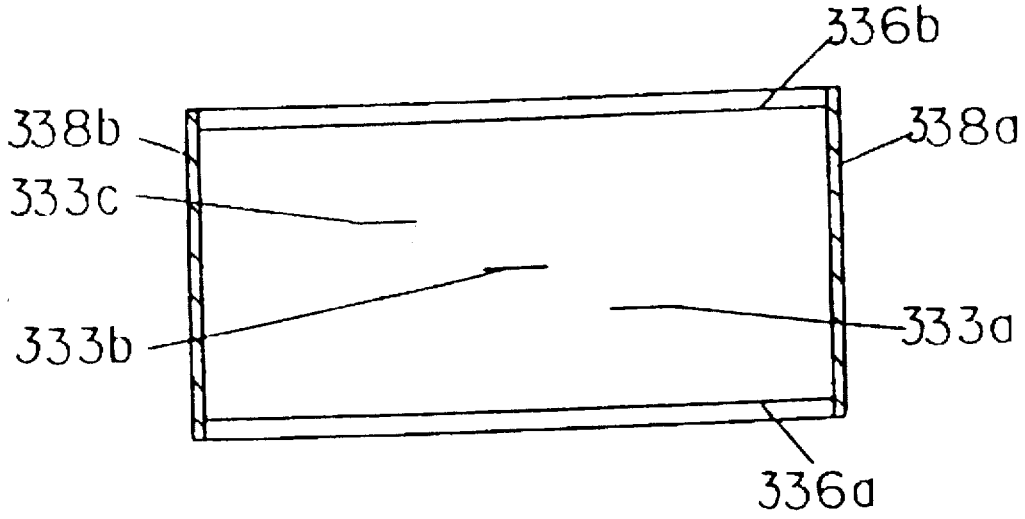

A laminated dielectric filter in a twelfth embodiment of the invention is described by reference to the drawings. FIG. 32 is a perspective exploded view of the laminated dielectric filter in the twelfth embodiment of the invention. FIG. 33(*a*) is a sectional view of section A–A' in FIG. 32, and FIG. 33(*b*) is a sectional view of section B–B'.

In FIG. 32, reference numerals 330*a*, 330*b*, 330*c*, 330*d*, 330*e*, 330*f*, 330*g*, 330*h* indicate dielectric sheets. Reference numerals 331*a*, 331*b*, 331*c* are strip line resonator electrodes, 335*a*, 335*b* are input and output coupling capacity electrodes, and 336*a*, 336*b* indicate shield electrodes, being formed of inner electrodes laminated on the dielectric sheets.

In the twelfth embodiment, which is different from the eleventh embodiment, the shield electrodes are formed of inner electrodes. In this embodiment, the shield electrodes can be formed in the same embodiment as in strip line resonator electrodes and capacity electrodes, and are hence easy to manufacture. Since the entire filter is shielded by the upper and lower shield electrodes 336*a*, 336*b* formed of inner electrodes, thereby preventing the filter characteristic from changing due to external effects same as in the eleventh embodiment.

Side electrodes 337*a*, 337*b* as input and output terminals, and side electrodes 338*a*, 338*b*, 338*c*, 338*d* are formed of external electrodes baked after applying metal paste.

Aside from the side electrode 338*d* of the grounding terminal at the grounding end side, the shield electrodes are connected and grounded to the side electrodes 338*a*, 338*b* of the side grounding terminals and the side electrode 338c of the grounding terminal of the open end side. By grounding the side electrodes which become grounding terminals, at both open end and grounding end sides of the strip line resonator, resonance of the shield electrode is suppressed, and deterioration of filter characteristic is prevented.

The strip line resonator electrodes 331*a*, 331*b*, 331*c* consist of grounding end side narrow parts 333*a*, 333*b*, 333*c* narrowed in the line width at the grounding end side, and open end side broad parts 332*a*, 332*b*, 332*c* broadened in the line width at the open end side. The grounding ends of the strip line resonator electrodes 331*a*, 331*b*, 331*c* are connected and grounded to the side electrode 338*d* of the grounding end side grounding terminal through the grounding electrodes 334*a*, 334*b*, 334*c*.

A parallel flat plate capacitor composed between the input and output coupling capacity electrode 335*a* and strip line resonator electrode 331*a*, and a parallel flat plate capacitor composed between the input and output coupling capacity electrode 335*b* and strip line resonator electrode 331*c* both function as input and output coupling capacitors. The input and output coupling capacity electrodes 335*a*, 335*b* are connected to input and output terminals 337*a*, 337*b* formed of side electrodes.

In this embodiment, as in the eleventh embodiment, the thicknesses $t_2$, $t_3$, . . . , (n is the number of strip line resonators) of the dielectric sheets between the strip line resonator electrode layers, or the thicknesses of the dielectric sheets 330*d*, 330*e* are set smaller than the thicknesses $t_1$, $t_{n+1}$ of the dielectric sheets between the strip line resonator electrode layer and shield electrode layer, that is, the total thickness of the dielectric sheets 330*b* and 330*c*, or the total thickness of the dielectric sheets 330*f* and 330*g*, so that a great coupling amount is obtained without lowering the unloaded Q value of the resonator. For example, in one production, the thickness of dielectric sheets 330*b*, 330*g* is 500 μm, the thickness of dielectric sheets 330*c*, 330*f* is 55 μm, and the thickness of dielectric sheets 330*d*, 330*e* is 44 μm, and a favorable filter characteristic could be obtained at this time. That is, supposing the maximum value of thicknesses $t_2, t_3, \ldots, t_n$ to be $t_{max}$ it is desired that $t_{max}$ be smaller than either $t_1$ or $t_{n+1}$. More preferably, the total of thicknesses $t_2, t_3, \ldots, t_n$ should be smaller than the total of $t_1$ and $t_{n+1}$. Further preferably, the total of thicknesses $t_2$, $t_3$, . . . , tn should be smaller than either thickness $t_1$ or $t_{n+1}$. In such conditions, the coupling degree necessary for filter design and the high unloaded Q value could be obtained at the same time.

Moreover, by forming thick dielectric sheets 330*b*, 330*g* by laminating a plurality of thin dielectric sheets, and equalizing the thickness of all dielectric sheets 330*d*, 330*e* between strip line resonators, all dielectric sheets can be formed by thin dielectric sheets of standardized thickness, so that the manufacturing cost can be reduced.

Operation of the thus constituted laminated dielectric filter, the operation is described below. The electric operating principle of the filter in this embodiment is slightly different from the principle of the filter in the eleventh embodiment. That is, in the eleventh embodiment, the operating principle is basically the comb-line filter. In the twelfth embodiment, however, by using the SIR (stepped impedance resonator) structure instead of loading capacity, the electromagnetic field coupling amounts of the first transmission lines and second transmission lines are set independently, and a passing band and an attenuation pole are generated in the transmission characteristic. This basic constitution is the same as in the laminated dielectric filter of the first embodiment.

First, the strip line resonator electrodes 331*a*, 331*b*, 331*c* are arranged by aligning the direction of the grounding ends, and the open end side broad parts 332*a*, 332*b*, 332*c* and the grounding end side narrow parts 333*a*, 333*b*, 333*c* are respectively coupled electromagnetically. Each strip line constitutes the SIR structure with the broad parts and narrow parts. Therefore, the length of the strip line resonators 331*a*, 331*b*, 331*c* can be shorter than the quarter wavelength.

The electromagnetic field coupling amount between the strip lines is adjusted by shifting the position of the strip line in the vertical direction. By deviating the line center line of the broad parts and narrow parts of the strip lines from the same line, the electromagnetic field coupling amount of the broad parts and the electromagnetic field coupling amount of the narrow parts of the strip lines can be set independently. By independently setting the coupling amounts in this way only, it is possible to design to form an attenuation pole at a desired frequency. This operating principle has been explained in the filter of the first embodiment.

By setting all at the same position, with the dielectric sheets laminating vertically the line center lines of the broad parts of the strip lines, the maximum coupling amount can be realized in the broad parts. Furthermore, since the vertical positions of the electrodes are aligned, the filter width can be minimized, so that the filter size can be reduced. On the other hand, the coupling amount of the narrow parts can be adjusted by shifting the position of the line center line by every dielectric sheet.

In this way, by electromagnetic field coupling of the open end side broad parts and grounding end side narrow parts, independently, not only the band pass characteristic is shown in the passing band, but also an attenuation pole can be formed at a desired frequency of transmission characteristic. Therefore, a selectivity characteristic superior to the Chebyshev characteristic can be realized.

Thus, according to the embodiment, aside from the same effects as in the first embodiment and eleventh embodiment, their combined effects are brought about, and an attenuation pole can be formed at a desired frequency of transmission characteristic, and excellent selectivity characteristic is achieved. Thus a filter characteristic of small size and low loss is achieved.

EXAMPLE 13

Figure 34:
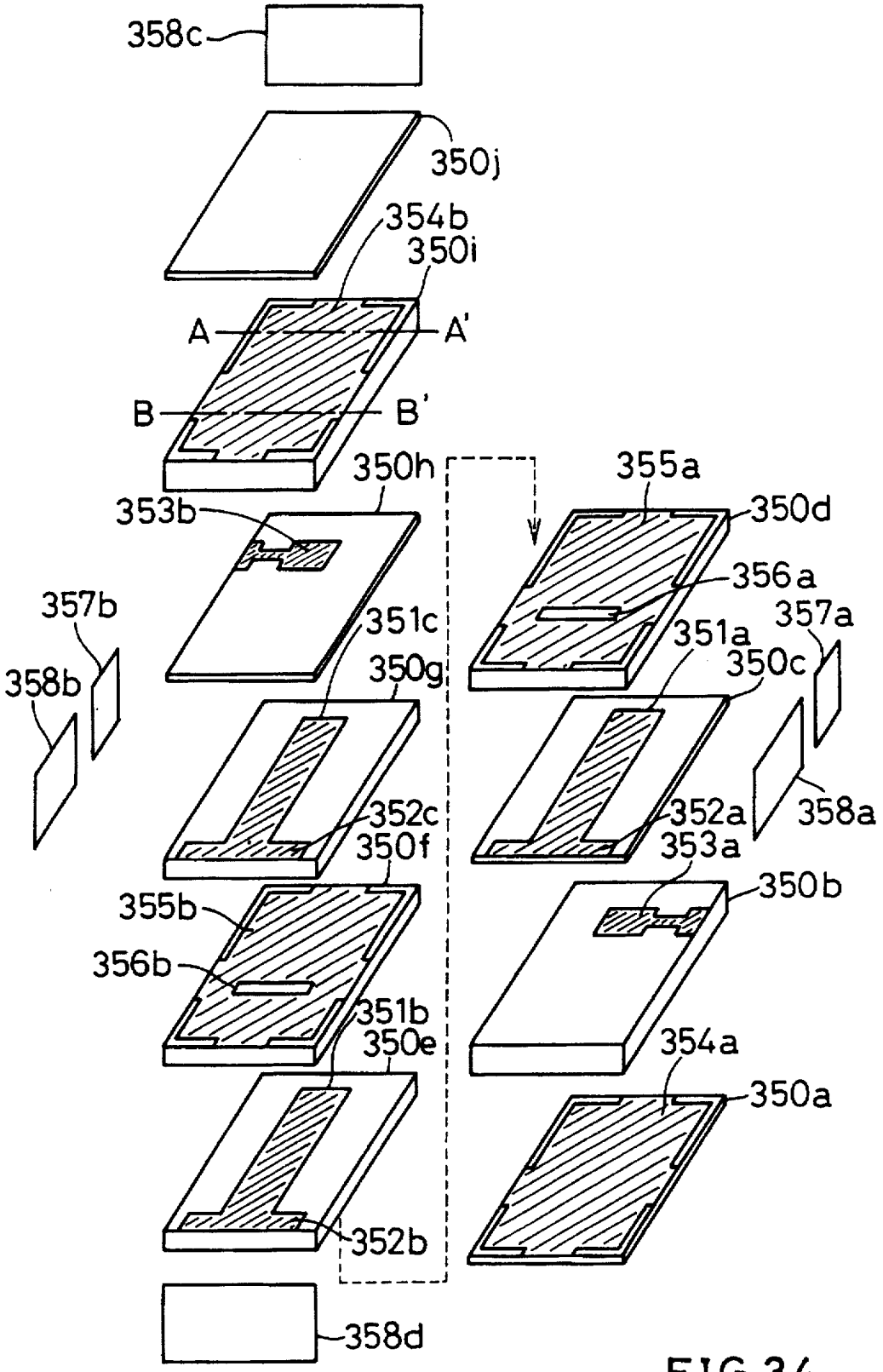
FIG. 34 is a perspective exploded view of a laminated dielectric filter in a thirteenth embodiment of the invention.
Figure 35:
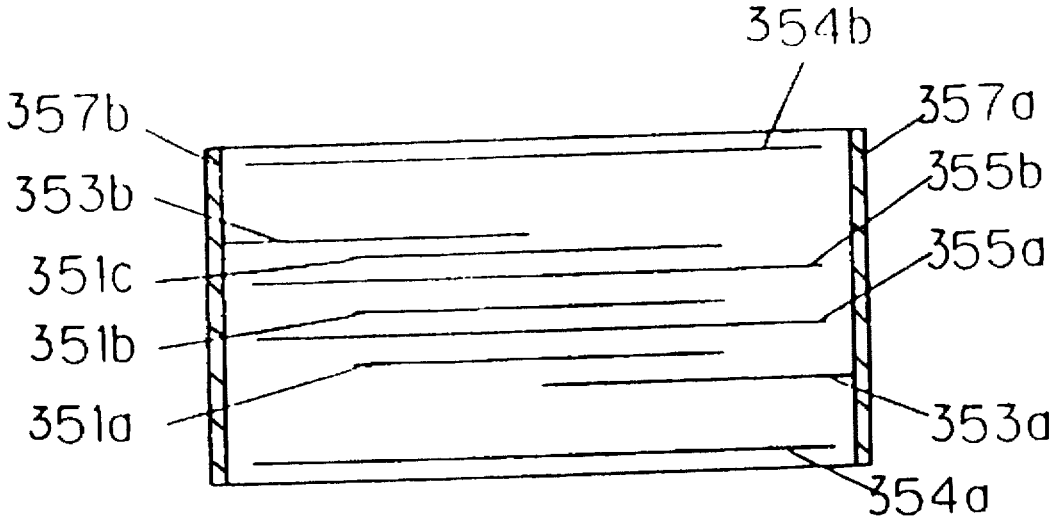
FIG. 35(*a*) is a sectional view of section A–A' of the laminated dielectric filter in the thirteenth embodiment of the invention in FIG. 34, and FIG. 35(*b*) is a sectional view of section B–B'.
Figure 35:
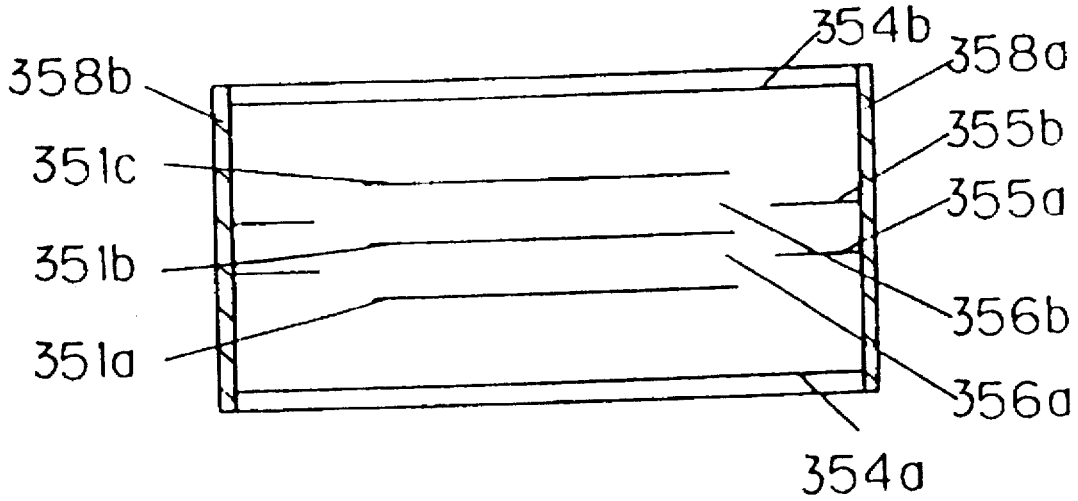

A laminated dielectric filter in a thirteenth embodiment of the invention is described below by referring to the accompanying drawings. FIG. 34 is a perspective exploded view of the laminated dielectric filter in the thirteenth embodiment of the invention. FIG. 35(*a*) is a sectional view of section A–A' in FIG. 34, and FIG. 35(*b*) is a sectional view of section B–B'.

In FIG. 34, reference numerals 350*a*, 350*b*, 350*c*, 350*d*, 350*e*, 350*f*, 350*g*, 350*h*, 350*i*, 350*j* indicate dielectric sheets. Reference numerals 351*a*, 351*b*, 351*c* are strip line resonator electrodes, 353*a*, 353*b* are input and output coupling capacity electrodes, 354*a*, 354*b* are shield electrodes, and 355*a*, 355*b* are coupling shield electrodes, which are formed of inner electrodes laminated on the dielectric sheets. Side electrodes 357*a*, 357*b* as input and output terminals, and side electrodes 358*a*, 358*b*, 358*c*, 358*d* as grounding terminals are formed of outer electrodes baked after application of metal paste.

The shield electrodes are connected and grounded to the side electrodes 358*a*, 358*b* of the side grounding terminals and side electrode 385*c* of grounding terminal of open end side, aside from the side electrode 358*d* of grounding terminal at grounding end side. The grounding ends of strip line resonator electrodes 351*a*, 351*b*, 351*c* are connected and grounded to the side electrode 358*d* of the grounding terminal at the grounding end side through grounding electrodes 352*a*, 352*b*, 352*c*.

A parallel flat plate capacitor composed between the input and output coupling capacity electrode 353*a* and strip line resonator electrode 351*a*, and a parallel flat plate capacitor composed between the input and output coupling capacitor composed between the input and output coupling capacity electrode 353*b* and strip line resonator electrode 351*c* both function as input and output coupling capacitors. The input and output coupling capacity electrodes 353*a*, 353*b* are connected to input and output terminals 357*a*, 357*b* formed of side electrodes.

In the thirteenth embodiment, different from the eleventh and twelfth embodiments, the coupling amount between the strip line resonators is controlled the electric field coupling windows or the magnetic field coupling windows 356*a*, 356*b* formed in the coupling shield electrodes 355*a*, 3356*b*. Depending on the size, shape and position of the coupling window, it is easy to control from a large coupling amount to a small coupling amount, so that a filter characteristic in a broad range from wide band to narrow band is realized. By capacity coupling for input and output coupling, the design is easy, and the filter size can be reduced.

Thus, according to the embodiment, aside from the effects of the eleventh and twelfth embodiments, a filter characteristic in a broad range from wide band to narrow band can be attained by a simple design.

EXAMPLE 14

Figure 36:
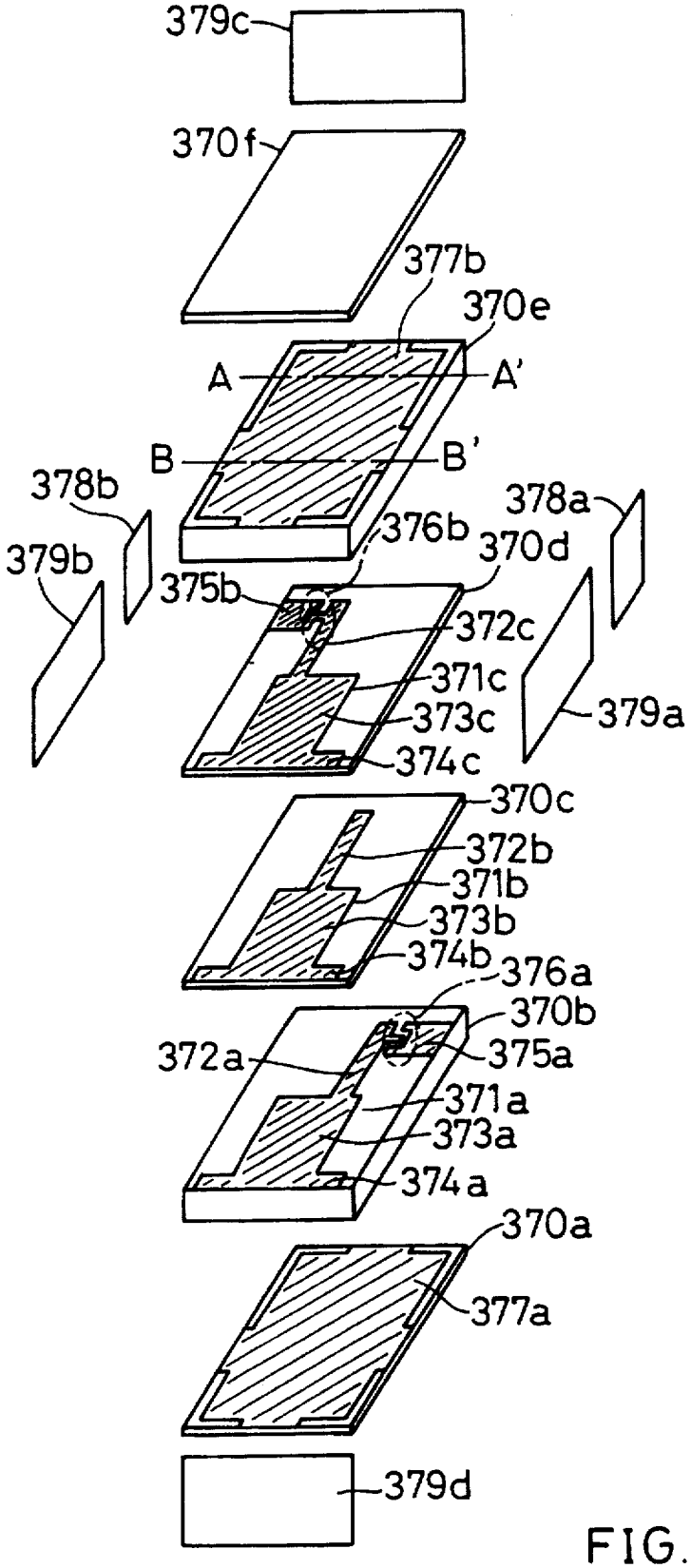
FIG. 36 is a perspective exploded view of a laminated dielectric filter in a fourteenth embodiment of the invention.
Figure 37:
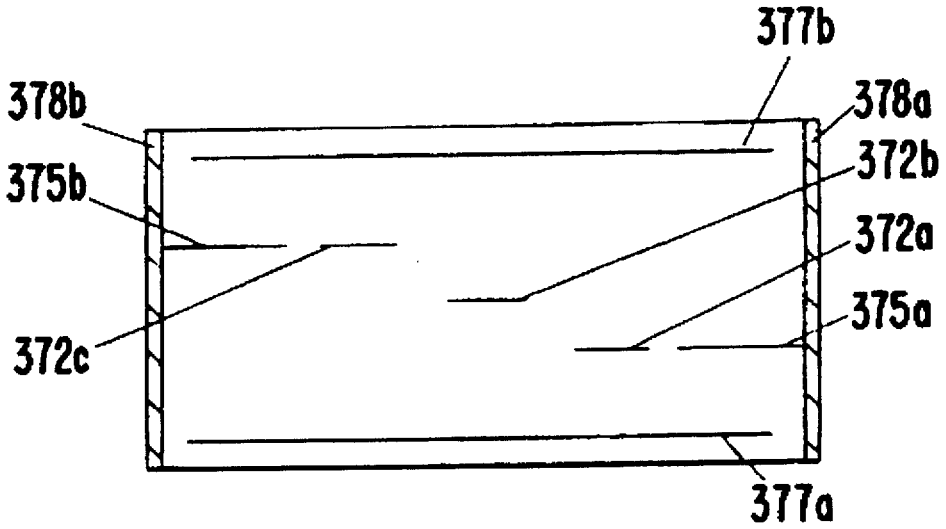
FIG. 37(*a*) is a sectional view of section A–A' of the laminated dielectric filter in the fourteenth embodiment of the invention in FIG. 36, and FIG. 37(*b*) is a sectional view of section B–B'.
Figure 37:
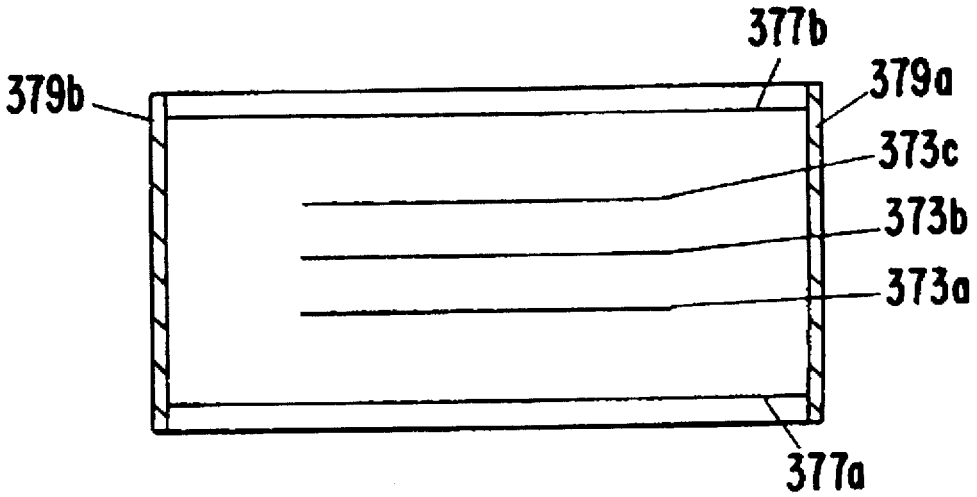

A laminated dielectric filter in a fourteenth embodiment of the invention is described below while referring to the drawings. FIG. 36 is a perspective exploded view of the laminated dielectric filter in the fourteenth embodiment of the invention. FIG. 37(*a*) is a sectional view of section A–A' in FIG. 36, and FIG. 37(*b*) is a sectional view of section B–B'.

In FIG. 36, reference numerals 370*a*, 370*b*, 370*c*, 370*d*, 370*e*, 370*f* are dielectric sheets. Reference numerals 371*a*, 371*b*, 371*c* are strip line resonator electrodes, 375*a*, 375*b* are input and output coupling capacity electrodes, and 377*a*, 377*b* are shield electrodes, which are formed of inner electrodes laminated on dielectric sheets.

Side electrodes 378*a*, 378*b* as input and output terminals, and side electrodes 379*a*, 379*b*, 379*c*, 379*d* as grounding terminals are formed of outer electrodes by baking metal paste afterwards. Shield electrodes are connected and grounded to the side electrodes 379*a*, 379*b* of the side grounding terminals and the side electrode 379*c* of the grounding terminal at the open end side, aside from the side electrodes 379*d* of the grounding terminal at the grounding end side.

The strip line resonator electrodes 371*a*, 371*b*, 371*c* consist of grounding end side broad parts 373*a*, 373*b*, 373*c* widened in the line width at the grounding end side, and open end side narrow parts 372*a*, 372*b*, 372*c* narrowed in the line width at the open end side. The grounding ends of the strip line resonator electrodes 371*a*, 371*b*, 371*c* are connected and grounded to the side electrode 79*d* of the grounding terminal at the grounding end side, through the grounding electrodes 374*a*, 374*b*, 374*c*. In the fourteenth embodiment, the broad parts come to the grounding end side of the strip line resonator, which is opposite to the constitution of the twelfth embodiment.

By shifting the line center lines of the grounding end side broad parts and line center lines of open end side narrow parts of each strip line, without aligning on the same line, in this embodiment, too, same as in the twelfth embodiment, the electromagnetic field coupling amount of the broad parts and narrow parts of the strip line resonator can be controlled independently. Therefore, an attenuation pole can be formed at a desired frequency of transmission characteristic of the filter, and an excellent selectivity is obtained.

Additionally, by forming broad parts at the grounding end side of the strip line resonator, the resistance loss of the high frequency current flowing in the strip line can be reduced, and hence the unloaded Q can be improved. Furthermore, by setting the line center lines of the broad parts of the strip lines all at the same position on the dielectric sheets laminated vertically, a maximum coupling amount can be realized in the broad parts. Since the vertical positions of the electrodes are aligned, the width of the filter can be minimized, so that the filter can be reduced in size.

An inter-digital type capacitor 376*a* composed between the input and output coupling capacity electrode 375*a* and strip line resonator electrode 371*a*, and an inter-digital type capacitor 376*b* composed between the input and output coupling capacity electrode 375*b* and strip line resonator electrode 371*c* both function as input and output coupling capacitors. The input and output coupling capacity electrodes 375*a*, 375*b* are connected to input and output terminals 378*a*, 378*b* formed of side electrodes. By composing the input and output coupling capacity by interdigital type capacitor, a large coupling capacity is obtained, and a band pass filter characteristic of wide band is realized.

Thus, according to the embodiment, aside from the same effects as in the eleventh through thirteenth embodiments of obtaining a laminated dielectric filter of low loss, small size, and thin and flat structure, the number of dielectric sheets and the number of times of electrode printing can be decreased, and the manufacturing is easier.

EXAMPLE 15

Figure 38:
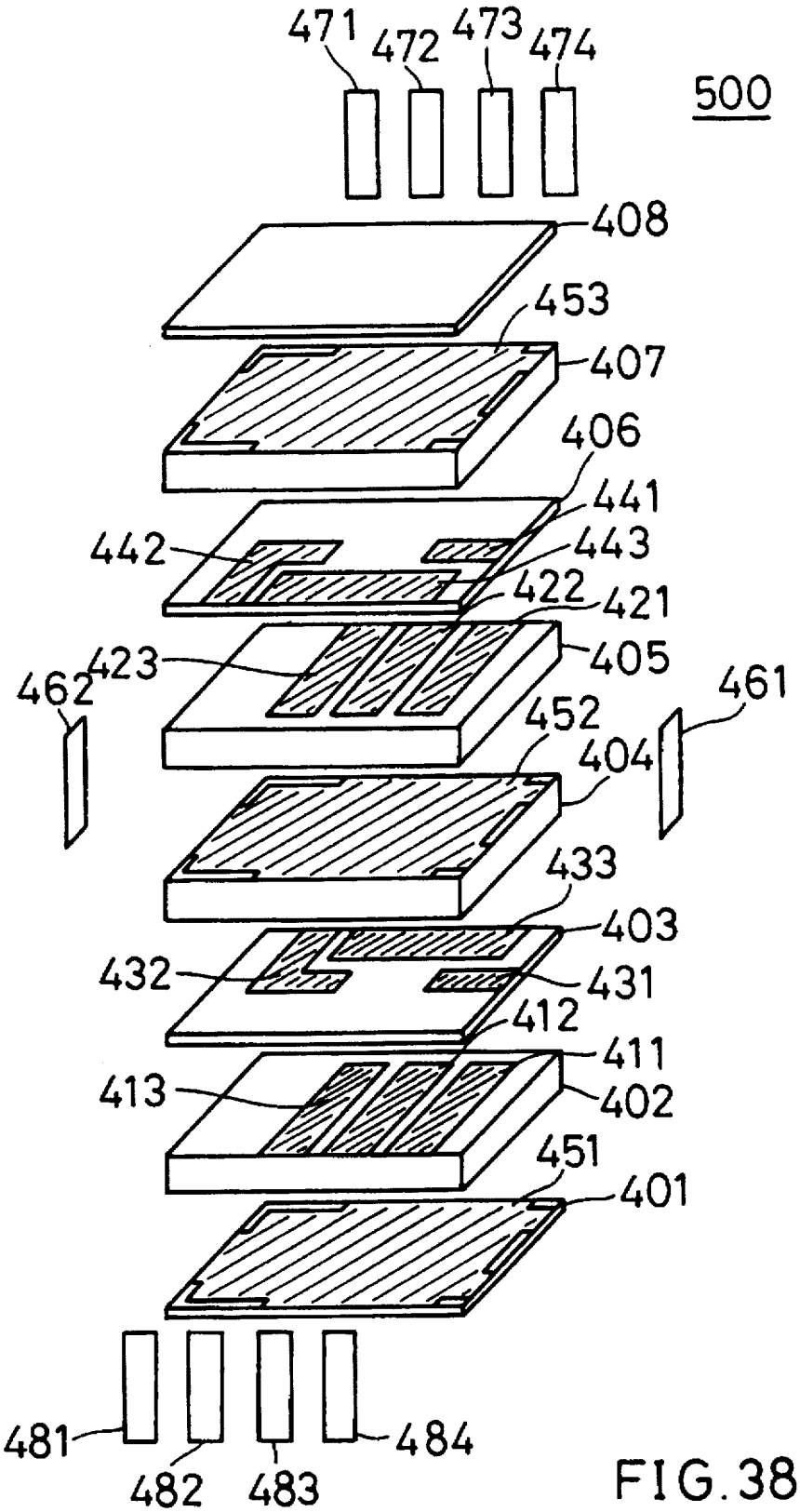
FIG. 38 is a perspective exploded view of a laminated dielectric antenna duplexer in a fifteenth embodiment of the invention.

A laminated dielectric antenna duplexer in a fifteenth embodiment of the invention is described with reference to drawings. FIG. 38 is a perspective exploded view of a laminated dielectric antenna duplexer 500 in the fifteenth embodiment of the invention. In FIG. 38, reference numerals 401 through 408 are dielectric sheets, 411 to 413 and 421 to 423 are strip line resonator electrodes, 431, 432 and 441, 442 are coupling capacitor electrodes, 433 and 443 are loading capacitor electrodes, 451 to 453 are shield electrodes, 461 is an antenna terminal electrode, 471 is a transmission terminal electrode, 481 is a reception terminal electrode, and 462 and 472 to 474, and 482 to 484 are grounding terminal electrodes. The dielectric sheets and electrode layers are laminated in the sequence shown in FIG. 38, and are baked integrally.

Figure 39:
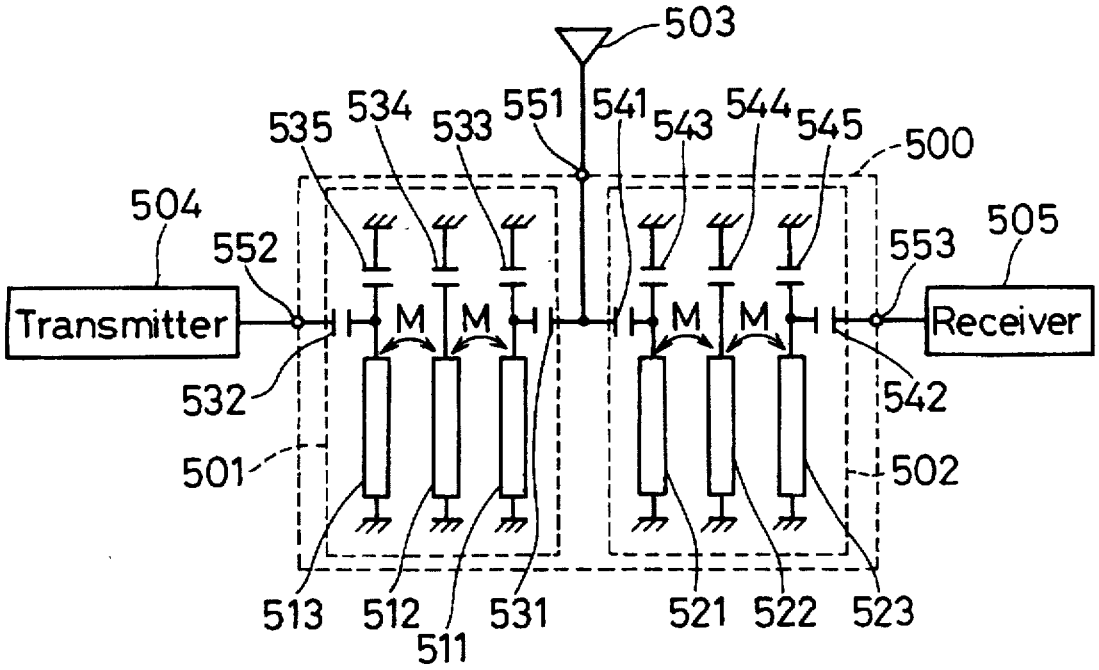
FIG. 39 is an equivalent circuit diagram of the laminated dielectric antenna duplexer in the fifteenth embodiment of the invention.

FIG. 39 is an equivalent circuit diagram of the laminated dielectric antenna duplexer 500 in the fifteenth embodiment of the invention. In thus constituted laminated dielectric antenna duplexer, the operation is described below while referring to FIG. 38 and FIG. 39.

The strip line resonators 511, 512,513 composed of the strip line resonator electrodes 411, 412, 413 are resonators composed of front end short-circuit transmission lines shorter than the quarter wavelength, and are formed closely to each other on a dielectric sheet 402. The strip line resonators are lowered in resonance frequency by loading capacitor 533, 534, 535 formed between the loading capacitor electrode 433 and strip line resonator electrodes 411, 412, 413, while the adjacent strip line resonators are mutually coupled in electromagnetic field, and a band pass characteristic is shown. A coupling capacitor 531 is formed between the coupling electrode 431 and strip line resonator electrode 411, and is electrically connected to an antenna 503 through an antenna terminal 551. Likewise, between the coupling electrode 432 and strip line resonator electrode 413, a coupling capacitor 532 is formed, and is electrically connected to a transmitter 504 through a transmission terminal 552. In this way, a comb-line type transmission filter 501 having a band pass characteristic is formed.

On the other hand, strip line resonators 521, 522, 523 composed of strip line resonator electrodes 421, 422, 423 are resonators composed of front end short-circuit transmission lines shorter than the quarter wavelength, and are formed closely to each other on a dielectric sheet 405. The strip line resonators are lowered in resonance frequency by loading capacitor 543, 544, 545 formed between the loading capacitor electrode 443 and strip line resonator electrodes 421, 422, 423, while the adjacent strip line resonators are mutually coupled in electromagnetic field, and a band pass characteristic is shown. A coupling capacitor 541 is formed between the coupling electrode 441 and strip line resonator electrode 421, and is electrically connected to the antenna 503 through the antenna terminal 551. Likewise, between the coupling electrode 442 and strip line resonator electrode 423, a coupling capacitor 542 is formed, and is electrically connected to a receiver 505 through a reception terminal 553. In this way, a comb-line type reception filter 502 having a band pass characteristic is formed.

The capacity coupling embodiment through coupling capacitors 531, 532, and 541, 542 does not require a coupling line as compared with the magnetic field coupling embodiment generally employed in the comb-line filter, so that both transmission filter and reception filter can be reduced in size.

One end of the transmission filter 501 is connected to the transmission terminal 552 electrically connected with the transmitter 504, and the other end of the transmission filter 501 is connected to one end of the reception filter 502, and is also connected to the antenna terminal 551 electrically connected to the antenna 503. The other end of the reception filter 502 is connected to the reception terminal 553 electrically connected to the receiver 505.

The transmission filter 501 shows a small insertion loss to the transmission signal in the transmission frequency band which is a passing band, so that the transmission signal can be transmitted from the transmission terminal 552 to the antenna terminal 551 without being attenuated practically. The reception signal in the reception frequency band shows a large insertion loss, and the input signal in the reception frequency band is reflected almost completely, and therefore the reception signal entered from the antenna terminal 551 returns to the reception filter 502.

The reception filter 502 shows a small insertion loss to the reception signal in the reception frequency band, and the reception signal can be transmitted from the antenna terminal 551 to the reception terminal 553 without being attenuated practically. The transmission signal in the transmission frequency band shows a large insertion loss, and the input signal in the transmission frequency band is reflected almost completely, and therefore the transmission signal coming from the transmission filter 501 is sent out to the antenna terminal 551.

In the fifteenth embodiment shown in FIG. 38, the direction of the short-circuit ends of the strip line resonator electrodes 411, 412, 413 for composing the transmission filter 501, and the direction of the short-circuit ends of the strip line resonator electrodes 421, 422, 423 for composing the reception filter 502 are mutually opposite directions. Accordingly, when the take-out directions of the coupling electrodes 431 and 441 for composing the coupling capacitors 531 and 541 connected to the antenna terminal 551 are set in the same side direction, the take-out direction of the coupling electrode 432 for composing the coupling capacitor 532 connected to the transmission terminal 552, and the take-out direction of the coupling electrode 442 for composing the coupling capacitor 542 to be connected to the reception terminal 553 may be set on the side of the opposite direction. Therefore, the distance between the transmission terminal electrode 471 and the reception terminal electrode 481 can be extended, so that sufficient isolation may be maintained between the transmission terminal and reception terminal.

The construction in the prior art by merely adhering up and down the transmission filter block and reception filter block of the antenna duplexer is compared with the laminated dielectric antenna duplexer conforming to the constitution of the invention.

First, in the prior art, the height of the transmission filter block and the reception filter block is about 2 mm at minimum due to the limit of fine processing of coaxial forming of the ceramic. Therefore, when placed up and down, the total height exceeds 4 mm. In the constitution of the invention, by contrast, the thickness of each dielectric sheet is about 30 μm, and the total height can be easily kept within 2 mm.

In the conventional example, for taking out and connecting the terminals, it is required to lay around outside of the filter block by using external parts, and a shield case for shielding the entire structure is needed, but in the constitution of the invention, for terminal connection, patterns of inner layer electrodes are connected to the side electrodes, and the entire structure can be shielded to compose a surface mounted device (SMD).

In the constitution of the invention, input and output coupling elements are composed in inner layer electrode patterns, and external parts are not needed.

Thus, according to the embodiment, comprising a plurality of dielectric sheets, at least three layers of shield electrode layers, and at least two layers of strip line resonator electrode layers, the structure is divided into a top and bottom by at least one layer of shield electrode layer. The dielectric sheets, shield electrode layers, and strip line resonator electrode layers are laminated and baked into one body to form the reception filter and transmission filter, the reception filter and transmission filter are laminated in upper and lower layers, and therefore a small and thin antenna duplexer of low cost is realized.

The side of forming the short-circuit end of the front end short-circuit strip line resonator coupled with the reception terminal in the strip line resonator electrode layers for composing the reception filter, and the side for forming the short-circuit end of the front end short-circuit strip line resonator coupled with the transmission terminal in the strip line resonator electrode layers for composing the transmission filter are set in different directions, and the transmission terminal and reception terminal are formed of side electrodes of different sides, so that a sufficient isolation is kept between the transmission terminal and reception terminal.

In the embodiment, the reception filter is laminated on the transmission filter, but, to the contrary, the transmission filter may be laminated on the reception filter, which is similarly applied to the succeeding embodiments.

EXAMPLE 16

Figure 40:
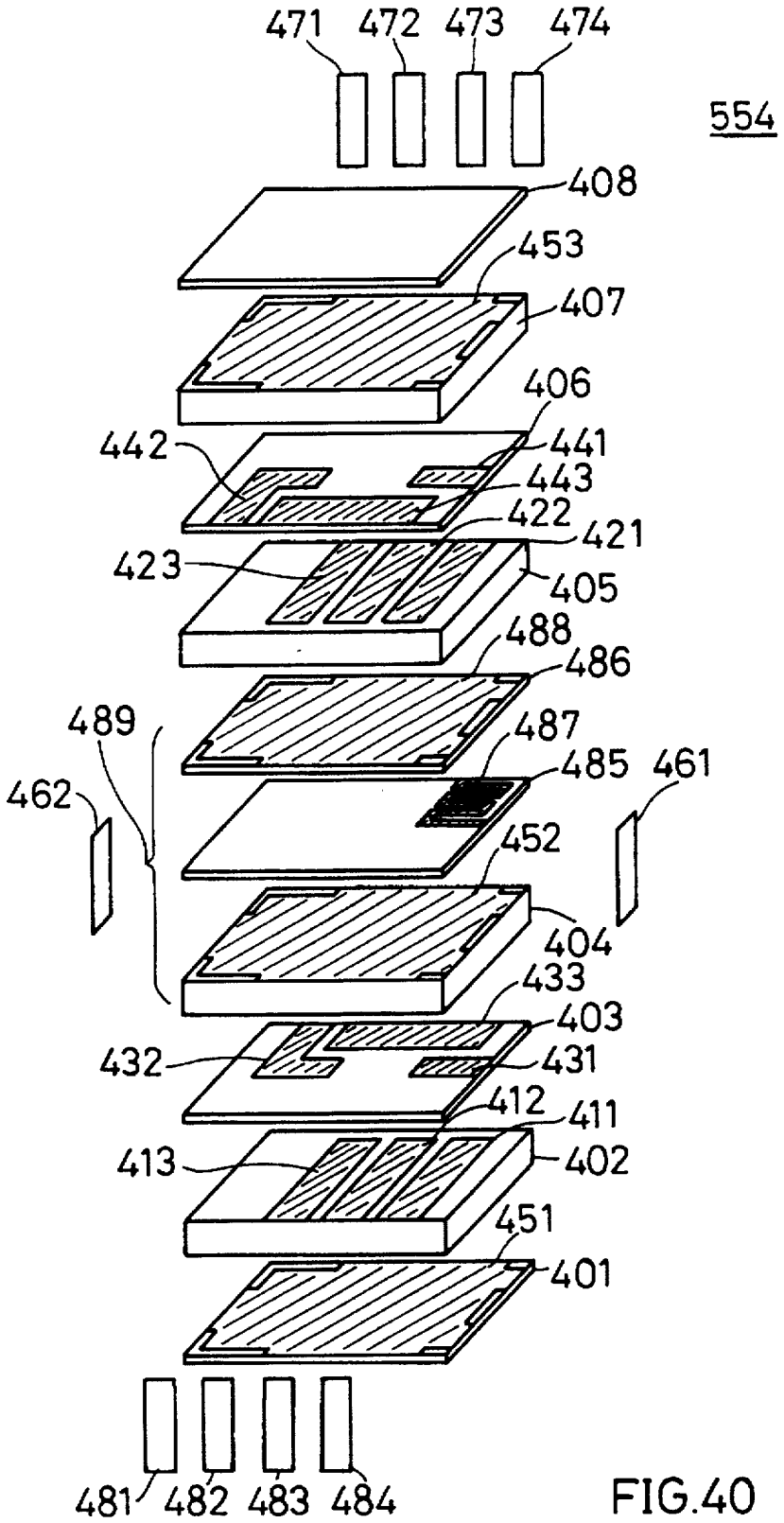
FIG. 40 is a perspective exploded view of a laminated dielectric antenna duplexer in a sixteenth embodiment of the invention.
Figure 41:
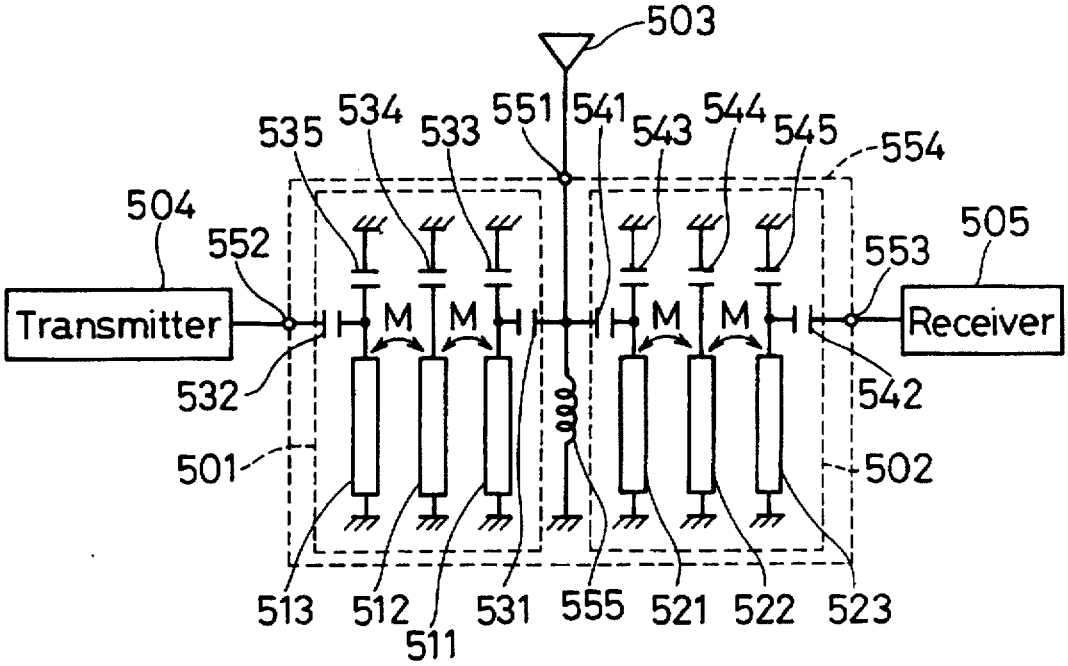
FIG. 41 is an equivalent circuit diagram of the laminated dielectric antenna duplexer in the sixteenth embodiment of the invention.

A laminated dielectric antenna duplexer in a sixteenth embodiment of the invention is described while referring to drawings. FIG. 40 is a perspective exploded view of a laminated dielectric antenna duplexer 554 in the sixteenth embodiment of the invention, and those elements corresponding to the elements in FIG. 38 are identified with the same reference numerals. FIG. 41 is an equivalent circuit diagram of the laminated dielectric antenna duplexer 554 of the sixteenth embodiment, and those elements corresponding to the elements in FIG. 39 are identified with the same reference numerals.

FIG. 40 differs from FIG. 38 in that the structure is divided into a top and bottom by a separation layer 489 composed by enclosing two dielectric sheets 485, 486 with two layers of shield electrode layers 452, 488, and that an inductor 555 formed of an electrode 487 is added as an impedance matching element on the intermediate dielectric sheet 485 of the separation layer 489.

The operation of the thus constituted laminated dielectric antenna duplexer 554 is the same as in the fifteenth embodiment except that the inductor 555 is added. As the inductor 555 is inserted between the antenna terminal and the ground, the impedance matching of the antenna 503 with the transmission filter 501 and reception filter 502 is achieved more favorably.

Thus, by comprising a plurality of dielectric sheets, at least four layers of shield electrode layers, and at least two layers of strip line resonator electrode layers, the structure is divided into a top and bottom by a separation layer enclosing the plurality of dielectric sheets with at least two layers of shield electrode layers, the dielectric sheets, shield electrode layers, and strip line resonator electrode layers are laminated and baked into one body to compose reception filter and transmission filter, the reception filter and transmission filter are laminated in upper and lower layers, and moreover an inductor is formed as impedance matching element on the intermediate dielectric sheet of the separation layer, so that a favorable matching characteristic may be realized, aside from the same effects as in the fifteenth embodiment.

EXAMPLE 17

Figure 42:
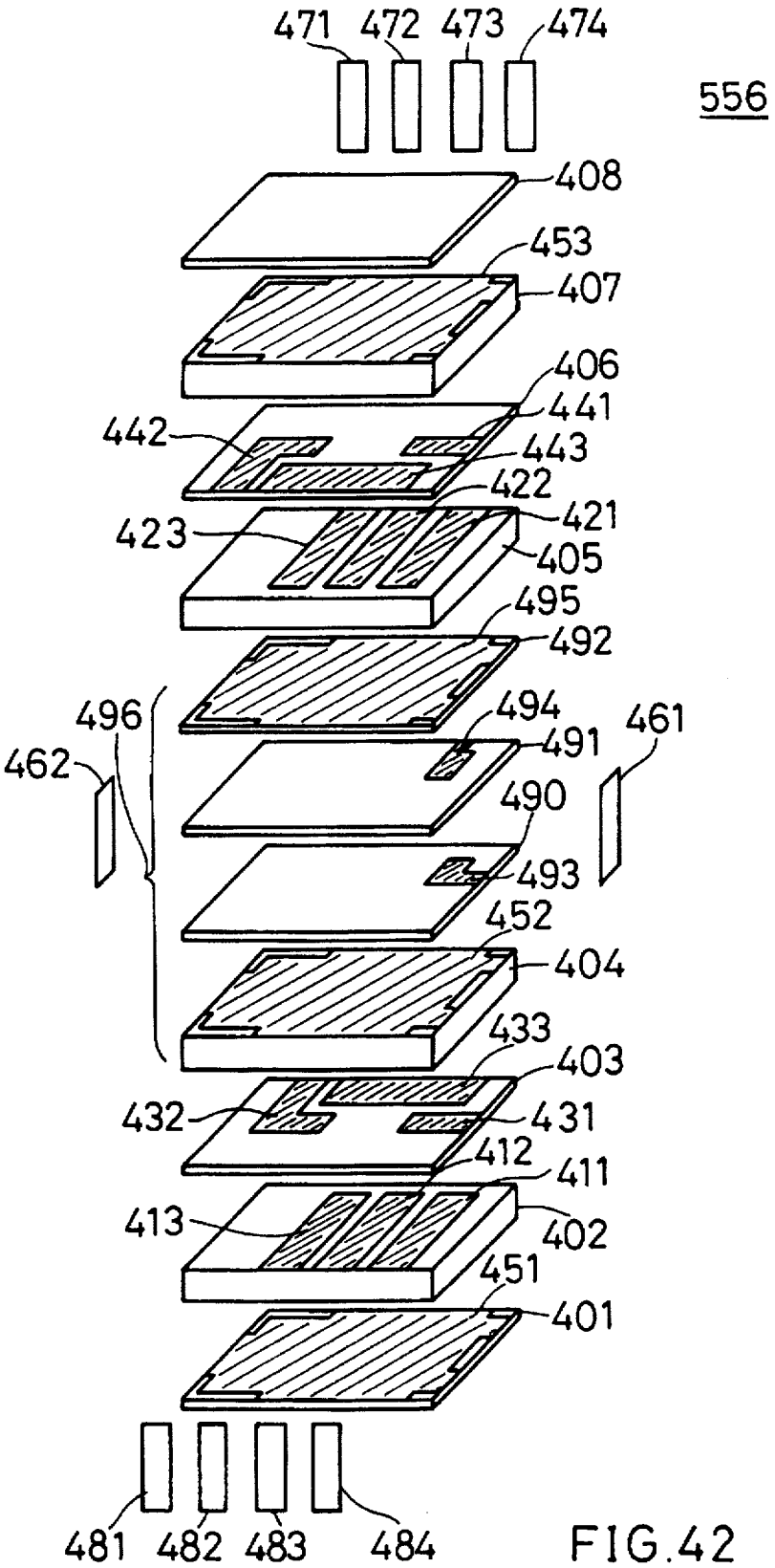
FIG. 42 is a perspective exploded view of a laminated dielectric antenna duplexer in a seventeenth embodiment of the invention.
Figure 43:
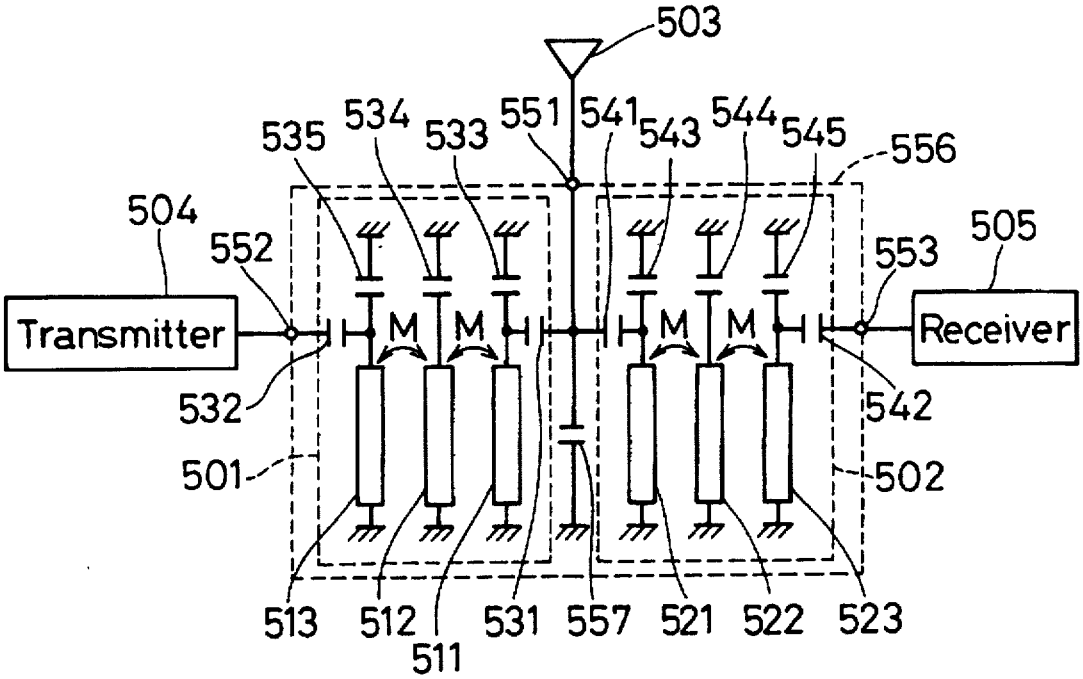
FIG. 43 is an equivalent circuit diagram of the laminated dielectric antenna duplexer in the seventeenth embodiment of the invention.

A laminated dielectric antenna duplexer in a seventeenth embodiment of the invention is described below. FIG. 42 is a perspective exploded view of a laminated dielectric antenna duplexer 556 showing the seventeenth embodiment of the invention, and those elements corresponding to the elements in FIG. 38 and FIG. 40 are identified with the same reference numerals. FIG. 43 is an equivalent circuit diagram of the laminated dielectric antenna duplexer 556 in the seventeenth embodiment. Those elements corresponding to the elements in FIG. 39 and FIG. 41 are identified with the same reference numerals.

FIG. 42 differs from FIG. 40 in that the structure is divided into a top and bottom by a separation layer 496 composed by holding three dielectric sheets 490, 491,492 with two shield electrode layers 452, 495, and that a capacitor 557 formed of electrodes 493, 494 is added as impedance matching element on the intermediate dielectric sheets 499, 491 of the separation layer 496.

The operation of the thus constituted laminated dielectric antenna duplexer 554 is the same as in the fifteenth embodiment except that the capacitor 557 is added. As the capacitor 557 is inserted between the antenna terminal and the ground, the impedance matching of the antenna 503 with the transmission filter 501 and reception filter 502 is achieved more favorably.

Thus, by comprising a plurality of dielectric sheets, at least four layers of shield electrode layers, and at least two layers of strip line resonator electrode layers, the structure is divided into a top and bottom by a separation layer enclosing the plurality of dielectric sheets with at least two layers of shield electrode layers, the dielectric sheets, shield electrode layers, and strip line resonator electrode layers are laminated and baked into one body to compose reception filter and transmission filter, the reception filter and transmission filter are laminated in upper and lower layers, and moreover a capacitor is formed as impedance matching element on the intermediate dielectric sheet of the separation layer, so that the same effects as in the fifteenth embodiment and sixteenth embodiment may be achieved.

In the laminated dielectric antenna duplexers in the fifteenth to seventeenth embodiments, the transmission filters and reception filters are comb-line type band pass filters for coupling the strip line resonators in the electromagnetic field, but band pass filters of other type than comb-line type for coupling with inductor or capacitor may be used, or band elimination filter or low pass filter may be also used. Various modifications of the transmission filter and reception filter are evident, and are included in the scope of the invention. As embodiments employing such modifications, an embodiment of laminated dielectric antenna duplexer using the laminated dielectric filter of the ninth embodiment as the transmission filter and reception filter, and an embodiment of laminated dielectric antenna duplexer using the modified laminated dielectric filter of the twelfth embodiment as the transmission filter and reception filter are described below.

EXAMPLE 18

Figure 44:
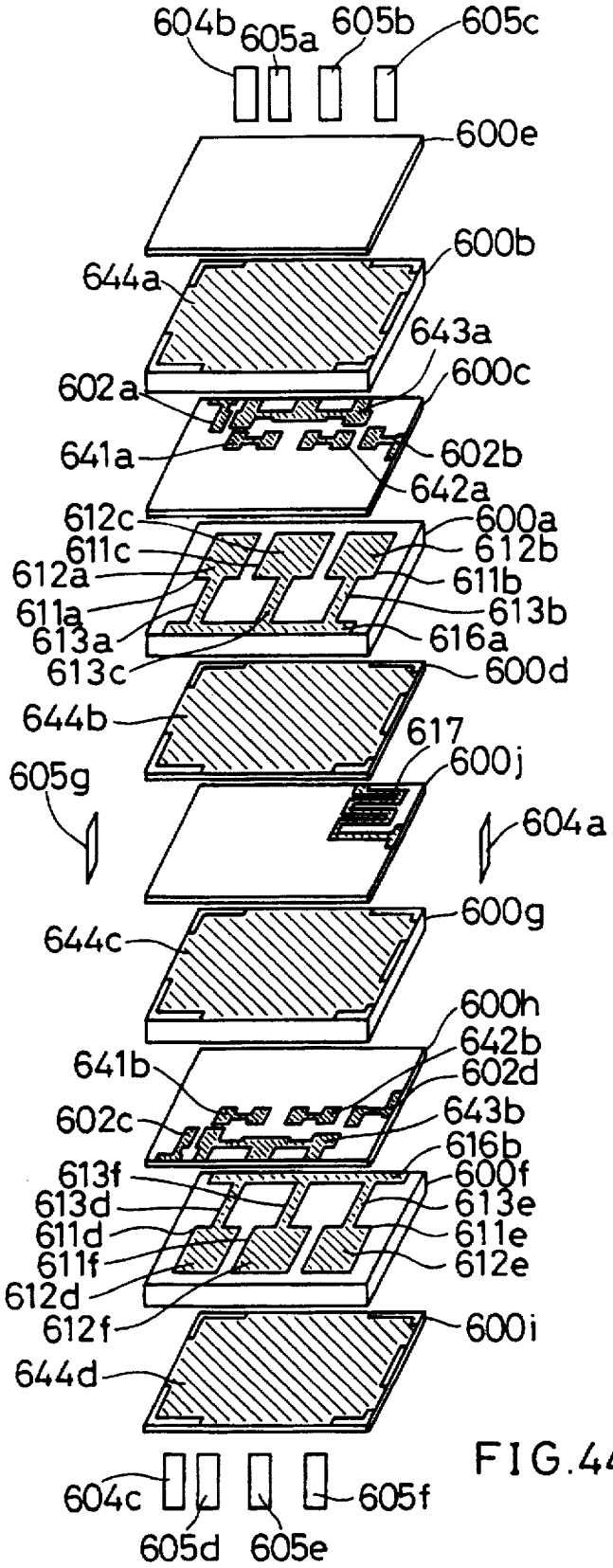
FIG. 44 is a perspective exploded view of a laminated dielectric antenna duplexer in an eighteenth embodiment of the invention.

A laminated dielectric antenna duplexer in an eighteenth embodiment of the invention is described below. FIG. 44 is a perspective exploded view of the laminated dielectric antenna duplexer showing the eighteenth embodiment of the invention. As mentioned above, in this embodiment, the laminated dielectric filter of the ninth embodiment is used as the transmission filter and reception filter.

In the constitution of the transmission filter and reception filter, strip line resonator electrodes 611*a* to 611*f* are formed on a dielectric sheet 600*a* and a dielectric sheet 600*f*, and each consists of broad parts 612*a* to 612*f*, and narrow parts 613*a* to 613*f*. The short-circuit end side of the narrow parts is connected and grounded to side electrodes 605*a* to 605*f* as grounding terminals, through broad common grounding electrodes 616a, 616*b*.

Electric field coupling between adjacent strip line resonators is achieved through second electrodes 641*a*, 642*a* formed on the dielectric sheet 600*c*, and second electrodes 641*b*, 642*b* formed on the dielectric sheet 600*h*. The adjacent strip line resonators are mutually coupled in electromagnetic field, and is coupled in electric field through interstage coupling capacitor, and coupling of strip line resonators is achieved by the combination of electromagnetic field coupling and electric field coupling. As a result, by the resonance phenomenon due to combination of electromagnetic field coupling and electric field coupling, an attenuation pole may be constituted in the transmission characteristic.

In the regions contacting the strip line resonator electrodes on the dielectric sheets 600*c*, 600*h*, third electrodes 643*a*, 643*b* are partly formed and grounded in the remaining regions of forming the second electrodes. Parallel flat plate capacitors composed between the third electrodes and strip line resonator electrodes function as parallel loading capacitors for lowering the resonance frequency of the strip line resonator. Therefore, the length of the strip line resonator may be set shorter than the quarter wavelength, so that the filter may be reduced in size.

Fourth electrodes 602a to 602d formed in the region contacting the strip line resonator electrode on the dielectric sheets 600*c*, 600*h* compose an input and output coupling capacitor together with the strip line resonator electrode. The fourth electrode 602*a* is connected to a side electrode 604*b* as a reception terminal, and the fourth electrode 602*c* is connected to a side electrode 604*c* as a transmission terminal, and the fourth electrodes 602*b*, 602*d* are connected to a side electrode 604*a* as an antenna terminal.

In the constitution of the laminated dielectric antenna duplexer of the embodiment, the structure is divided into a top and bottom by a separation layer constituted by enclosing two dielectric sheets 600*j*, 600*d* by two layers of shield electrode layers 644*b*, 644*c*, and an inductor is formed by an electrode 617 as an impedance matching element on the dielectric sheet 600*j*. Shield electrodes 644*a*, 644*d* are formed to cover the whole surface on the dielectric sheets 600*b*, 600*i*. In the uppermost layer, by laminating an electrode protective dielectric sheet 600*e*, the upper shield electrode layer 644*a* made of inner layer electrode not sufficient in mechanical strength is protected. The shield electrodes 644*a* to 644*d* are connected and grounded to the side electrodes 605*a* to 605*g*.

A reception filter is composed of dielectric sheets 600*a* to 600*e* and electrodes formed thereon, and a transmission filter is composed of dielectric sheets 600*f* to 600*i* and electrodes formed thereon. As the inductor composed of the electrode 617 formed on the dielectric sheet 600*j* is inserted between the antenna terminal and ground, the impedance matching of the antenna with the transmission filter and reception filter may be achieved favorably.

Thus, the laminated dielectric antenna duplexer of the embodiment has the same effects as in the sixteenth embodiment, and moreover by using the laminated dielectric filter of the ninth embodiment in the transmission filter and reception filter, an attenuation pole is formed in the transmission characteristic, and excellent selectivity is achieved.

EXAMPLE 19

Figure 45:
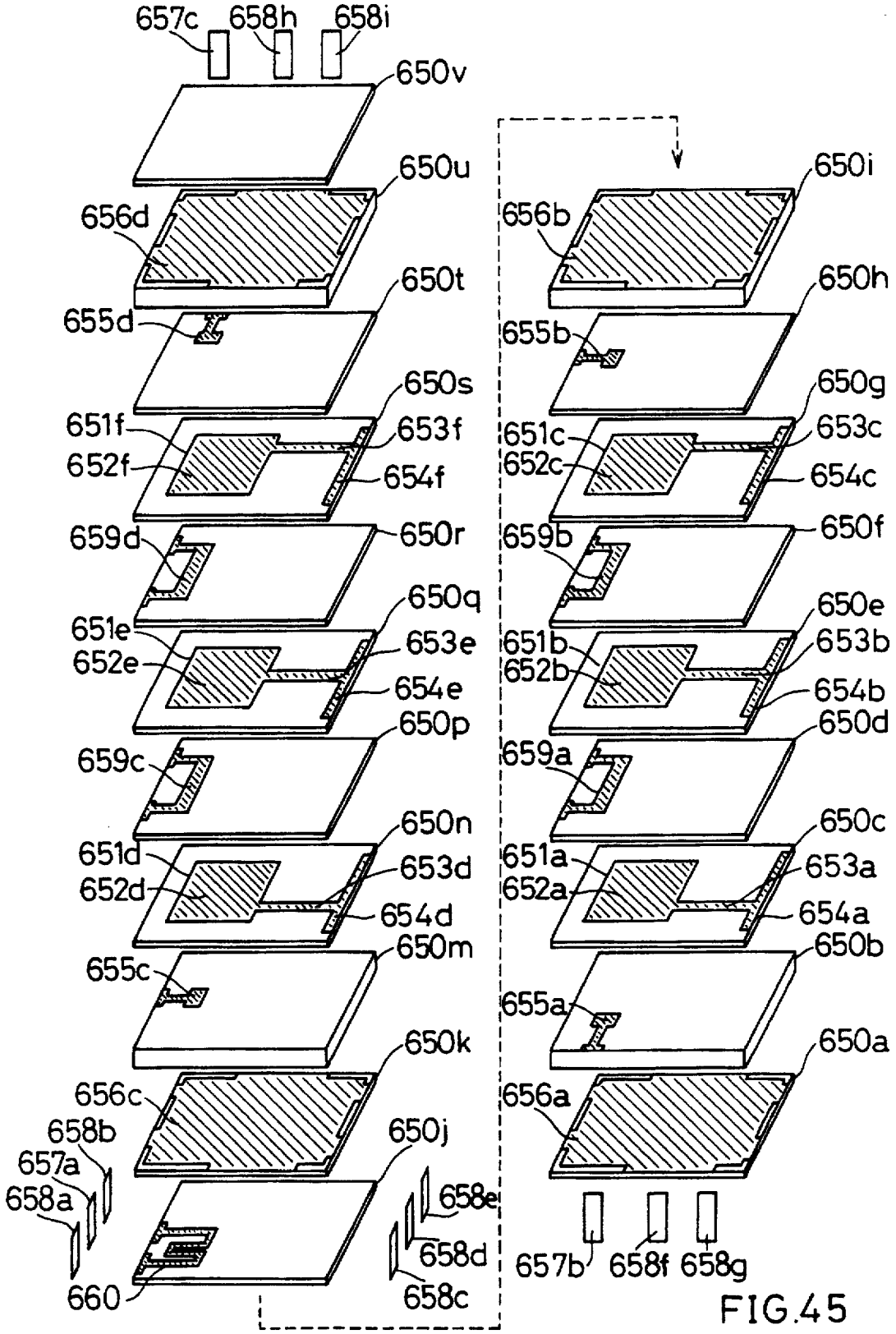
FIG. 45 is a perspective exploded view of a laminated dielectric antenna duplexer in a nineteenth embodiment of the invention.
Figure 46:
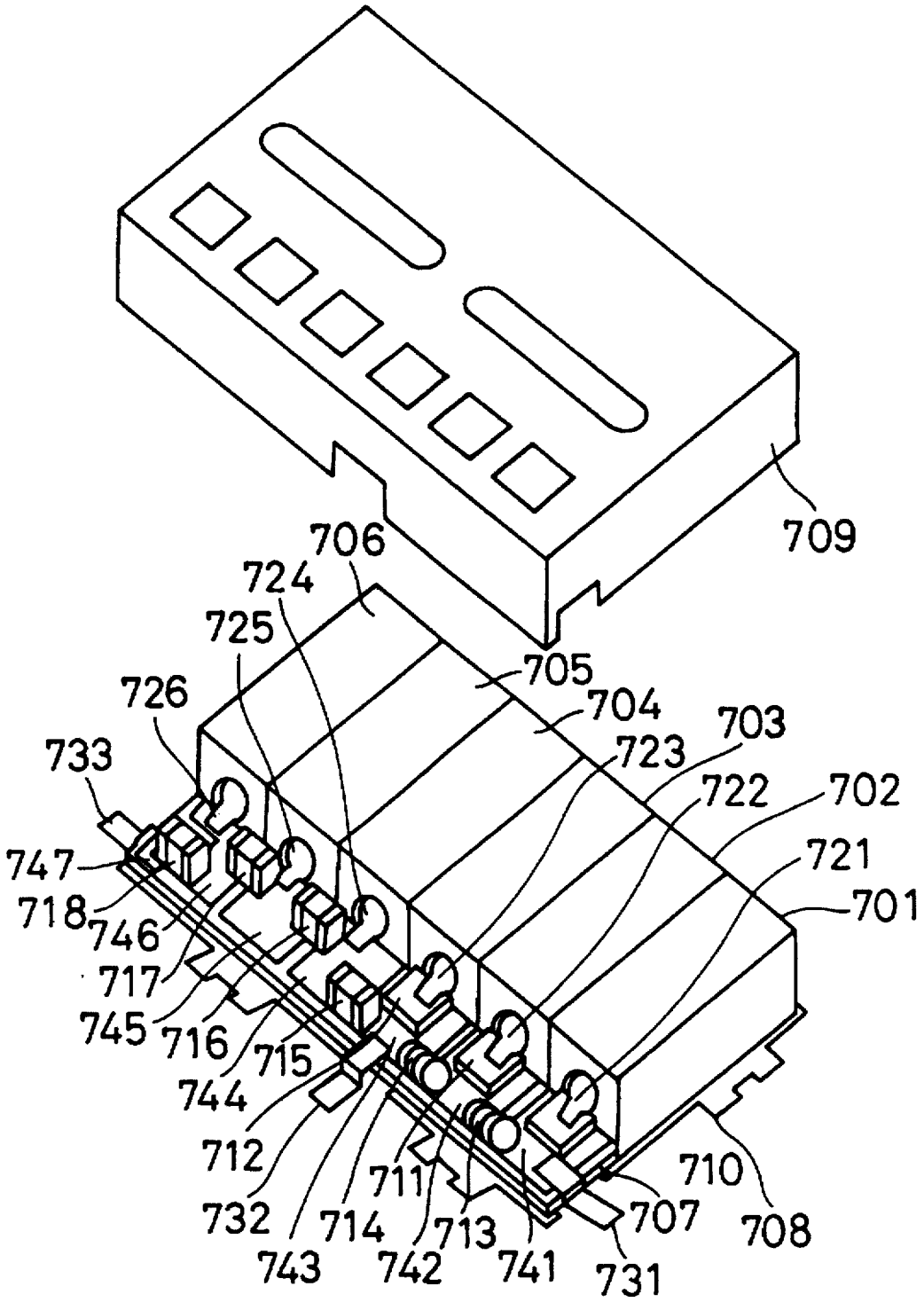
(PRIOR ART) FIG. 46
FIG. 46 is a perspective exploded view of a dielectric antenna duplexer of the prior art.
Figure 47:
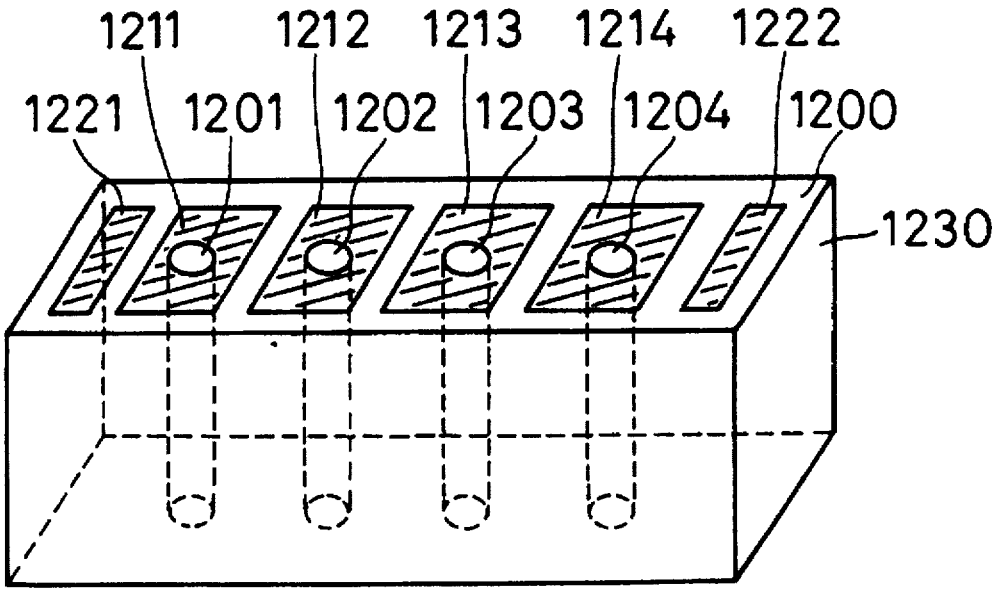
(PRIOR ART) FIG. 47
FIG. 47 is a perspective view of a block dielectric filter of the prior art.
Figure 48:
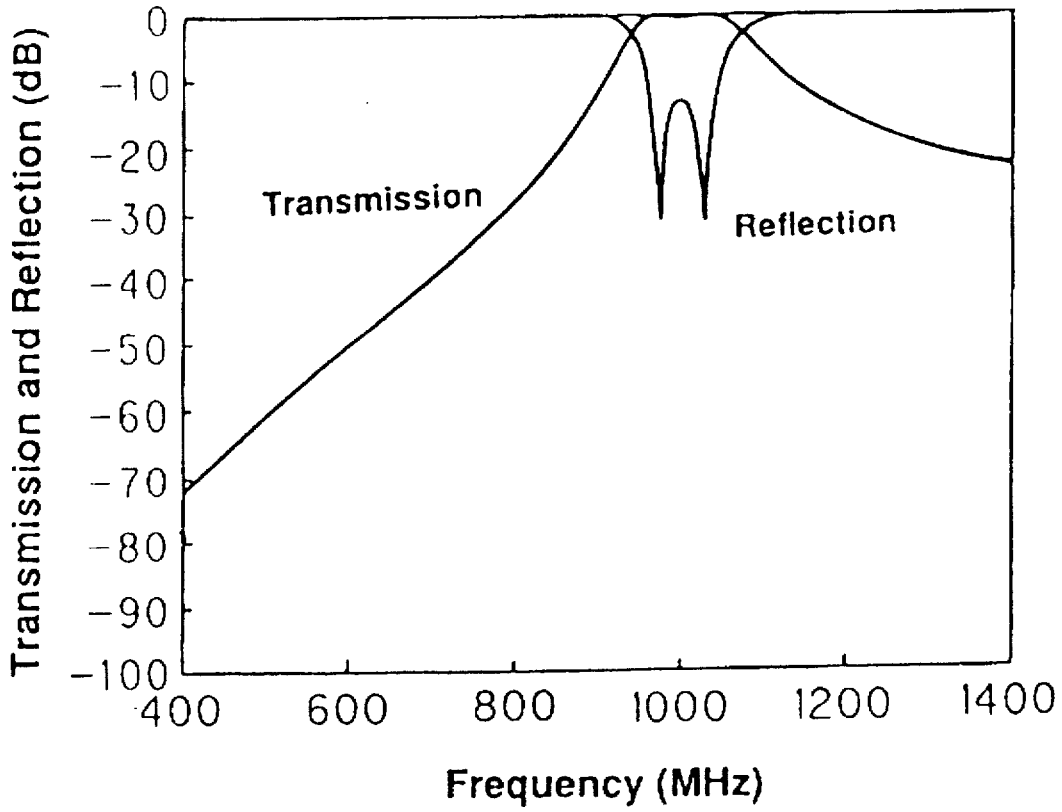
FIG. 48 is a graph showing transmission characteristic and reflection characteristic of a comb-line dielectric filter of the prior art.
Figure 49:
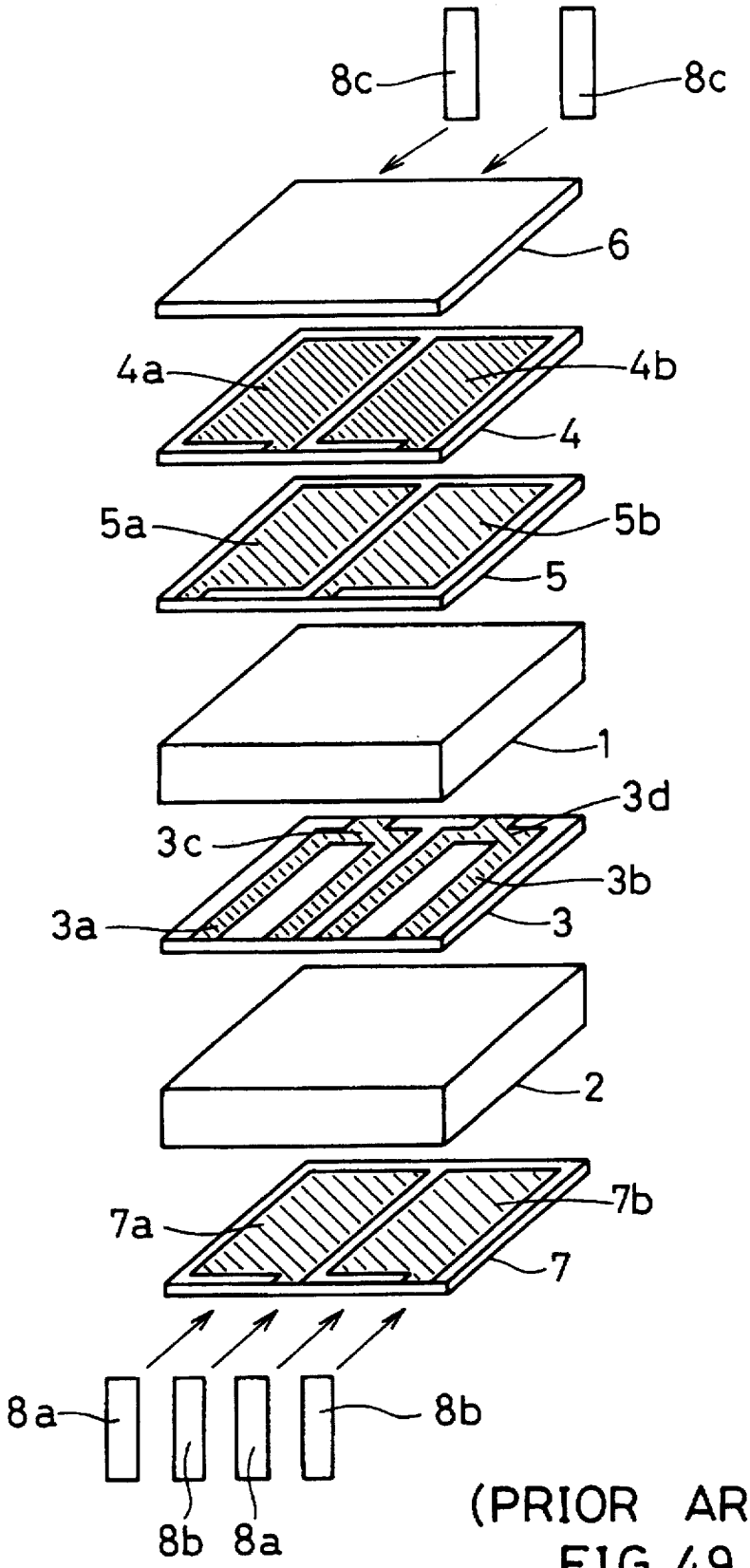
(PRIOR ART) FIG. 49
FIG. 49 is a perspective exploded view of a laminated LC filter of the prior art.
Figure 50:
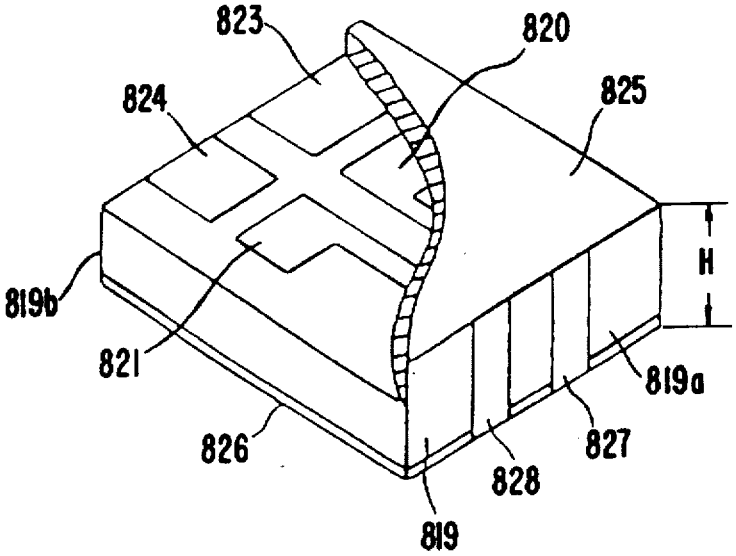
FIG. 50(*a*) and (*b*) is a perspective view of a laminated dielectric filter of the prior art.
Figure 50:
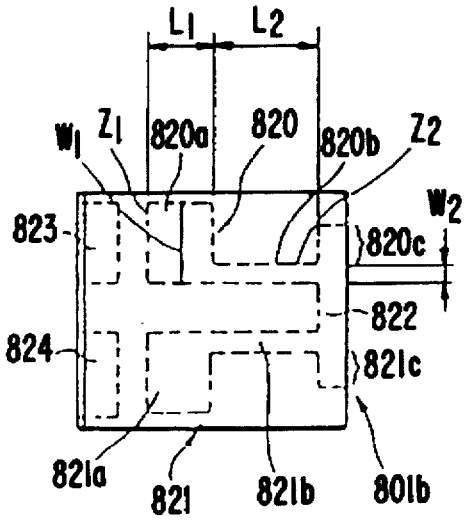

A laminated dielectric antenna duplexer in a nineteenth embodiment of the invention is described below. FIG. 45 is a perspective exploded view of the laminated dielectric antenna duplexer of the nineteenth embodiment of the invention. As mentioned above, in this embodiment, a modified laminated dielectric filter of the twelfth embodiment is used as the transmission filter and reception filter.

In the constitution of the transmission filter and reception filter, strip line resonator electrodes 651*a* to 651*f* are formed on dielectric sheets 650*c*, 650*e*, 650*g*, and dielectric sheets 650*g*, 650*q*, 650*s*, and each one is composed of broad parts 652*a* to 652*f*, and narrow parts 653*a* to 653*f*. The short-circuit end side of the narrow parts is connected and grounded to side electrodes 658*c* to 658*e* as grounding terminals through broad grounding electrodes 654*a* to 654*f*.

On the dielectric sheets 650*b*, 650*h*, 650*m*, 650*t*, input and output coupling capacity electrodes 655*a* to 655*d* confronting the strip line resonator electrodes are formed. The input and output coupling capacity electrode 655*d* is connected to the side electrode 657*c* as reception terminal, the input and output coupling capacity electrode 655*a* is connected to the side electrode 657*b* as a transmission terminal, and the input and output coupling capacity electrodes 655*b*, 655*c* are connected to the side electrode 657*a* as an antenna terminal.

In the region contacting the strip line resonator electrodes on the dielectric sheets 650*d*, 650*f*, 650*p*, 650*r*, loading capacitor electrodes 659*a*, 650*d* are formed. The loading capacitor electrodes 659*a*, 650*d* are connected and grounded to the side electrodes 658*a*, 658*b*. These capacitors function to lower the resonance frequency of the strip line resonator. Therefore, the length of the strip line resonator can be cut further shorter than the shortening by the SIR structure, so that the filter may be further reduced in size. This point is a slightly modified point of the laminated dielectric filter in the twelfth embodiment.

In the transmission filter and reception filter of the embodiment, in SIR structure, the electromagnetic field coupling amounts of the first transmission lines and second transmission lines are independently set, and a passing band and attenuation pole are generated in the transmission characteristic. The strip line resonator electrodes 651*a*, 651*f* are laminated up and down by aligning the direction of the grounding ends, and the broad parts 652*a* to 652*f*, and narrow parts 653*a* to 653*f* are mutually coupled in electromagnetic field.

The electromagnetic field coupling amount of the strip lines is adjusted by shifting the strip line position in the vertical direction. By shifting the line center lines of the broad parts and narrow parts of the strip lines from the same line, the electromagnetic field coupling of the broad parts of the strip lines, and the electromagnetic field coupling of the narrow parts can be set independently. By thus setting the coupling amount independently, it is possible to design to form an attenuation pole at a desired frequency. By independent electromagnetic field coupling of the open end side broad parts and grounding end side narrow parts, not only the band passing characteristic is shown in the passing region, but also an attenuation pole may be formed at a desired frequency of transmission characteristic. Therefore, a selectivity characteristic superior to Chebyshev characteristic may are obtained.

In the constitution of the laminated dielectric antenna duplexer in the embodiment, the structure is divided into a top and bottom by a separation layer constituted by enclosing two dielectric sheets 650*j*, 650*d* by two layers of shield electrode layers 656*b*, 656*c*, and a inductor is formed by an electrode 660 as an impedance matching element on the dielectric sheet 650*j*. Shield electrodes 656*a*, 656*d* are formed to cover the whole surface on the dielectric sheets 650*a*, 650*u*. In the uppermost layer, by laminating an electrode protective dielectric sheet 650*v*, the upper shield electrode layer 656*d* made of inner layer electrode not sufficient in mechanical strength is protected. The shield electrodes 656*a* to 656*d* are connected and grounded to the side electrodes 658*a* to 658*i*.

A reception filter is composed of dielectric sheets 650*k* to 650*v* and electrodes formed thereon, and a transmission filter is composed of dielectric sheets 650*a* to 650*i* and electrodes formed thereon. As the inductor composed of the electrode 660 formed on the dielectric sheet 650*j* is inserted between the antenna terminal and ground, the impedance matching of the antenna with the transmission filter and reception filter may be achieved favorably.

Thus, the laminated dielectric antenna duplexer of the embodiment has the same effects as in the sixteenth embodiment, and moreover by using the modified laminated dielectric filter of the twelfth embodiment in the transmission filter and reception filter, an attenuation pole is formed in the transmission characteristic, and an excellent selectivity may be realized.

The invention may be embodied in other specific forms without departing from the spirit or essential characteristics thereof.

The above embodiments are to be considered in all respects as illustrative and not restrictive, the scope of the invention being indicated by the appended claims rather than by the foregoing description and all changes which come within the meaning and range of equivalency of the claims are intended to be embraced therein.

What is claim is:

1. A dielectric filter comprising at least two TEM mode resonators having a stepped impedance resonator structure with a total line length of each of the resonators being shorter than a quarter wavelength of a center frequency of a passband of the filter, the stepped impedance resonator structure comprising a cascade connection of both ends of first transmission line sections having characteristic impedances and being grounded at one end, and second transmission line sections opened at one end and having characteristic impedances lower than the characteristic impedances of the first transmission line sections, wherein the first transmission line sections are coupled to each other electromagnetically with even-mode impedance Ze1 and odd-mode impedance Zo1, wherein the second transmission line sections are coupled to each other electromagnetically with even-mode impedance Ze2 and odd-mode impedance Zo2, and wherein a ratio P1 defined as Ze1 divided by Zo1 and a ratio P2 defined as Ze2 divided by Zo2 are set independently so as to generate the passband and an attenuation pole in the transmission characteristic of the filter with the attenuation pole frequency being controlled relative to the center frequency of the passband.

2. The dielectric filter of claim 1, wherein the open end of the TEM mode resonator is grounded with an electrical capacity.

3. The dielectric filter of claim 1, wherein at least two TEM mode resonators and input and output terminals are coupled capacitively.

4. The dielectric filter of claim 1, wherein the attenuation pole frequency of the transmission characteristic is adjusted by varying the line distance of the first transmission lines and the line distance of the second transmission lines.

5. The dielectric filter of claim 1, wherein the first and second transmission lines have a line length equal to each other.

6. The block type dielectric filter of claim 1, wherein the TEM mode resonator is comprised of an integrated coaxial resonator formed of a penetration hole provided in a dielectric block.

7. The dielectric filter of claim 1, wherein the TEM mode resonator is comprised of a strip line resonator formed on a dielectric sheet.

8. The dielectric filter of claim 1, wherein the value of dividing the even mode impedance by the odd mode impedance of the first transmission lines is set larger than the value of dividing the even mode impedance by the odd mode impedance of the second transmission lines.

9. The dielectric filter of claim 1, wherein the value of dividing the even mode impedance by the odd mode impedance of the first transmission lines is set smaller than the value of dividing the even mode impedance by the odd mode impedance of the second transmission lines.

10. The dielectric filter of claim 1, wherein the value of dividing the even mode impedance of the second transmission lines by the even mode impedance of the first transmission lines is set at 0.2 to 0.8.

11. The dielectric filter of claim 1, wherein the value of dividing the even mode impedance of the second transmission lines by the even mode impedance of the first transmission lines is set at 0.4 to 0.6.

12. The dielectric filter of claim 1, wherein at least two TEM mode resonators are capacitively coupled by capacity coupling means provided separately, and coupling of the TEM mode resonators is achieved by combination of electromagnetic field coupling and capacity coupling.

13. The dielectric filter of claim 12, wherein capacity coupling by the capacity coupling means is achieved in the second transmission lines.

14. The dielectric filter of claim 12, wherein capacity coupling by the capacity coupling means is achieved at the open end of the TEM mode resonator.

15. The dielectric filter of claim 12, wherein the open end of the TEM mode resonator is grounded through the capacity coupling means.

16. The dielectric filter of claim 12, wherein at least two TEM mode resonators and input and output terminals are coupled capacitively.

17. The dielectric filter of claim 12, wherein the attenuation pole frequency of the transmission characteristic is adjusted by varying the line distance of the first transmission lines and the line distance of the second transmission lines.

18. The dielectric filter of claim 12, wherein the first and second transmission lines have a line length equal to each other.

19. The block type dielectric filter of claim 12, wherein the TEM mode resonator is comprised of an integrated coaxial resonator formed of a penetration hole provided in a dielectric block.

20. The dielectric filter of claim 12, wherein the TEM mode resonator is comprised of a strip line resonator formed on a dielectric sheet.

21. The dielectric filter of claim 12, wherein the value of dividing the even mode impedance by the odd mode impedance of the first transmission lines is set larger than the value of dividing the even mode impedance by the odd mode impedance of the second transmission lines.

22. The dielectric filter of claim 12, wherein the value of dividing the even mode impedance by the odd mode impedance of the first transmission lines is set smaller than the value of dividing the even mode impedance by the odd mode impedance of the second transmission lines.

23. The dielectric filter of claim 12, wherein the attenuation pole of transmission characteristic is formed in a frequency range within 15% on both sides of the polarity of the center frequency.

24. The dielectric filter of claim 12, wherein the value of dividing the even mode impedance of the second transmission lines by the even mode impedance of the first transmission lines is set at 0.2 to 0.8.

25. The dielectric filter of claim 12, wherein the value of dividing the even mode impedance of the second transmission lines by the even mode impedance of the first transmission lines is set at 0.4 to 0.6.

26. A laminated dielectric filter comprising a strip line resonator electrode layer forming plural strip line resonators, and a capacity electrode layer forming input and output coupling capacitors and an interstage coupling capacitor, wherein the strip line resonator electrode layer and the capacity electrode layer are sandwiched by two shield electrode layers, wherein a space between the two shield electrode layers is filled with a dielectric, and wherein a thickness of a space between the strip line resonator electrode layer and the capacity electrode layer is less than a thickness of a space between the strip line resonator electrode layer and one of the shield electrode layers and a thickness of a space between the capacity electrode layer and the other of the shield electrode layers, wherein an interstage coupling capacity electrode, or input and output coupling capacity electrode, or loading capacity electrode formed on the capacity electrode layer has a dent narrowed in the electrode width in the region overlapping with the outer edge of the strip line resonator electrode of the strip line resonator electrode layer.

27. A laminated dielectric filter comprising a strip line resonator electrode layer forming plural strip line resonators, and a capacity electrode layer forming input and output coupling capacitors and an interstage coupling capacitor, wherein the strip line resonator electrode layer and the capacity electrode layer are sandwiched by two shield electrode layers, wherein a space between the two shield electrode layers is filled with a dielectric, and wherein a thickness of a space between the strip line resonator electrode layer and the capacity electrode layer is less than a thickness of a space between the strip line resonator electrode layer and one of the shield electrode layers and a thickness of a space between the capacity electrode layer and the other of the shield electrode layers, wherein the laminated dielectric filter has an input and output coupling capacity electrode on the capacity electrode layer, and the strip line resonator has a front end short-circuit structure, and moreover the input and output coupling capacity electrode and strip line resonator are coupled capacitively at an intermediate position between the open end and short-circuit end of the strip line resonator.

28. The laminated dielectric filter of claim 27, wherein input and output terminals electrically connected to the input and output coupling capacity electrode are formed of side electrodes provided in the lateral direction of the strip line resonator.

29. A laminated dielectric filter comprising a first strip line resonator disposed on a first shield electrode through a first dielectric sheet with a thickness $t_1$, second to n-th strip line resonators disposed on the first strip line resonator through second to n-th dielectric sheets with thicknesses of $t_2$ to $t_n$ (where n is greater than two), and a second shield electrode disposed on the n-th strip line resonator through an (n+1)-th dielectric sheet with thickness $t_{n+1}$, setting a maximum thickness of $t_2$ to $t_n$ smaller than $t_1$ or $t_{n+1}$, wherein the first dielectric sheet and the (n+1)-th dielectric sheet includes a laminated plurality of thin dielectric sheets, whereby an input and output coupling capacity electrode is formed in one of the thin dielectric sheets of the first dielectric sheet and in one of the thin dielectric sheets of the (n+1)-th dielectric sheet.

30. The laminated dielectric filter of claim 29, wherein the first shield electrode and second shield electrode are formed of inner layer electrodes enclosed by dielectric sheets.

31. The laminated dielectric filter of claim 29, wherein the position of the center line of the first to n-th strip line resonators is shifted to overlap in the lateral direction in every one of the first to n-th dielectric sheets.

32. The laminated dielectric filter of claim 29, wherein the first to n-th strip line resonators are used as front end short-circuit strip line resonators, and are laminated by aligning the direction of the short-circuit ends.

33. The laminated dielectric filter of claim 32, wherein broad grounding electrodes are disposed at the short-circuit end side of the first to n-th strip line resonators, grounding side shield electrodes are provided by outer electrodes on the side of the short-circuit end side of the strip line resonator of the dielectric composed of the first to (n+1)-th dielectric sheets, and the short-circuit end of the strip line resonator is connected and grounded to the grounding side shield electrode through the grounding electrode.

34. The laminated dielectric filter of claim 32, wherein an input and output coupling capacity electrode is formed respectively in one of the thin dielectric sheets of the first dielectric sheet, and in one of the thin dielectric sheets of the (n+1)-th dielectric sheet, the take-out direction of the input and output coupling capacity electrode is the right side direction of the strip line resonator in one, and the left side direction of the strip line resonator in the other, and they are connected as input and output terminals to the side input and output electrodes formed of outer electrodes, provided at the right and left sides of the laminate comprised by the first to (n+1)-th dielectric sheets.

35. The laminated dielectric filter of claim 32, wherein side shield electrodes are formed of outer electrodes at the sides of the laminate composed of the first to (n+1)-th dielectric sheets.

36. The laminated dielectric filter of claim 32, wherein an open side shield electrode is formed of outer electrode at the side of the open end side of the strip line resonator of the laminate composed of the first to (n+1)-th dielectric sheets.

37. The laminated dielectric filter of claim 32, wherein the line width at the short-circuit end side of the first to n-th strip line resonators is narrower than the line width of the open end side.

38. The laminated dielectric filter of claim 37, wherein the line distance of the short-circuit end side of the first to n-th strip line resonators is different from the line distance of the open end side.

39. The laminated dielectric filter of claim 37, wherein the positions of the center lines of open end side of the first to n-th strip line resonators are aligned vertically, and the positions of the center lines of the short-circuit end side are shifted to overlap in the lateral direction in every one of the first to n-th dielectric sheets.

40. A laminated dielectric filter of claim 32, wherein the line width of the short-circuit end side of the first to n-th strip line resonators is set broader than the line width of the open end side.

41. The laminated dielectric filter of claim 40, wherein the line distance of the short-circuit end side of the first to n-th strip line resonators is different from the line distance of the open end side.

42. The laminated dielectric filter of claim 40, wherein the positions of the center lines of short-circuit end side of the first to n-th strip line resonators are aligned vertically, and the positions of the center lines of the open end side are shifted to overlap in the lateral direction in every one of the first to n-th dielectric sheets.

* * * * *